US005585231A

United States Patent [19]

Yamada et al.

[11] Patent Number: 5,585,231

[45] Date of Patent: Dec. 17, 1996

[54] HEAT DEVELOPABLE COLOR LIGHT-SENSITIVE MATERIAL WITH PYRAZOLOTRIAZOLE CONTAINING DYE

[75] Inventors: Makoto Yamada; Naoto Matsuda; Yasuhiro Ishiwata; Osamu Uchida; Michio Ono, all of Kanagawa, Japan

[73] Assignee: Fuji Photo Film Co., Ltd., Kanagawa, Japan

[21] Appl. No.: 439,253

[22] Filed: May 11, 1995

Related U.S. Application Data

[62] Division of Ser. No. 227,382, Apr. 14, 1994, abandoned.

[30] Foreign Application Priority Data

| | | | |
|---|---|---|---|
| Apr. 14, 1993 | [JP] | Japan | 5-109811 |
| Apr. 14, 1993 | [JP] | Japan | 5-109830 |
| Mar. 16, 1994 | [JP] | Japan | 6-70192 |

[51] Int. Cl.[6] ..... G03C 8/40; G03C 8/20; G03C 8/10

[52] U.S. Cl. ..... 430/562; 430/303; 430/222; 430/223; 430/226; 430/563

[58] Field of Search ..... 430/203, 222, 430/223, 225, 226, 561, 562, 563

[56] References Cited

U.S. PATENT DOCUMENTS

| | | | |
|---|---|---|---|
| 4,663,273 | 5/1987 | Van De Sande et al. | 430/223 |
| 4,721,667 | 1/1988 | Sato et al. | 430/223 |
| 4,770,981 | 9/1988 | Komamura et al. | 430/203 |
| 4,871,654 | 10/1984 | Vanmaele et al. | 430/223 |
| 5,326,684 | 7/1994 | Aotsuka | 430/203 |

FOREIGN PATENT DOCUMENTS

| | | | |
|---|---|---|---|
| 0149260 | 7/1985 | European Pat. Off. | G03C 5/54 |
| 0220746 | 5/1987 | European Pat. Off. | G03C 7/32 |
| 0333193 | 9/1989 | European Pat. Off. | G03C 7/26 |

*Primary Examiner*—Richard L. Schilling
*Attorney, Agent, or Firm*—Sughrue, Mion, Zinn, Macpeak & Seas

[57] ABSTRACT

A heat developable color light-sensitive material containing at least light-sensitive silver halide, a binder, and a dye-providing compound on a support, wherein at least one of the compounds represented by formula (1) is contained as the above dye-providing compound, and the amount of the above binder is 5 g/m$^2$ or less:

$$[(\mathrm{Dye})_p\mathrm{X}]_q\mathrm{Y} \qquad (1)$$

wherein variables in the above formula are defined in the specification. The heat developable color light-sensitive material which provides an excellent discrimination of an image and is less susceptible to an influence by a fluctuation in a development processing condition.

7 Claims, No Drawings

HEAT DEVELOPABLE COLOR LIGHT-SENSITIVE MATERIAL WITH PYRAZOLOTRIAZOLE CONTAINING DYE

This is a divisional of application Ser. No. 08/227,382 filed 14 Apr. 1994, now abandoned.

FIELD OF THE INVENTION

The present invention relates to a heat developable color light-sensitive material, specifically to a heat developable color light-sensitive material which provides an excellent discrimination of an image and is less susceptible to an influence by a fluctuation in a development processing condition.

BACKGROUND OF THE INVENTION

A heat developable color light-sensitive material is publicly known in this technical field, and the heat developable color light-sensitive material and the process thereof are described in, for example, "Base of A Photography" a non-silver salt photography series (published by Corona Co., Ltd., 1982), pp. 242 to 255, and U.S. Pat. No. 4,500,626.

In addition to the above, a process by which a dye image is formed, for example, by a reaction of an oxidation product of a developing agent with a coupler is described in U.S. Pat. Nos. 3,761,270 and 4,021,240. Further, a process by which a positive color image is formed according to a light-sensitive silver dye-bleaching process is described in U.S. Pat. No. 4,235,957.

In recent years, there is proposed a process by which a diffusible dye is imagewise released or formed by a heat development and this diffusible dye is transferred on a dye-fixing element. In this process, the kind of a dye-providing compound used or the kind of silver halide used can be changed to change either a dye image in a negative or a dye image in a positive. More details are described in U.S. Pat. Nos. 4,500,626, 4,483,914, 4,503,137, and 4,559,290, JP-A-58-1449046 (the term "JP-A" as used herein means an unexamined published Japanese patent application), JP-A-60-133449, JP-A-59-218443, and JP-A-61-238056, European Patent Publication 220746A2, Published Technical Report 87-6199, and European Patent Publication 210660A2.

Many processes are proposed as well regarding a process by which a positive color image by a heat development is obtained. There is proposed in U.S. Pat. No. 4,559,290, for example, a process in which a compound obtained by converting a so-called DDR compound to an oxidation type having no dye-releasing ability is allowed to coexist with a reducing agent of the precursor thereof, the reducing agent is oxidized by a heat development according to an exposure of silver halide and a diffusible dye is released by reducing with the reducing agent remained without being oxidized. Further, there is described in European Patent Publication 220746A and Published Technical Report 87-6199 (vol. 12, No. 22), a heat developable color light-sensitive material using a compound releasing a diffusible dye by reductive cleavage of an N—X bond (X represents an oxygen atom, a nitrogen atom or a sulfur atom) as a compound releasing the diffusible dye by a similar system.

A pyrazolonazo yellow dye and a phenolazo yellow dye are widely used as a yellow dye used in these heat developable color light-sensitive materials. With respect to these dyes, the dye-providing compounds releasing these yellow dyes are described in, for example, JP-A-52-7727 and 54-79031, and U.S. Pat. No. 4,473,672.

It is desired in these diffusion transfer type heat developable color light-sensitive materials that a dye having a high diffusibility is released in order to form an image in a short time. It is described in JP-A-61-261738 to use a compound having a high diffusibility and a-high light fastness as compared with the yellow dyes described above.

However, it was found that the heat developable color light-sensitive materials using these compounds were susceptible to a fluctuation in the development processing conditions (particularly a development processing temperature), particularly at a middle density part of a yellow color phase and that an unevenness was generated on an image obtained in some cases.

SUMMARY OF THE INVENTION

Accordingly, an object of the present invention is to provide a heat developable color light-sensitive material with which an image having an excellent discrimination can be formed in a short time and which is less susceptible to an fluctuation in a development processing condition.

Another object of the present invention is to provide a heat developable color light-sensitive material in which an image obtained is less degraded (reduction of a density and lowering of a sharpness) even after it is left for a long time or under a severer condition.

The objects of the present invention have been achieved by the following constitution:

A heat developable color light-sensitive material containing at least light-sensitive silver halide, a binder, and a dye-providing compound on a support, wherein at least one of the compounds represented by formula (1) is contained as the above dye-providing compound, and the amount of the above binder is 5 g/m$^2$ or less:

$$[(\mathrm{Dye})_p\mathrm{X}]_q\mathrm{Y} \qquad (1)$$

wherein Dye represents a dye group or a dye precursor group represented by formula (2); Y represents a group having a nature by which a diffusibility of a dye component is differentiated corresponding or inversely corresponding with a light-sensitive silver halide having imagewise a latent image; X represents a mere bond or a linkage group; p represents an integer of 1 or more and q represents 1 or 2; and when p is 2 or more and q is 2, all of Dye or $(\mathrm{Dye})_p$-X may be the same of different:

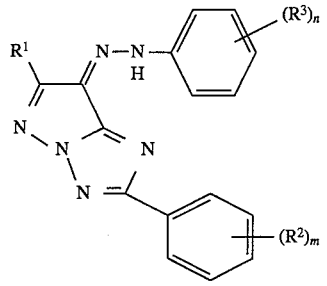

(2)

wherein $R^1$ represents a substituent selected from a hydrogen atom, a halogen atom, a hydroxyl group, a cyano group, a nitro group a carboxyl group, a substituted or non-sabstituted alkyl group, an aralkyl group, a cycloalkyl group, an aryl group, a heterocycle residue, an alkoxy group, an aryloxy group, an amino group, an acylamino group, a sulfonylamino group, an acyl group, a sulfonyl group, a carbamoyl group, a sulfamoyl group, a ureido group, an alkylthio group, and an arylthio group; $R^2$ and $R^3$ which may be the same of different, each is the same as $R^1$, except that a hydrogen atom which is a substituent defined in $R^1$ is excluded; m and n each represents an integer of 0 to 5, and when m or n is 2 or more, m $R^2$ or n $R^3$ may the same or different; and Dye and X are bonded via any of $R^1$, $R^2$ and $R^3$ in formula (2).

It is difficult to expect that the above light-sensitive material which is less susceptible to an influence of a fluctuation in a development processing condition can be obtained by that at least one of the compound represented by formula (1) is incorporated as a dye-providing compound in the present invention and further that the above binder is 5 $g/m^2$ or less.

The compound represented by formula (1) for case in the present invention will be explained below in further details.

First of all, X is explained.

X is a mere bond or a linkage group. When X is a linkage group, represents an alkylene group, a substituted alkylene group, an arylene group, a substituted arylene group, a heterocyclic group, —O—, —$SO_2$—, —CO—, —$NR^4$— ($R^4$ represents a hydrogen atom, an alkyl group, an aryl group, or an aralkyl group), or a group obtained by combining two or more of them.

There can be enumerated as the preferred linkage group, —$NR^4SO_2$—, —$NR^4CO$—, —O—, —$SO_2$—, and a group obtained by combining them with a substituted or non-substituted alkylene group (for example, methylene, ethylene, and propylene) and an arylene group (for example, o-phenylene, m-phenylene, p-phenylene, and 1,4-naphthylene).

In the case where X has a substituent, there can be enumerated as the preferred group, an alkyl group, an aralkyl group (an alkyl group which may be substituted and an aralkyl group, for example, methyl, trifluoromethyl, benzyl, chloromethyl, dimethylaminomethyl, ethoxycarbonylmethyl, aminomethyl, acetylaminomethyl, ethyl, carboxyethyl, allyl, 3,3,3-trichloropropyl, n-propyl, iso-propyl, n-butyl, iso-butyl, sec-butyl, t-butyl, n-pentyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, and t-octadecyl);

an alkenyl group (an alkenyl group which may be substituted, for example, vinyl, 2-chlorovinyl, 1-methylvinyl, 2-cynovinyl, and cyclohexene-1-yl);

an alkynyl group (an alkynyl group which may be substituted, for example, ethynyl, 1-propynyl, and 2-ethoxycarbonylethynyl);

an aryl group (an aryl group which may be substituted, for example, phenyl, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-acetylaminophenyl, 4-methanesulfonylphenyl, and 2,4-dimethylphenyl);

a hetercyclic group (a hetercyclic group which may be substituted, for example, 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazoline-2-yl, and morpholino);

an acyl group (an acyl group which may be substituted, for example, acetyl, propionyl, butyloyl, iso-butyloyl, 2,2-dimethylpropionyl, benzoyl, 3,4-dichlorobenzoyl, 3-acetylamino-4-methoxybenzoyl, 4-methylbenzoyl, and 4-methoxy-3-sulfobenzoyl);

a sulfonyl group (a sulfonyl group which may be substituted, for example, methanesulfonyl, ethanesulfonyl, chloromethanesulfonyl, propanesulfonyl, butanesulfonyl, benzenesulfonyl, and 4-toluenesulfonyl);

a carbamoyl group (a carbamoyl group which may be substituted, for example, carbamoyl, methylcarbamoyl, dimethylcarbamoyl, bis-(2-methoxyethyl)carbamoyl, dimethylcarbamoyl, and cyclohexylcarbamoyl);

a sulfamoyl group (a sulfamoyyl group which may be substituted, for example, sulfamoyl, methylsulfamoyl, dimethylsulfamoyl, diethylsulfamoyl, bis-(2-methoxyethyl)sulfamoyl, di-n-butylsulfamoyl, 3-ethoxypropylmethylsulfamoyl, and N-phenyl-N-methylsulfamoyl);

an alkoxy- or aryloxycarbonyl group (an alkoxy- or aryloxycarbonyl group which may be substituted, for example, methoxycarbonyl, ethoxycarbonyl, phenoxycarbonyl, and 2-methoxyethoxycarbonyl);

an alkoxy- or aryloxysulfonyl group (an alkoxy- or aryloxysulfonyl group which may be substituted, for example, methoxysulfonyl, ethoxysulfonyl, phenoxysulfonyl, and 2-methoxyethoxysulfonyl);

an alkoxy or arloxy group (an alkoxy or aryloxy group which may be substituted, for example, methoxy, ethoxy, methoxyethoxy, 2-chloroethoxy, phenoxy, and p-methoxyphenoxy);

an alkylthio or arylthio group (an alkylthio or arylthio group which may be substituted, for example, methylthio, ethylthio, n-butylthio, phenylthio, 4-chlorophenylthio, and 2-methoxyphenylthio);

an amino group (an amino group which may be substituted, for example, amino, methylamino, N,N-dimethoxyethoxyamino, and methylphenylamino);

an ammonio group (an ammnio group which may be substituted, for example, ammnio, trimethylammonio, phenyldimethylammonio, and dimethylbenzylammonio);

an acylamino group (an acylamino group which may be substituted, for example, acetylamino, 2-carboxybenzoylamino, 3-nitrobenzoylamino, 3-diethylaminopropanoylamino, and acryloylamino);

an acyloxy group (an acyloxy group which may be substituted, for example, acetoxy, benzoyloxy, 2-butenoyloxy, and 2-methylpropanoyloxy);

a sulfonylamino group (a sulfonylamino group which may be substituted, for example, methanesulfonylamino, benzenesulfonylamino, and 2-methoxy-5-n-methylbenzenesulfonylamino);

an alkoxycarbonylamino group (an alkoxycarbonylamino group which may be substituted, for example, methoxycarbonylamino, 2-methoxyethoxycarbonylamino, isobutoxycarbonylamino, benzyloxycarbonylamino, t-butoxycarbonylamino, and 2-cyanoethoxycarbonylamino);

an aryloxycarbonylamino group (an aryloxycarbonylamino group which may be substituted, for example, phenoxycarbonylamino and 2,4-nitrophenoxyarbonylamino);

(an alkoxycarbonyloxy group an alkoxycarbonyloxy group which may be substituted, for example, methoxycarbonyloxy, t-butoxycarbonyloxy, 2-benzenesulfonylethoxycarbonyloxy, and benzylcarbonyloxy);

an aryloxycarbonyloxy group (an aryloxycarbonyloxy group which may be substituted, for example, phenoxycarbonyloxy, 3-cyanophenoxycarbonyloxy, 4-acetoxyphenoxycarbonyloxy, and 4-t-butoxycarbonylaminophenoxycarbonyloxy);

an aminocarbonylamino group (an aminocarbonyl-amino group which may be substituted, for example, methylaminocarbonylamino, morpholinocarbonylamino, N-ethyl-N-phenylaminocarbonylamino, and 4-methanesulfonylaminocarbonylamino);

(an aminocarbonyloxy group (an aminocarbonyloxy group which may be substituted, for example, dimethylaminocarbonyloxy, pyrrolidinocarbonyloxy, and 4-dipropylaminophenylaminocarbonyloxy);

an aminosulfonylamino group (an aminosulfonylamino group which may be substituted, for example, diethylaminosulfonylamino, di-n-butylaminosulfonylamino, and phenylaminosulfonylamino );

a sulfonyloxy group (a sulfonyloxy group which may be substituted, for example, phenylsulfonyloxy, methanesulfonyloxy, chloromethanesulfonyloxy, and 4-chlorophenylsulfonyloxy);

and a carboxyl group, a sulfo group, a cyano group, a nitro group, a hydroxyl group, and a halogen atom. Of them, more preferred are an alkoxy group, an amino group, a sulfamoyl group, a sulfonylamino group, a carboxyl group, a sulfo group, and a halogen atom.

Next, Y is explained.

Y represents a group having a nature by which a diffusibility of a dye component is differentiated corresponding or inversely corresponding with a light-sensitive silver halide having imagewise a latent image. Such the group is publicly known in a field of a photochemistry utilizing a diffusion transfer of a dye and described in, for example, U.S. Pat. No. 5,021,334 (JP-A-2-184852).

Y is explained below in more detail. A description is given in the formula including G which is a group linking X and Y.

(1) First of all, a negative working releaser releasing a photographically useful group corresponding to a development can be enumerated as Y.

A releaser group releasing a photographically useful group from an oxidation product is known as Y classified to be a negative working releaser.

The following formula (Y-1) can be enumerated as a preferred example of this type of Y:

(Y-1)

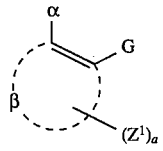

wherein β represents a nonmetal atomic group necessary for forming a benzene ring, and a saturated or unsaturated carbon ring and a heterocylic ring may be condensed with this benzene ring; α represents —$OZ^2$ or —$NHZ^3$, in which $Z^2$ represents α hydrogen atom or a group generating a hydroxyl group upon hydrolysis and $Z^3$ represents a hydrogen atom, an alkyl group, an aryl group, or a group generating an amino group upon hydrolysis; $Z^1$ represents an alkyl group which may have a substituent, an aryl group, an aralkyl group, an alkoxy group, an alkylthio group, an aryloxy group, an arylthio group, an acyl group, a sulfonyl group, an acylamino group, a sulfonylamino group, a carbamoyl group, a sulfamoyl group, a ureido group, a urethane group, a heterocyclic group, a cyano group, or a halogen atom; a represents a positive integer; and when $Z^1$ is two or more, all of them may be the same of different. In formula (Y-1), —G is a group represented by—$NHSO_2Z^4$ and $Z^4$ represents a divalent group.

Of the groups included in (Y-1), (Y-2) or (Y-3) can be enumerated as a preferred group:

(Y-2)

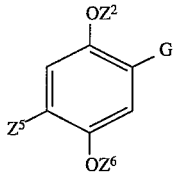

(Y-3)

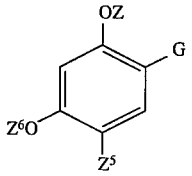

wherein $Z^2$ and G are as defined in (Y-1); $Z^5$ and $Z^6$ each represents an alkyl group, an aryl group or an aralkyl group, and they may have a substituent; and further $Z^5$ is a secondary or tertiary alkyl group and the sum of the carbon numbers of $Z^5$ and $Z^6$ is preferably 20 or more and 50 or less.

The specific examples thereof are described in U.S. Pat. Nos. 4,055,428 and 4,336,322, JP-A-51-113624, JP-A-56-16131, JP-A-56-71061, JP-A-56-71060, JP-A-56-71072, JP-A-56-73057, JP-A-57-650, JP-A-57-4043, and JP-A-50-60,439, and JP-B-56-17656 (the term "JP-B" as used herein means an examined Japanese patent publication) and JP-B-60-25780.

(Y-4) can be enumerated as other examples of Y:

(Y-4)

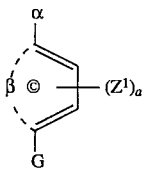

wherein α, G, $Z^1$, and a are as defind in (Y-1); and β' represents a nonmetal atomic group necessary to form a benzene ring and a saturated or unsaturated carbon ring or a heterocyclic ring may be condensed with this benzene ring.

Of the groups represented by (Y-4), those in which α is —$OZ^2$ and β' forms a naphthalene skeleton are preferred. Specifically, they are described in U.S. Pat. Nos. 3,928,312 and 4,153,929.

There can be enumerated as a releaser releasing a photographically useful group by the same reaction as (Y-1) and (Y-2), the groups described in JP-A-51-104343, JP-A-53-46730, JP-A-54-130122, JP-A-57-85055, JP-A-53-3819, JP-A-54-48534, JP-A-49-64436, and JP-A-57-20735, JP-B-48-32129 and JP-B-48-39165, and U.S. Pat. No. 3,443,934.

A hydroquinone derivative represented by formula (Y-5) or (Y-6) can be enumerated as a compound releasing a photographically useful group from an oxidation product by a different mechanism:

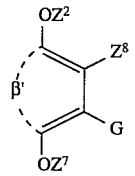

(Y-5)

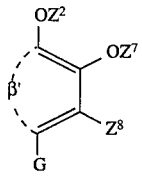

(Y-6)

wherein β' is as defined in (Y-4), and $Z^2$ is as defined in (Y-1); $Z^7$ is the same as $Z^2$; $Z^8$ represents the substituent described in $Z^1$ or a hydrogen atom; and $Z^1$ and $Z^7$ may be the same or different. The specific examples of this kind are described in U.S. Pat. No. 3,725,062.

Those having a nucleophilic group in a molecule of this kind of the hydroquinone derivative releaser can be enumerated as well. Specifically, it is is described in JP-A-4-97347.

Further, there can be enumerated as other examples of Y, the p-hydroxydiphenylamine derivatives described in U.S. Pat. No. 3,443,939, and the hydrazine derivatives described in U.S. Pat. Nos. 3,844,785 and 4,684,604, and R.D. No. 128, p. 22.

Further, the following formula (Y-7) can be enumerated as a negative working releaser:

Coup-G (Y-7)

wherein Coup represents a group which is subjected to coupling with the oxidation products of p-phenylenediamines or p-aminophenols, that is, a group known as a photographic coupler. The specific examples thereof are described in British Patent 1,330,524.

(2) Next, the negative working releaser releasing a photographically useful group inversely corresponding with a development can be enumerated as Y.

First of all, a releaser which reveals a function when it is reduced in processing can be enumerated as a positive working releaser. The following formula (Y-8) can be enumerated as a preferred example of this type of Y:

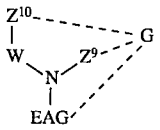

(Y-8)

wherein EAG represents a group receiving an electron from a reductive material; N represents a nitrogen atom; W represents an oxygen atom, a sulfur atom, or —$NZ^{11}$—, and after EAG receives an electron, this N—W bond is cleaved; $Z^{11}$-represents an alkyl group or an aryl group; $Z^9$ and $Z^{10}$ each represents a mere bond or a substituent other than a hydrogen atom; and a solid line represents a bond and the broken lines represent that at least one of them is a bond.

Of the groups represented by (Y-8), (Y-9) can be enumerated as a preferred one:

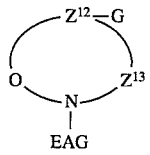

(Y-9)

wherein O represents an oxygen atom (that is, W in (Y-8) is an oxygen atom); $Z^{12}$ represents an atomic group having a nature in which a heterocyclic ring containing an N—O bond is formed, and a $Z^{12}$—G bond is cleaved following a cleavage of the N—O bond; $Z^{12}$ may have a substituent and may be condensed with a saturated or unsaturated ring; and $Z^{13}$ represents —CO— or —$SO_2$—.

Of (Y-9), (Y-10) can be enumerated as a further preferred group:

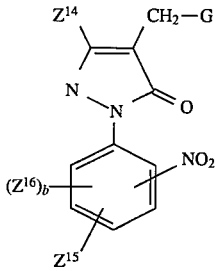

(Y-10)

wherein $Z^{14}$ represents an an alkyl group, an aryl group, or an aralkyl group; $Z^{15}$ represents a carbamoyl group or a sulfamoyl group; $Z^{16}$ represents an an alkyl group, an aryl group, an aralkyl group, an alkoxy group, an alkylthio group, an aryloxy group, an arylthio group, a halogen atom, a cyano group, or a nitro group; b represents an integer of 0 to 3; and a substitution position of a nitro group in the formula is ortho or para to a nitrogen atom.

Further, $Z^{15}$ is most preferably a carbamoyl group or sulfamoyl group substituted with an alkyl group having 12 to 30 carbon atoms.

The specific examples of this type of Y are described in JP-A-62-215,270 and U.S. Pat. No. 4,783,396.

Further, there can be enumerated as other positive working releasers which reveal a function by reduction, the BEND compounds described in U.S. Pat. Nos. 4,139,379 and 4,139,389, the Carquin compounds described in British Patent 11,445, and the releasers described in JP-A-54-126535 and 57-84453.

When these reduced releasers which are represented by (Y-8) as representative y are used, a reducing agent is used in combination, and an LDA compound containing a reductive group in the same molecule can be enumerated as well. This is described in U.S. Pat. No. 4,551,423.

Of the positive working releasers, there are included as well those of a type which is incorporated into a light-sensitive material and deactivated by oxidization in processing.

There can be enumerated as this type of the releaser, the Fields compounds described in JP-A-51-63618 and U.S. Pat. No. 3,980,479, and the Hinshaw compounds described in JP-A-49-111628 and JP-A-52-4819, and U.S. Pat. No. 4,199,354.

(Y-11) also can be enumerated as an example of this type of Y:

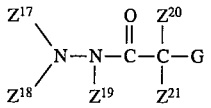

(Y-11)

wherein $Z^{17}$ and $Z^{19}$ each represent a hydrogen atom, a substituted or non-substituted acyl group, an alkoxycarbonyl group, or an aryloxycarbonyl group; $Z^{18}$ represents an alkyl group, an aryl group, an aralkyl group, an acyl group, an alkoxycarbonyl group, an aryloxycarbonyl group, a carbamoyl group, a sulfonyl group, or a sulfamoyl group; and $Z^{20}$ and $Z^{21}$ each represents a hydrogen atom, a substituted or non-substituted alkyl group, an aryl group, or an aralkyl group. Specifically, the descriptions are given in JP-A-62-245,270 and JP-A-63-46450.

A thiazolidine type releaser can be enumerated as a positive working releaser having other mechanisms. Specifically, a description is given in U.S. Pat. No. 4,468,451.

In the case where any of these Y's is used, Y has preferably at least one ballast group having at least 10 carbon atoms.

Next, the dye portion represented by formula (2) will be explained. First of all, $R^1$ will be explained .

There can be enumerated as a preferred example of $R^1$, an alkyl group having 1 to 4 carbon atoms (those having a substituent are included; for example, methyl, isopropyl, t-butyl, methoxyethyl, β-cynoethyl, and trifluoromethyl), an alkoxy group having 1 to 4 carbon atoms (those having a substituent are included; for example, methoxy, ethoxy, and methoxyethoxy), an aryl group having 6 to 8 carbon atoms (those having a substituent are included; for example, phenyl, p-methoxyphenyl, and p-hydroxyphenyl), a hydroxyl group, a cyano group, a carbamoyl group, and a carboxyl group.

There can be enumerated as a preferred example of $R^2$, a halogen atom, a cyano group, a carboxyl group, a hydroxyl group, a sulfonylamino group (for example, methanesulfonylamino, ethanesulfonylamino, benzenesulfonylamino, and 2-methoxyethanesulfonylamino), an acylamino group (for example, acetylamino, propionylamino, benzoylamino, and m-methanesulfonylaminobenzoylamino), a carbamoyl group (for example, carbamoyl, N-methylcarbamoyl, and N,N-dimethylcarbamoyl), a sulfamoyl group (for example, sulfamoyl, N-methylsulfamoyl, and N,N-dimethylsulfamoyl), methoxy, and methoxyethoxy.

Of them, a sulfonylamino group, a sulfamoyl group, a carboxyl group, and a hydroxy group can preferably be enumerated.

There can be enumerated as a preferred example of $R^3$, a halogen atom, a cyano group, a carbamoyl group (for example, carbamoyl, N-methylcarbamoyl, and N,N-dimethylcarbamoyl), a sulfamoyl group (for example, sulfamoyl, N-methylsulfamoyl, and N,N-dimethylsulfamoyl), a sulfonyl group (for example, methanesulfonyl and ethanesulfonyl), methyl, methoxy, and methoxyethoxy.

Of them, a halogen atom, a cyano group, a sulfonyl group, and a sulfamoyl group can be enumerated as a more preferred example.

Dye is bonded to any of $R^1$, $R^2$ and $R^3$ in formula (2) via X, and the one bonded to $R^2$ or $R^3$ is particularly preferred.

Next, the exemplified compound of the present invention will be shown but the present invention will not be limited thereto.

1

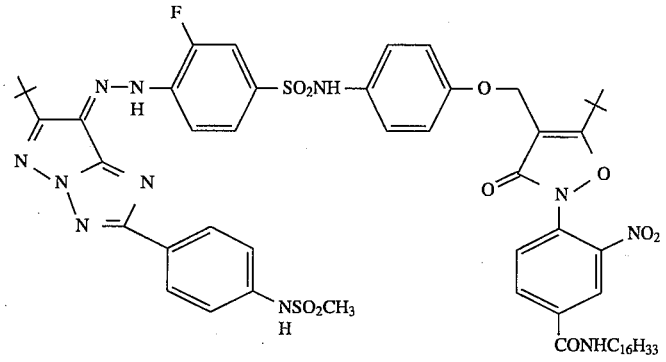

2

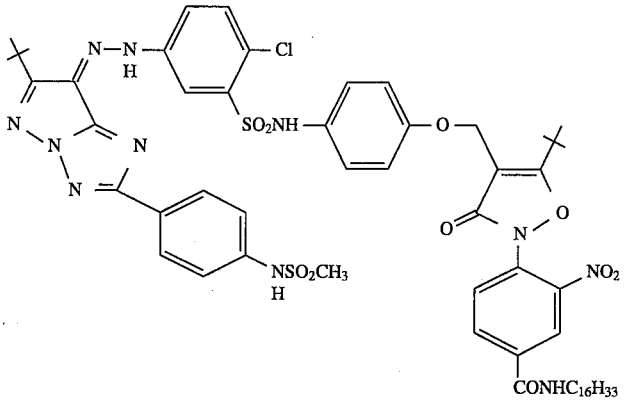

-continued
3
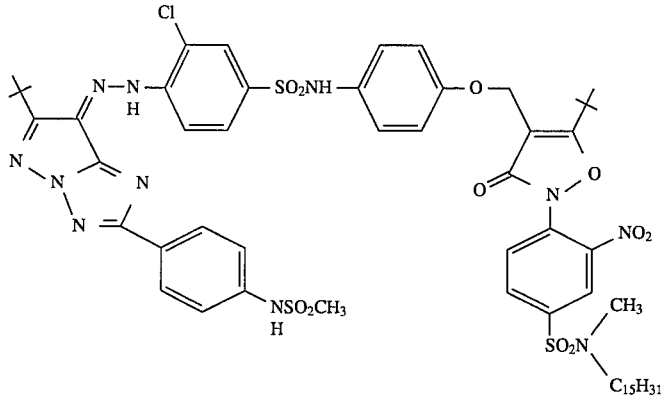
4
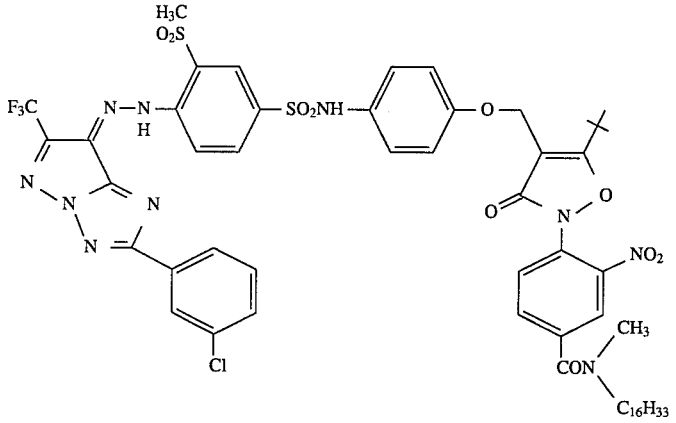
5
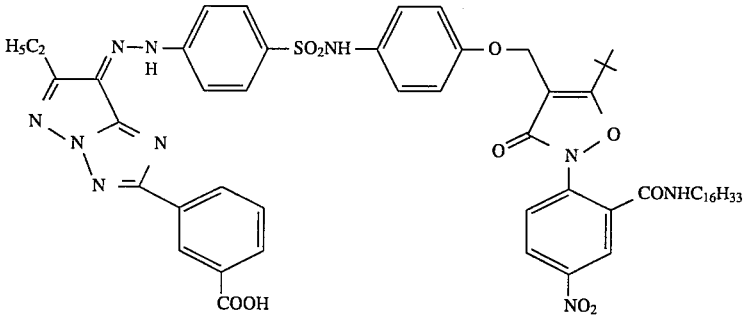
6
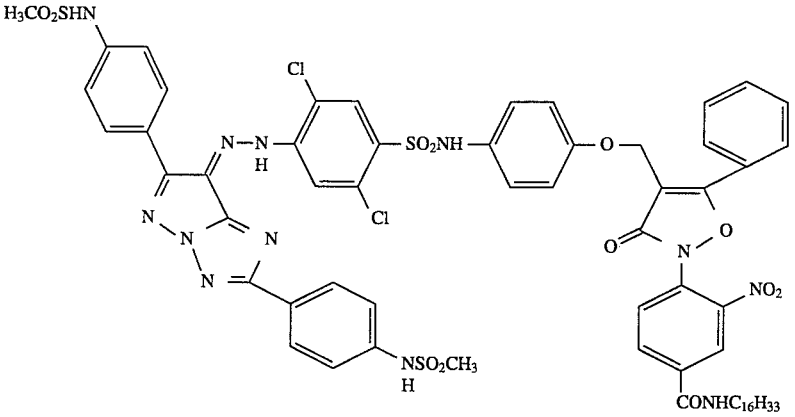

-continued
7
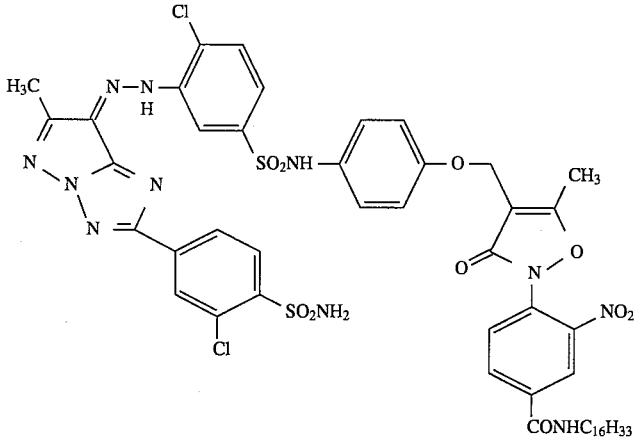
8
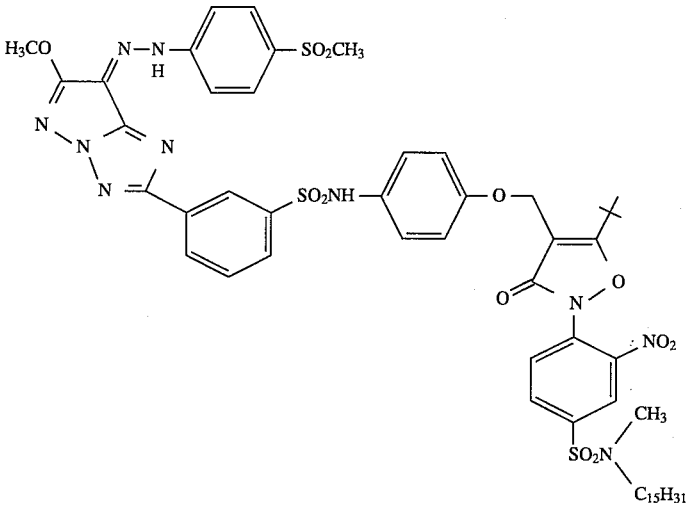
9
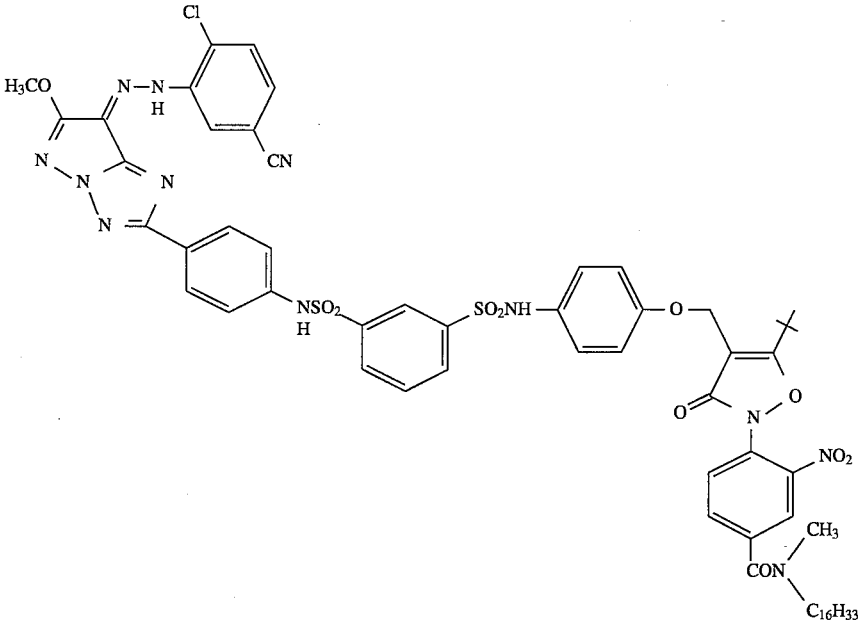

-continued
10
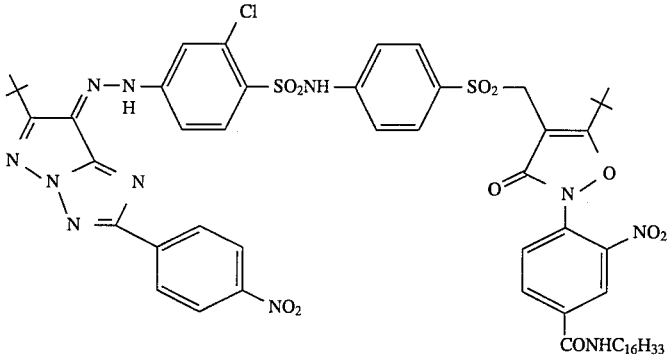
11
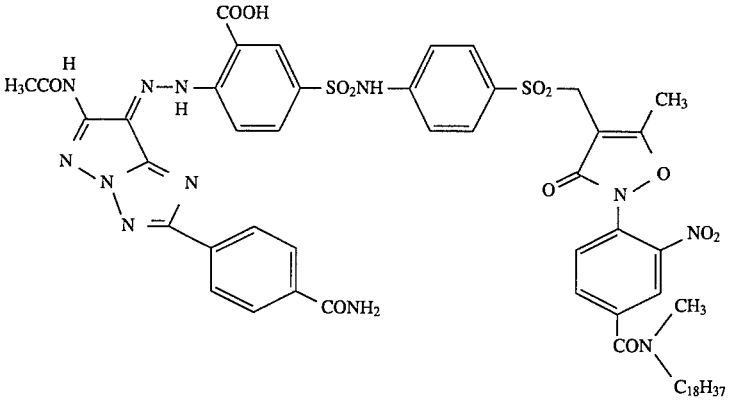
12
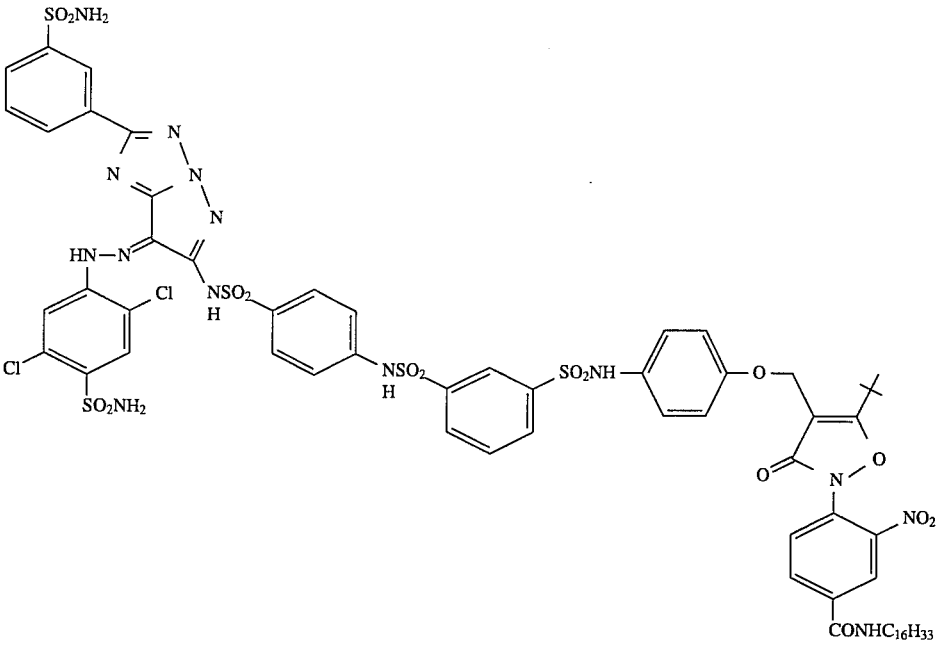

-continued
13
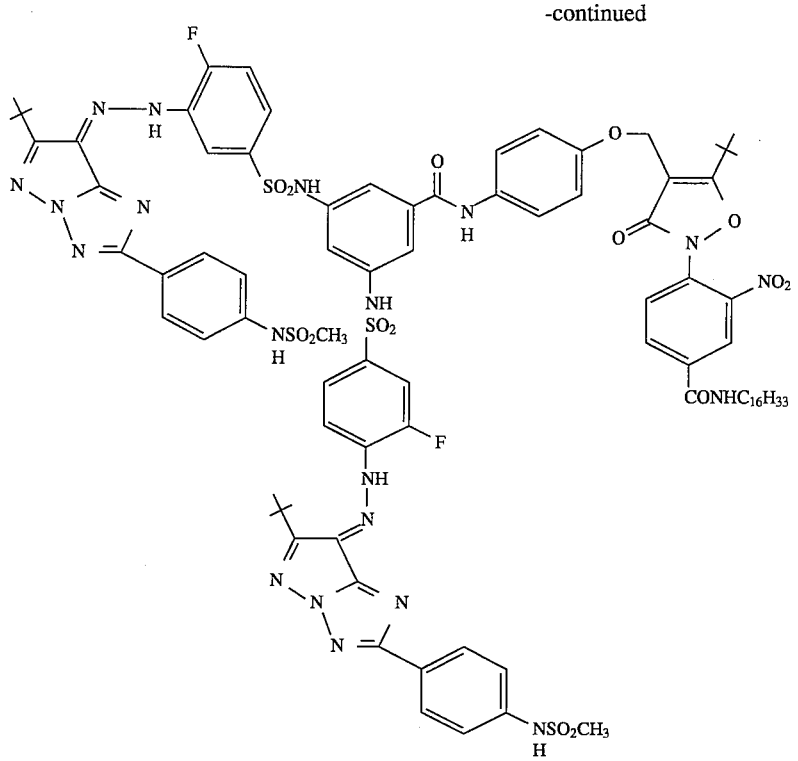
14
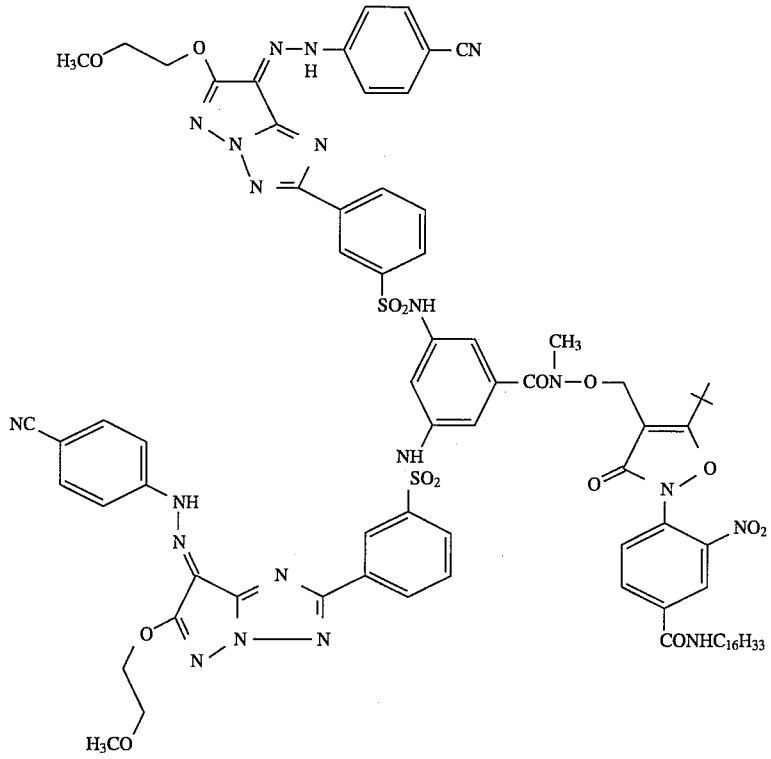

-continued
15
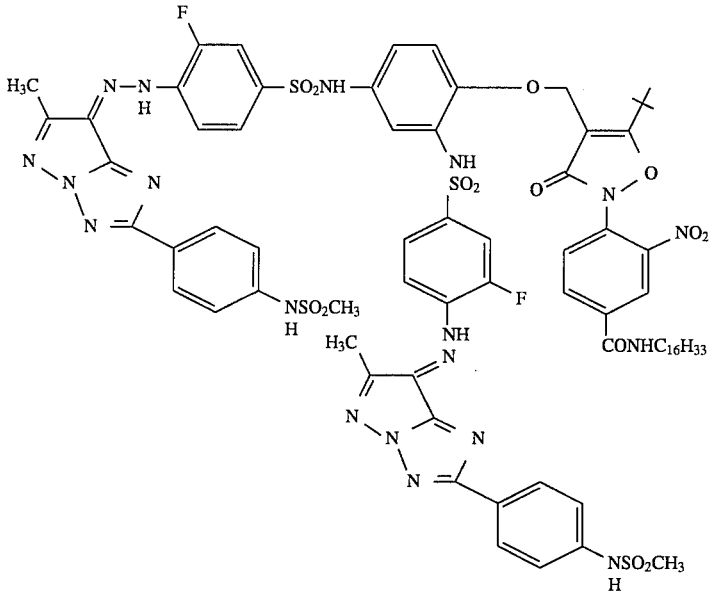
16
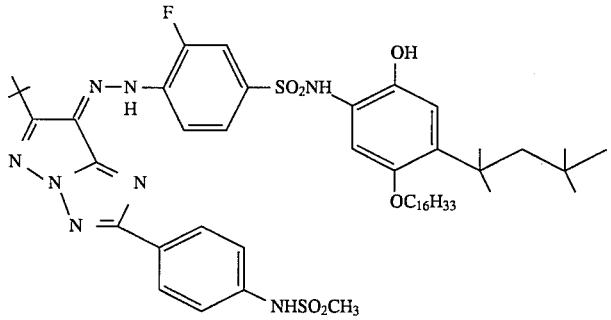
17
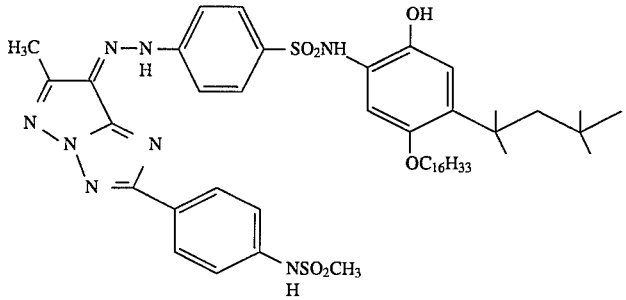
18
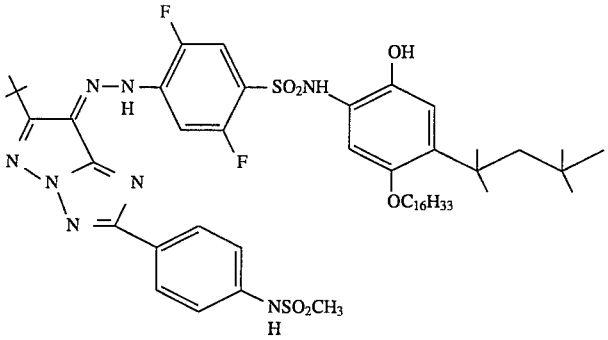

-continued
19
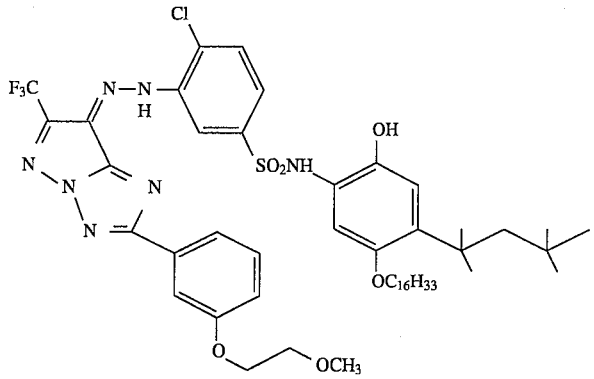
20
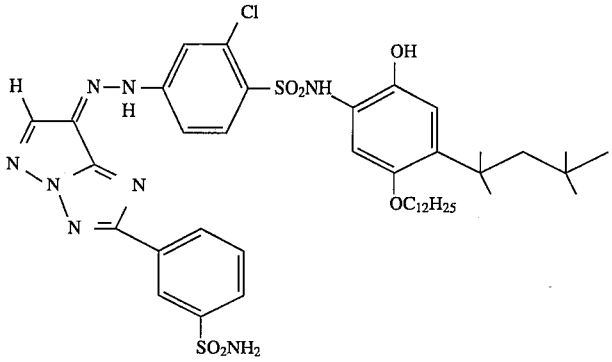
21
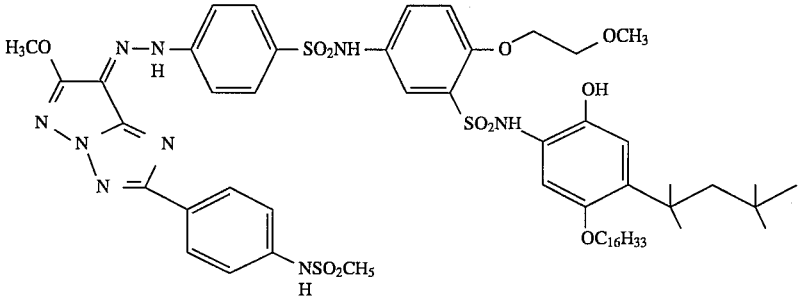
22
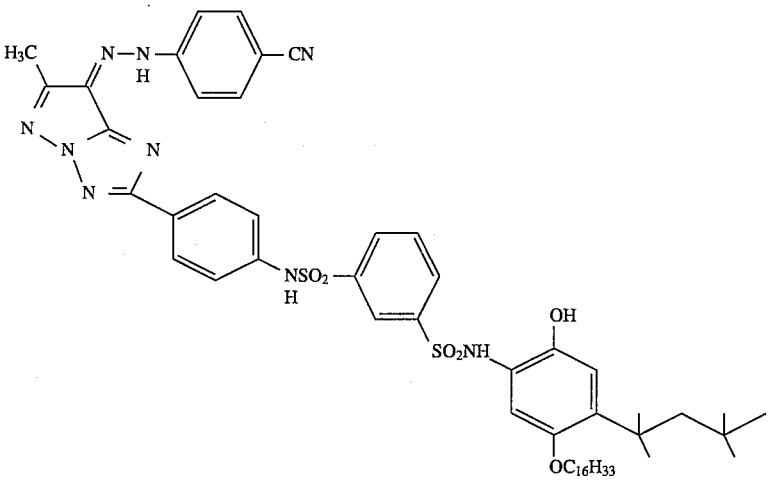

-continued
23
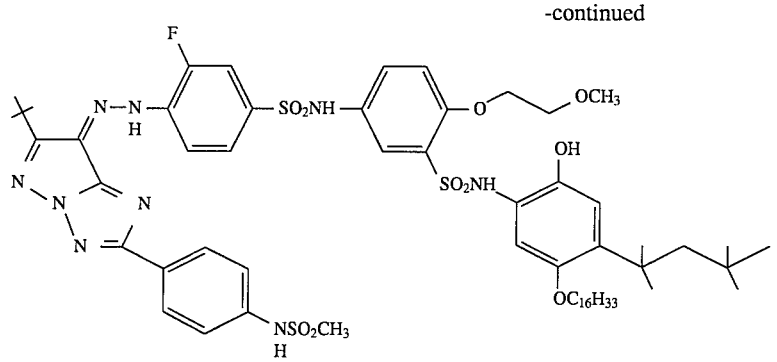
24
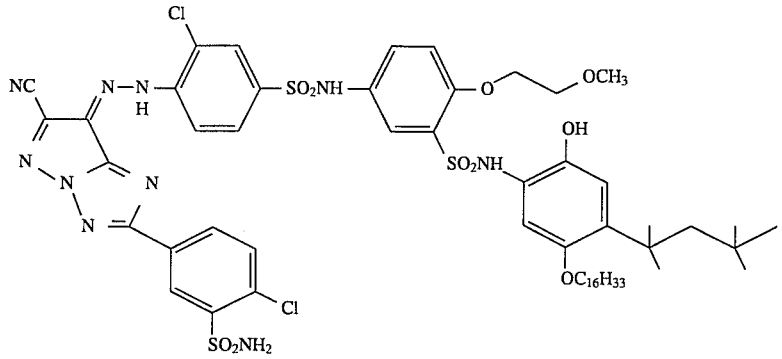
25
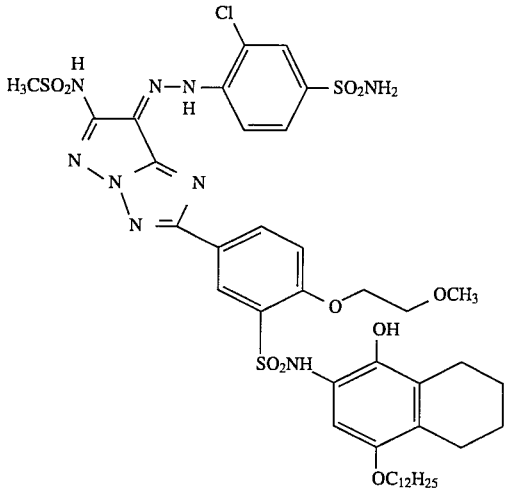
26
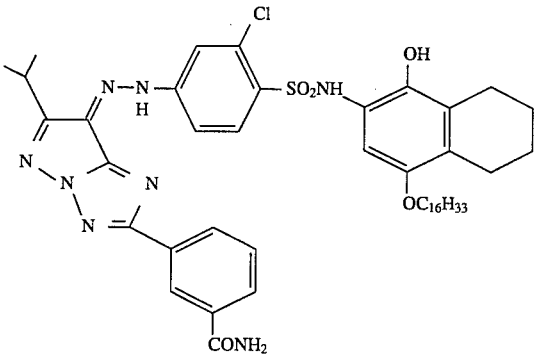

-continued
27
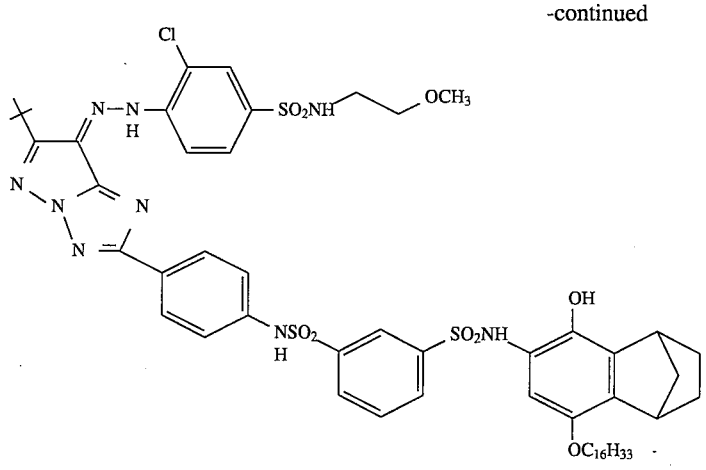
28
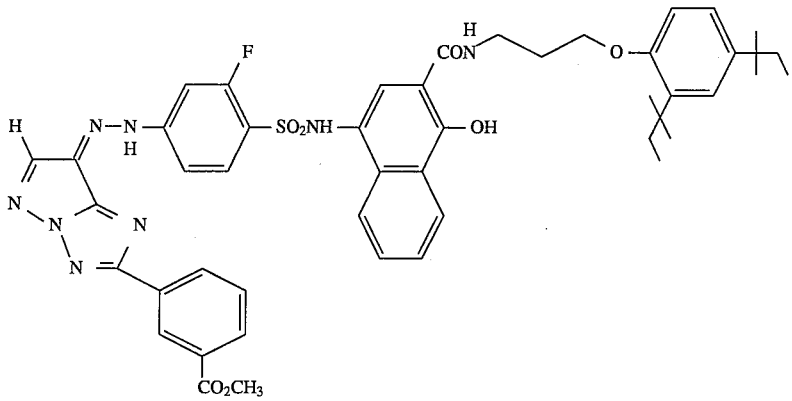
29
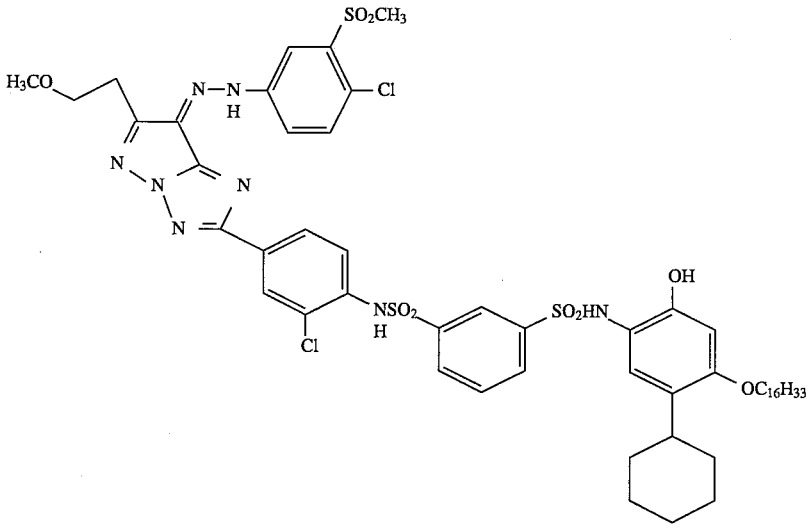
30
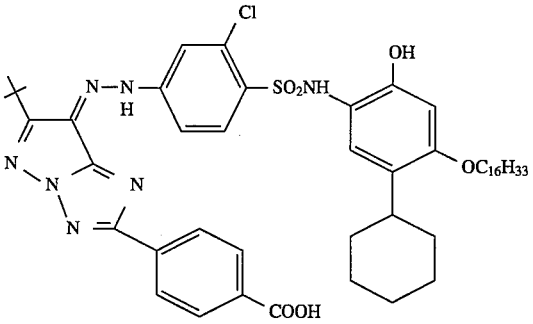

-continued
31
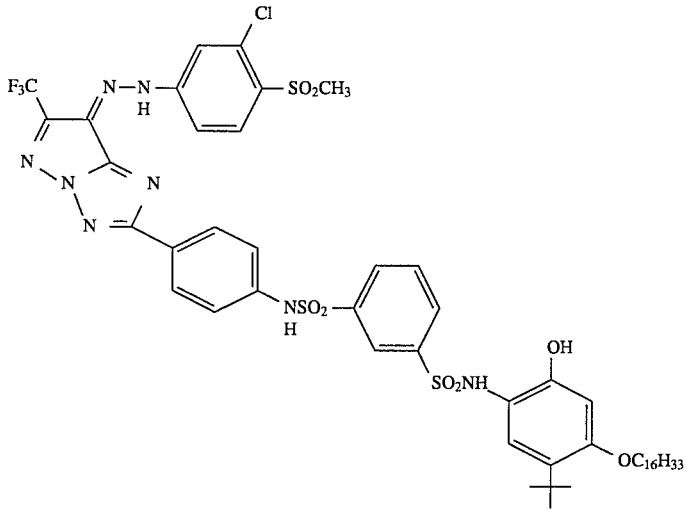
32
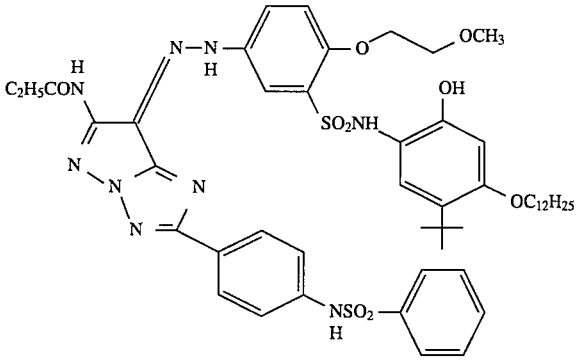
33
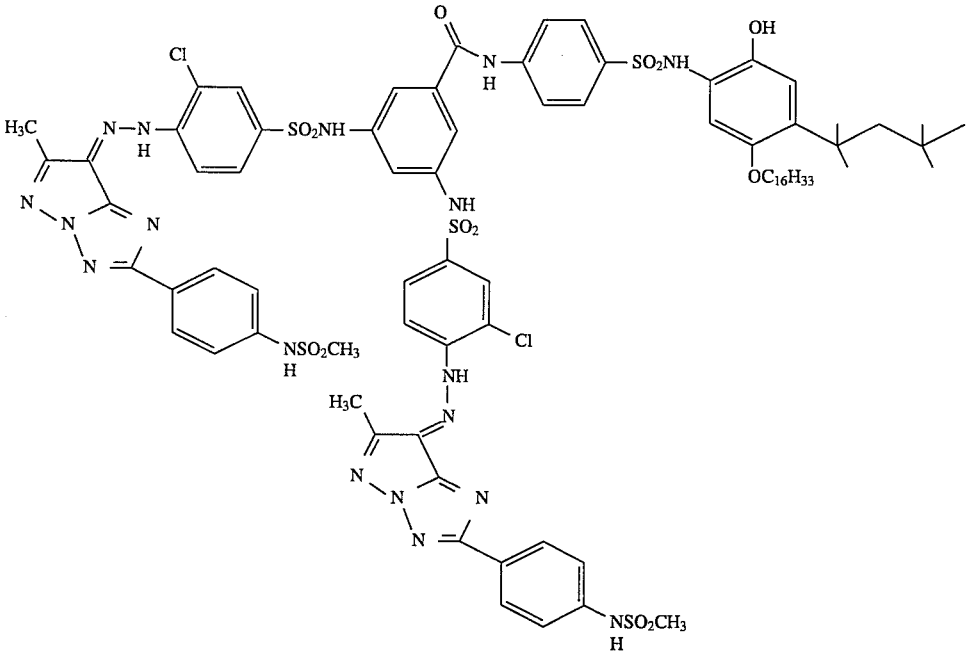

-continued
34
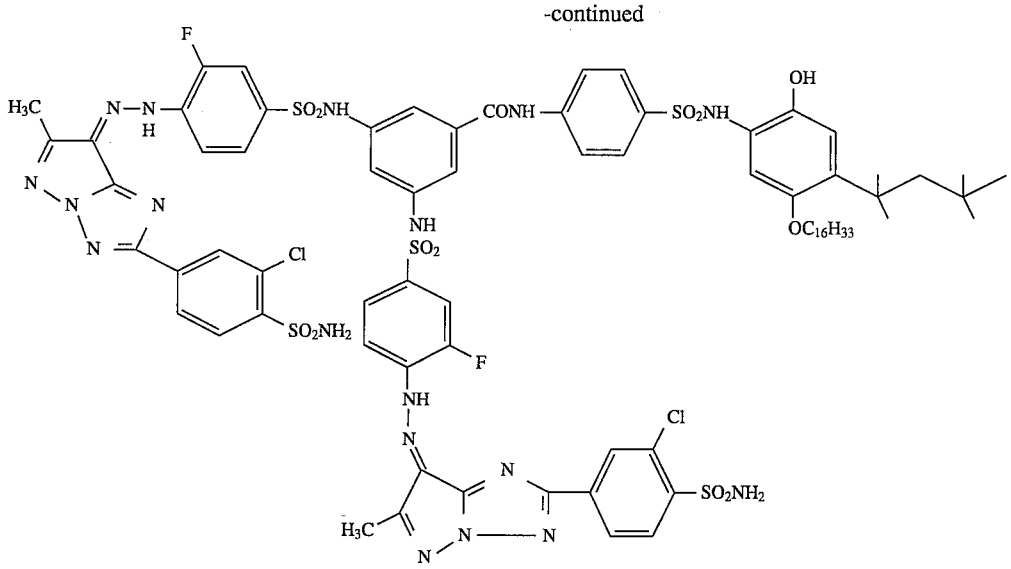
35
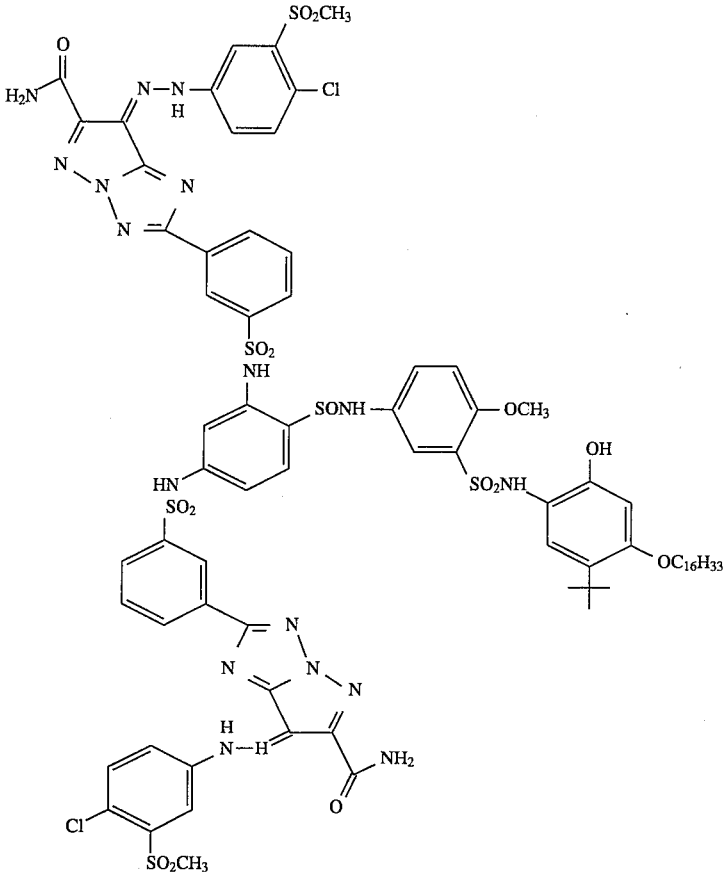

-continued
36
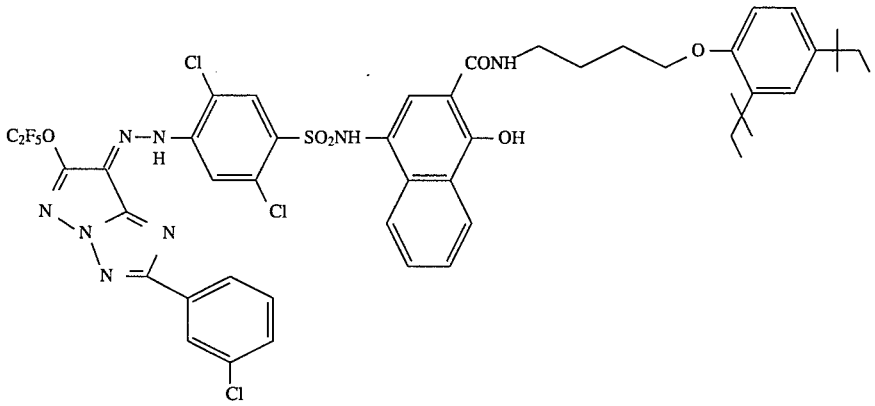
37
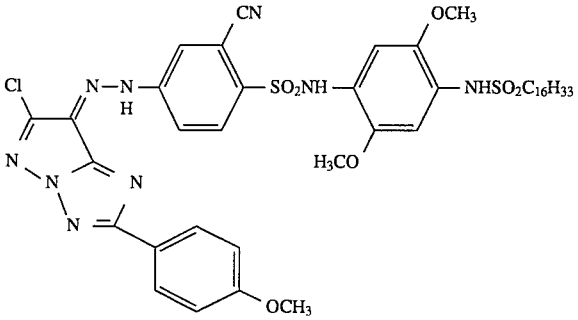
38
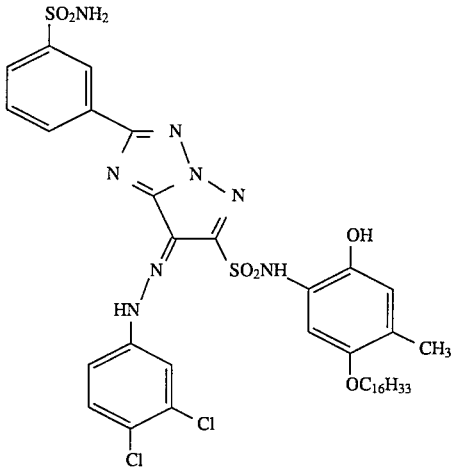
39
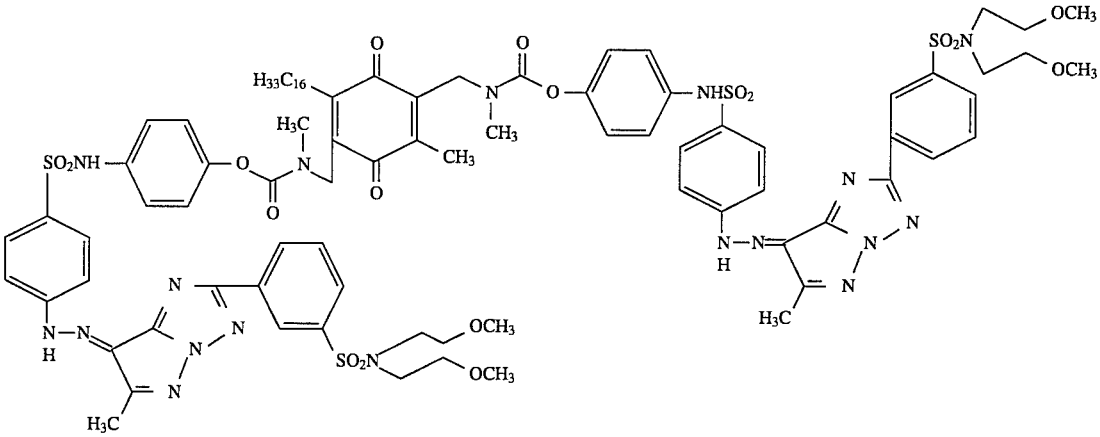

-continued

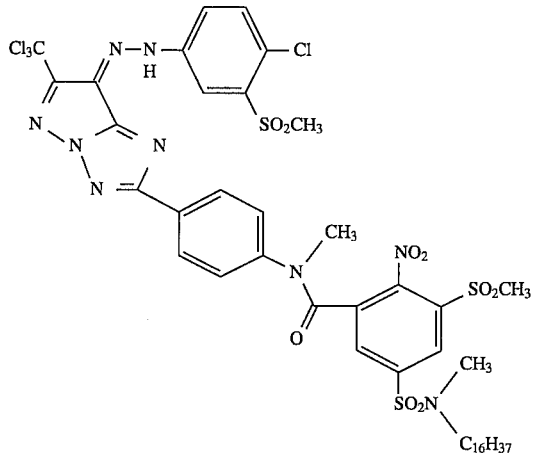

The compound of the present invention can be synthesized by applying the process described in JP-A-61-261,738 and using a compound derived from cyanobenzenes as imidate used.

The specific synthetic examples is shown below.

Synthesis of exemplified compound 1:

(i) Coupling component: the case of the compound (F): Synthetic scheme:

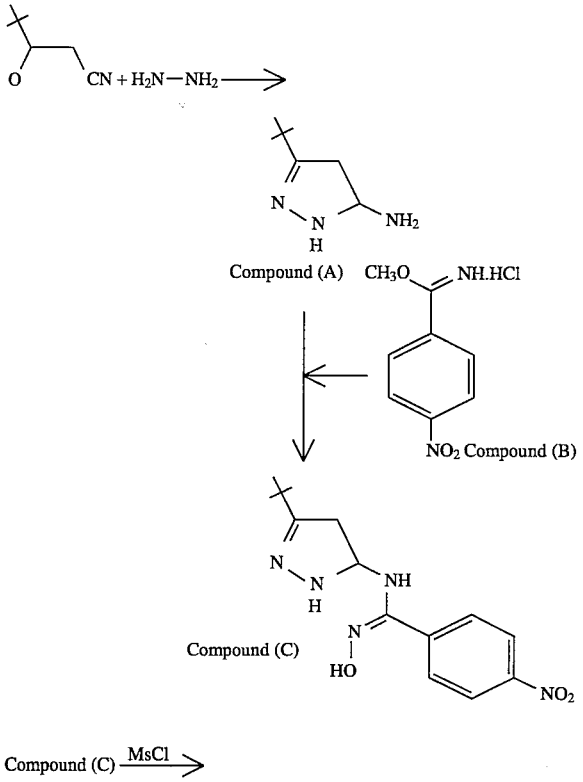

-continued

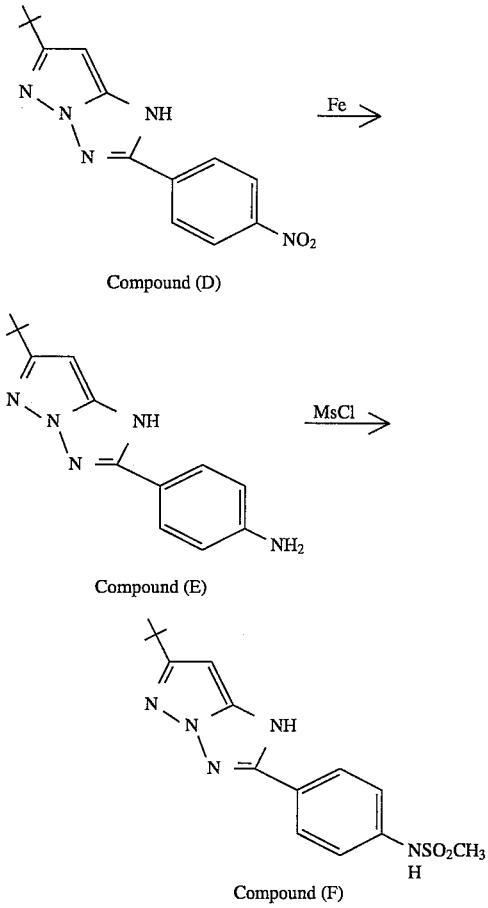

Isopropanol 800 ml was added to pivaloylacetonitrile 600 g and heating and stirring were applied. Hydrazine hydrate 288 g was dropped thereto and heating and stirring were applied for 3 hours. After finishing the reaction, isopropanol 400 ml was distilled off under reduced pressure. Ethyl acetate 2000 ml and a saturated salt aqueous solution were added to a residue and stirring was applied. After leaving for standing for a while, an aqueous layer was removed and an ethyl acetate layer was washed twice with the saturated salt aqueous solution, followed by drying an ethyl acetate solution over magnesium sulfate anhydrous. This ethyl acetate solution was concentrated under reduced pressure and then n-hexane 2000 ml was added to a residue to precipitate crystal. This crystal was filtered off and dried, whereby 3-amino-5-t-butylpyrazole (Compound (A)) 643 g (96.2%) was obtained. The melting point was 74.0° to 75.0° C.

Acetonitrile 2800 ml was added to 3-amino-5-t-butylpyrazole 250 g obtained by the process described above and stirring was applied at a room temperature. Methyl-4-nitrophenylimidate ester hydrochloride (Compound (B)) 390 was added to this solution and stirring was applied at a room temperature for 7 hours. Next, a methanol solution of hydroxylamine (prepared from hydroxylamine hydrochloride 150 g and a 28 wt % methanol solution 430 ml of sodium methylate) was added and stirring was applied for further 8 hours. After finishing the reaction, water 8000 ml was added to this solution and deposited crystal was filtered off. This crystal was dried to obtain an amidoxime product (Compound (C)) 421.7 g (77.2%). The melting point was 175° to 177° C.

Dimethylacetamide 900 ml was added to the amidoxime product (Compound (C)) 364 g and stirring was applied after cooling down to 10° C. Methanesulfonic chloride 144.3 g was added thereto and then pyridine 233 ml was added. After stirring at a room temperature for 2 hours, methanol 2600 ml was added and heating and stirring were applied at 55° C. for 5 hours. After completing the reaction, water 1800 ml was added after cooling down to the room temperature to thereby deposit crystal. This crystal was filtered off and dried. Compound (D) 249 g (72.8%) which was a cyclized product was obtained. A melting point was 259° to 260° C.

water 120 ml and isopropanol 1200 ml were added to reduced iron 209 g and ammonium chloride 20 g, and heating and stirring were applied. The compound (D) 202 g obtained by the process described above was added little by little to this solution. After finishing addition, heating and stirring were carried out for one hour and then a reaction solution was filtered while hot to remove insoluble matters by filtration. A filtrate was concentrated under reduced pressure and water 3000 ml was added to the residue to deposit crystal. This crystal was filtered off and dried, whereby the amine product (Compound (E)) 167.9 g (92.9%) was obtained. The melting point was 263° to 265° C.

Acetonitrile 750 ml and pyridine 80 ml were added to the amine product (Compound (E)) synthesized by the process described above and stirring was applied while cooling with ice. Methanesulfonyl chloride 39 ml was added dropwise to this solution. After finishing the addition, stirring was applied for one hour while cooling with ice, and the reaction solution was added to a mixed solution of water 4000 ml and hydrochloric acid 86 ml for a crystallization. This crystal was filtered off and after drying, a recrystallization was carried out with a mixed solvent of ethanol 1500 ml and acetone 500 ml, whereby the coupler (Compound (F)) 116 g (76%) was obtained. A melting point was 195° to 197° C.

(ii) Synthesis of dye (H):

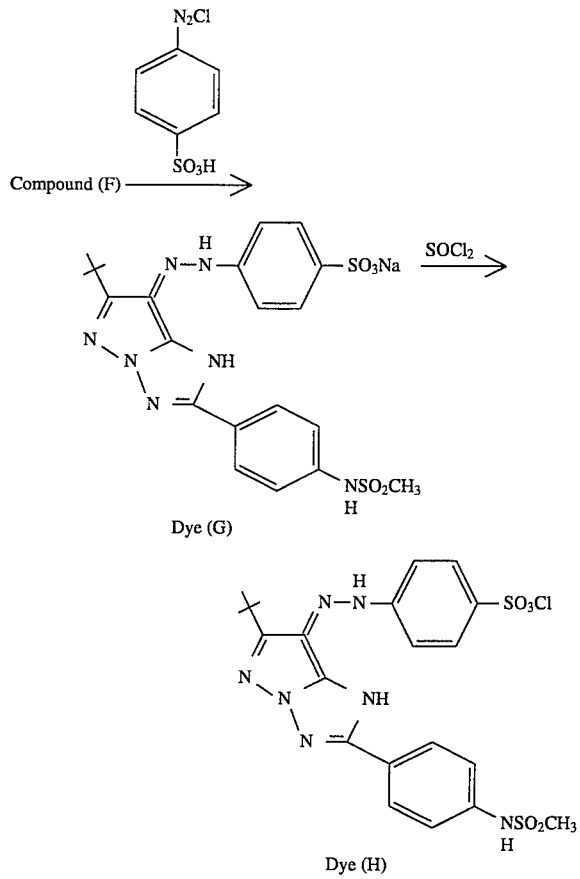

Hydrochloric acid 12.2 ml and water 12.2 ml were added to sulfanilic acid 9.53 g and stirring was carried out while cooling with ice. Sodium sulfite 4.2 g dissolved in water 15 ml was dropped to this solution. After finishing dropping, stirring was carried out for 30 minutes while cooling with ice, whereby a diazonium solution of sulfanilic acid was obtained.

Potassium hydroxide 8.4 g was added to methanol 200 ml and stirring was carried out. After cooling this solution with water and methanol, the coupler (Compound (F)) 16.7 g was added. The coupler was dissolved and then the diazonium solution of sulfanilic acid was added dropwise. After the addition, stirring was carried out for 30 minutes and the solution was added to a saturated salt aqueous solution 2000 ml for a crystallization. This crystal was filtered off and dried. After this crystal was added to acetonitrile 200 ml and stirring was carried out on a water bath for one hour, it was filtered off and dried, whereby dye (G) 30 g (inorganic salt was contained by 100% or more) was obtained.

Acetonitrile 150 ml and dimethylacetamide 30 ml were added to dye (G) 30.0 g synthesized by the process described above and stirring was carried out at a room temperature. Phosphorous oxychloride 30 ml was added dropwise to this solution. After finishing the addition, stirring was carried out for 30 minutes while heating, and the solution was poured into ice and water 1000 ml for a crystallization. This crystal was filtered off and added to acetonitrile 150 ml cooled with ice. After stirring for 30 minutes while cooling with ice, the crystal was filtered off and dried, whereby dye (H) 20 g (74%) was obtained.

(iii) Synthesis of exemplified compound 1:

Dimethylacetamide 50 ml was added to a redox base nucleus (Compound (I)) 10.3 g and stirring was carried out while cooling with ice. 2-Methylpyridine 4.5 ml was added to this solution and then dye (H) 9 g synthesized by the process described above was added little by little. After finishing addition, stirring was continued for one hour while cooling with ice, followed by adding ethyl acetate and water for extraction and drying this ethyl acetate solution over magnesium sulfate anhydrous. Magnesium sulfate was filtered and then the filtrate was concentrated and dried up under reduced pressure. The residue was recrystallized with a mixed solution of methanol and ethyl acetate and dried, whereby the crystal 12.4 g (73%) of exemplified compound I was obtained. The melting point was 110° to 114° C.

Compound I

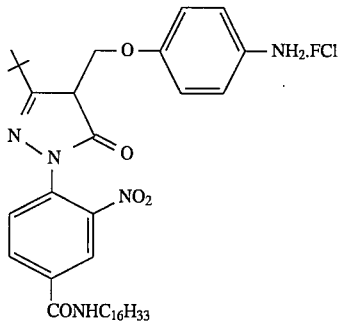

In the color light-sensitive material of the present invention, the compound represented by formula (1) is added preferably to the same layer as a layer containing light-sensitive silver halide. The compound of the present invention can be used in a wide range of amount, and it is used in a range of 0.01 to 5 mole, preferably 0.05 to 1 mole per mole of silver.

The compound of the present invention is a yellow dye-providing compound and in order to obtain a full color image, a magenta dye-providing compound and a cyan dye-providing compound are used in combination therewith. Other yellow dye-providing compound may be used in combination. These dye-providing compounds used in combination are represented by formula (3):

$$[(\text{Dye}')_i\text{-}X']_j\text{-}Y' \quad (3)$$

wherein Dye' represents a magenta dye, a cyan dye, or yellow dye which is outside the scope of the present invention, or their precursors; Y' represents a group having a nature by which a diffusibility of a dye component is differentiated corresponding or inversely corresponding with a light-sensitive silver salt having imagewise a latent image (the same as Y in formula (1)); X' represents a mere bond or a linkage group (the same as X in formula (1)); i represents an integer of 1 or more and j represents 1 or 2; and when i is 2 or more or j is 2, all of Dye' or $(\text{Dye}')_i$-X may be the same or different. A publicly known dye (or a dye precursor) can be used as a magenta dye, a cyan dye or yellow dye which is outside the scope of the present invention (or a dye precursor).

The present invention relates also to a heat developing color light-sensitive material having at least one silver halide emulsion layer on a support and containing a compound represented by formula (4) in the emulsion layer or the other hydrophilic colloid layers:

$$Y\text{-}[G\text{-}X'\text{-}(L\text{-}(\text{Dye})_p)_m]_n \quad (4)$$

wherein Dye represents an image-forming dye or a precursor thereof; Y is the same as Y in formula (1); X' represents a benzene ring, a naphthalene ring, a 5- to 6-membered heterocycle containing one or two nitrogen atoms, or a group obtained by removing m hydrogen atoms from a chain or cyclic alkyl group having 2 to 10 carbon atoms and may have a substituent, other saturated or unsaturated rings being allowed to be condensed therewith and a part of constitutional carbon atoms therefor being allowed to be substituted with an oxygen atom or a sulfur atom; L represents a linkage group; G is a group linking Y with X' and represents a group having a nature that a Y—G bond is broken in a heat processing reaction; G may have a timing group which further decomposes itself; p represents an integer of 1 or more and m represents a natural number of 2 or more; n is 1 or 2, and m (L-(Dye)) may be the same or different; when n is 2, n $(G\text{-}X\text{-}(L\text{-}\text{Dye})_m)$ may be the same or different; and when p is 2 or more, p Dyes may be the same or different.

Further, the present invention relates to an image-forming process characterized in that a diffusible image-forming dye is imagewise released by heating the above heat developing color light-sensitive material containing the compound of formula (4) at the same time as or after an imagewise exposure and that then this is diffusion-transferred on an image-receiving layer of an image-receiving material.

Next, the respective groups in the compound represented by formula (4) is explained.

First of all, X' is explained.

A benzene ring and a naphthalene ring can be enumerated as a group preferably used as X', and they may have a substituent.

Further, there can be enumerated as other groups preferably used, a heterocyclic group which contains one or two nitrogen atoms and may have a substituent and with which the other rings may condense (for example, pyrrole, pyrazole, imidazole, pyrroline, pyrazoline, imidazoline, pyrrolidine, pyrazolidine, imidazolidine, indole, indoline, pyridine, pyrimidine, pyrazine, pyperizine, pyridone, adenine, tetrahydropyrimidine, morpholine, quinoline, quinoxaline, N-methylmorpholine, oxyindole, and hydantoin).

Further, there can be enumerated as a other groups preferably used, a chain or cyclic alkyl group having a carbon 2 to 10 carbon atoms (for example, ethane, propane, butane, pentane, hexane, isobutane, cyclopentane, cyclohexane, cycloheptane, decane, and cyclodecane), and there can be used a group partially containing an oxygen atom or a sulfur atom (for example, furan, tetrahydrofuran, pyran, tetrahydropyran, di-n-butyl ether, thiophene, and tetrahydrothiophene).

Of them, a benzene ring, a naphthalene ring, and a chain or cyclic alkyl group having 2 to 6 carbon atoms can be enumerated as a more preferred group. Further the benzene ring and the naphthalene ring are most preferred in terms of easiness of synthesis and general usability.

In the case where X' has a substituent, the same group as the substituent for X in formula (1) is enumerated as the preferred group.

There are enumerated as more preferred group, an alkoxy group, a halogen atom, an amino group, an acylamino group, a carbamoyl group, a sulfonylamino group, a sulfamoyl group, and a carboxyl group.

G links Y and X' and L links X' and Dye. They may be any groups as long as the bonds can be maintained stable in a light-sensitive material. Those shown in Table 1 can be enumerated as the preferred groups. They are shown in Table 1 in terms of a combination of G, X' and L but the present invention will not be limited thereto. In the table, * represents a position bonded to Y and ** represents a position bonded to Dye.

TABLE 1
| | Example of G−X−L | | |
|---|---|---|---|
| | G | X | L |
| 1 | 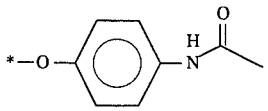 | 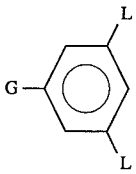 | 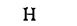 |
| 2 | 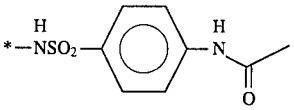 | Same as 1 | Same as 1 |
| 3 | 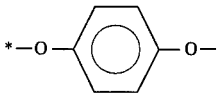 | Same as 1 | Same as 1 |
| 4 | *−O− | Same as 1 | Same as 1 |
| 5 | 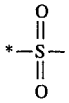 | Same as 1 | Same as 1 |
| 6 | Same as 4 | 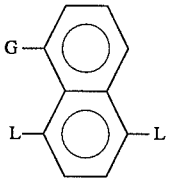 | Same as 1 |
| 7 | 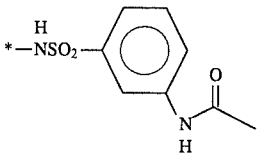 | Same as 6 | Same as 1 |
| 8 | Same as 3 | 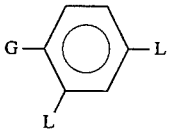 | Same as 1 |
| 9 | Same as 4 | Same as 8 | Same as 1 |
| 10 | Same as 1 | Same as 1 | 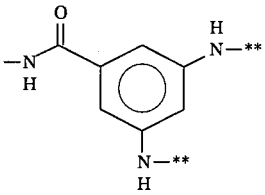 |
| 11 | Same as 4 | 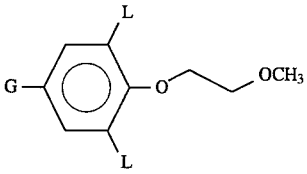 | Same as 1 |

TABLE 1-continued
| | Example of G—X—L | | |
|---|---|---|---|
| | G | X | L |
| 12 | 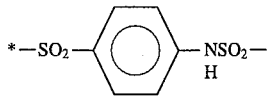 | 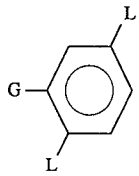 | Same as 1 |
| 13 | 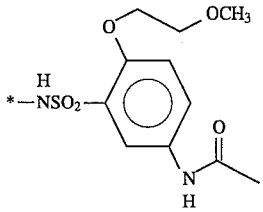 | 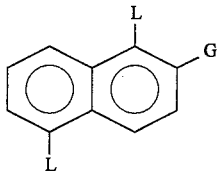 | Same as 1 |
| 14 | Same as 1 | 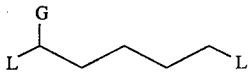 | Same as 1 |
| 15 | Same as 2 | 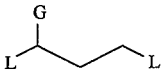 | Same as 1 |
| 16 | Same as 4 | 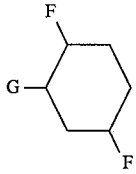 | Same as 1 |
| 17 | Same as 1 | 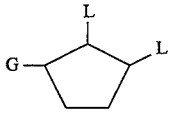 | Same as 1 |
| 18 | 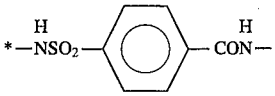 | Same as 1 | —CO—** |
| 19 | 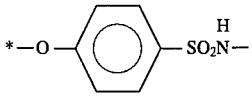 | Same as 1 | —$SO_2$—** |
| 20 | 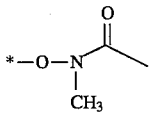 | Same as 1 | Same as 1 |
| 21 | Same as 4 | Same as 1 | 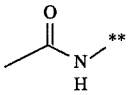 |
| 22 | Same as 5 | Same as 1 | Same as 21 |
| 23 | Same as 3 | 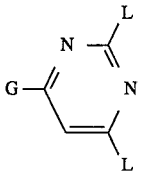 | Same as 1 |

TABLE 1-continued

| | Example of G—X—L | | |
|---|---|---|---|
| | G | X | L |
| 24 | Same as 4 | 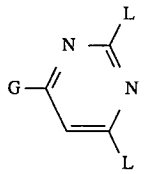 | Same as 1 |
| 25 | Same as 3 | 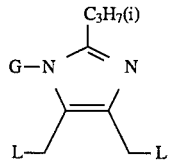 | |

A dye or dye precursor for forming an image can be enumerated as Dye used in the present invention.

There can be enumerated as the dye, for example, an azo dye, an azomethine dye, an azopyrazolone dye, an indoaniline series dye, an indophenol dye, an anthraquinone series dye, a triarylmethane series dye, alizarin, a nitro series dye, a quinoline series dye, an indigo series dye, and a phthalocyanine series dye. Further, there can be enumerated a leuco from thereof, those the absorption wavelengths of which are temporarily shifted, and further a dye precursor such as a tetrazolium salt. Further, these dyes may form a chelating dye with suitable metal. These dyes are described in, for example, U.S. Pat. Nos. 3,880,658, 3,931,144, 3,932,380, 3,932,381, and 3,942,987.

Of them, the cyan, magenta and yellow dyes are particularly important for forming color images.

The examples of a yellow dye:

the compounds described in U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930 and JP-A-56-71072, and Research Disclosure 17630 (1978) and 16475 (1977).

The examples of a magenta dye:

the compounds described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, add JP-A-52-106727, JP-A-53-23628, JP-A-55-36804, JP-A-56-73057, JP-A-56-71060, and JP-A-55-134.

The examples of a cyan dye:

the compounds described in U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, JP-A-52-8827, JP-A-53-47823, JP-A-53-143323, JP-A-54-99431, and JP-A-56-71061, European Patents (EPC) 53,037 and 53,040, and Research Disclosures 17630 (1978) and 16475 (1977).

The specific examples of a dyes, a light absorption of which is temporarily shifted in a light-sensitive element as a kind of a dye precursor part are described in U.S. Pat. Nos. 4,310,612, T-999,003, 3,336,287, 3,579,334, and 3,982,946, British Patent 1,467,317, and JP-A-57-158638.

Next, the specific examples of the compounds of the present invention are shown but the present invention will not be limited thereto.

TABLE 2

| Compound No. | Structure other than D | Structure of D |
|---|---|---|
| Y-1 | 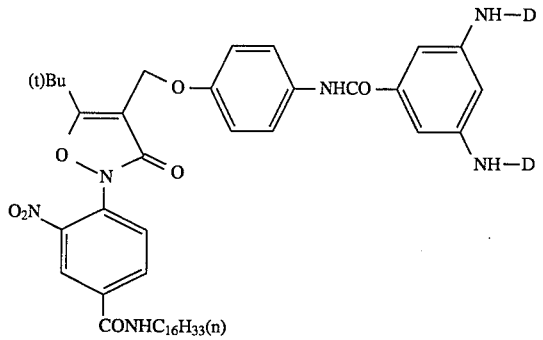 | 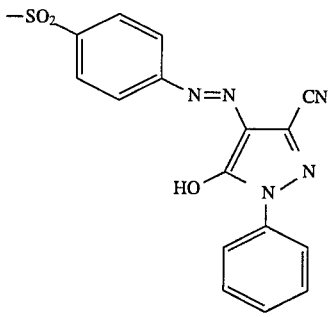 |

TABLE 2-continued
| Compound No. | Structure other than D | Structure of D |
|---|---|---|
| Y-2 | Same as Y-1 | 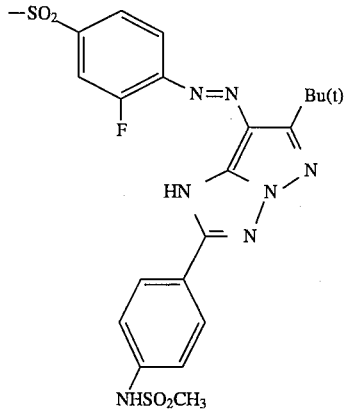 |
| Y-3 | Same as Y-1 | 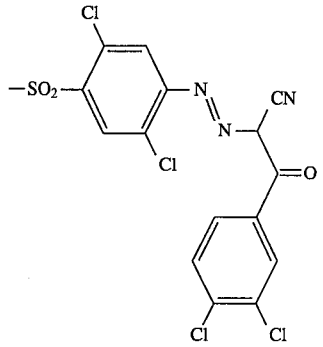 |
| Y-4 | 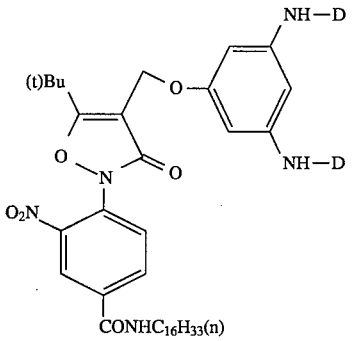 | Same as Y-2 |
| M-1 | Same as Y-4 | 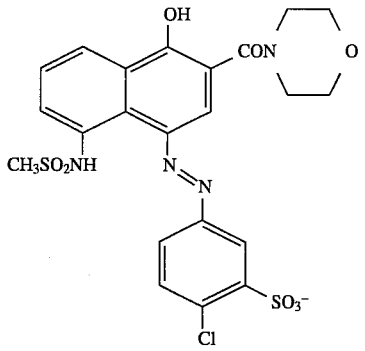 |

TABLE 2-continued
| Compound No. | Structure other than D | Structure of D |
|---|---|---|
| C-1 | Same as Y-4 | 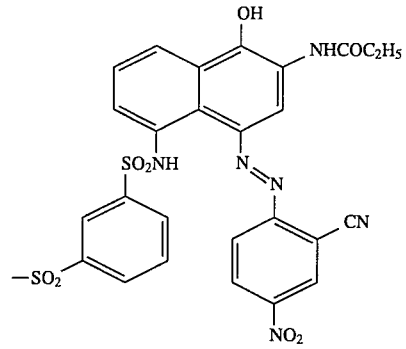 |
| C-2 | Same as Y-4 | 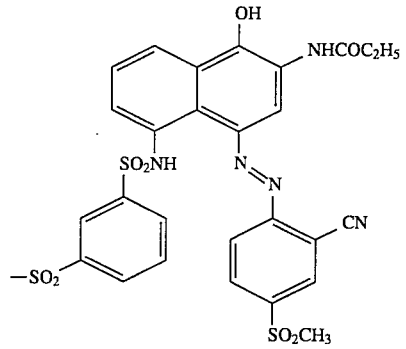 |
| Y-5 | 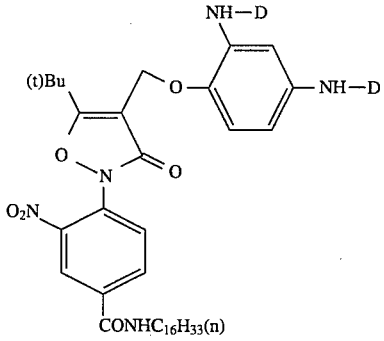 | Same as Y-2 |
| M-2 | Same as Y-5 | Same as M-1 |
| C-3 | Same as Y-5 | Same as C-1 |
| C-4 | Same as Y-5 | Same as C-2 |
| M-3 | Same as Y-5 | 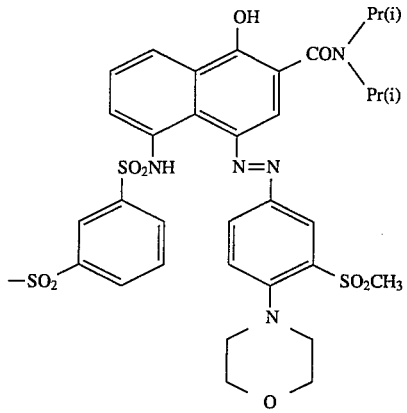 |

TABLE 2-continued
| Compound No. | Structure other than D | Structure of D |
|---|---|---|
| Y-6 | 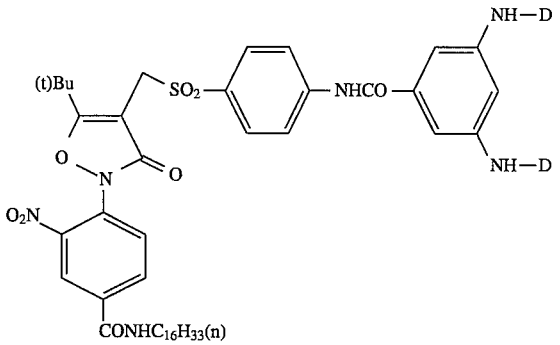 | Same as Y-2 |
| M-4 | Same as Y-6 | Same as M-1 |
| C-5 | Same as Y-6 | Same as C-1 |
| C-6 | Same as Y-6 | Same as C-2 |
| Y-7 | 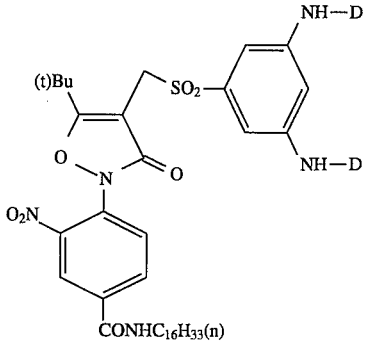 | Same as Y-2 |
| M-5 | Same as Y-7 | Same as M-1 |
| C-7 | Same as Y-7 | Same as C-1 |
| C-8 | Same as Y-7 | Same as C-2 |
| Y-8 | 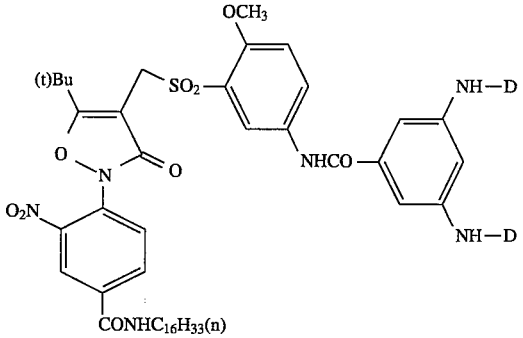 | Same as Y-2 |
| M-6 | Same as Y-8 | Same as M-1 |
| C-9 | Same as Y-8 | Same as C-1 |
| C-10 | Same as Y-8 | Same as C-2 |

TABLE 2-continued
| Compound No. | Structure other than D | Structure of D |
|---|---|---|
| Y-9 | 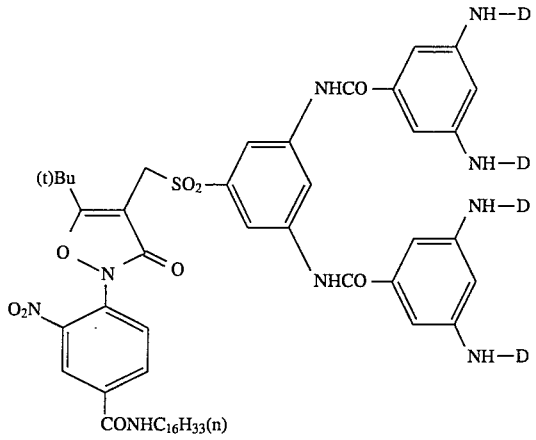 | Same as Y-2 |
| M-7 | Same as Y-9 | Same as M-1 |
| C-11 | Same as Y-9 | Same as C-1 |
| C-12 | Same as Y-9 | Same as C-2 |
| Y-10 | 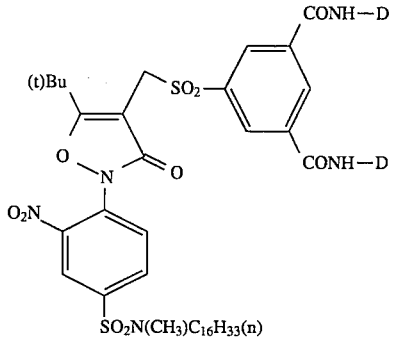 | Same as Y-1 |
| M-8 | Same as Y-10 | Same as M-1 |
| C-13 | Same as Y-10 | Same as C-1 |
| C-14 | Same as Y-10 | Same as C-2 |
| Y-11 | 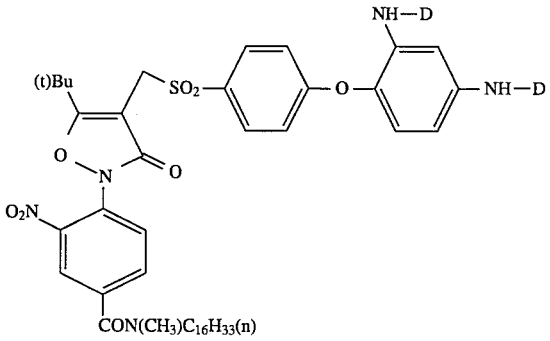 | Same as Y-2 |
| M-9 | Same as Y-11 | Same as M-1 |
| C-15 | Same as Y-11 | Same as C-1 |
| C-16 | Same as Y-11 | Same as C-2 |

TABLE 2-continued
| Compound No. | Structure other than D | Structure of D |
|---|---|---|
| Y-12 | 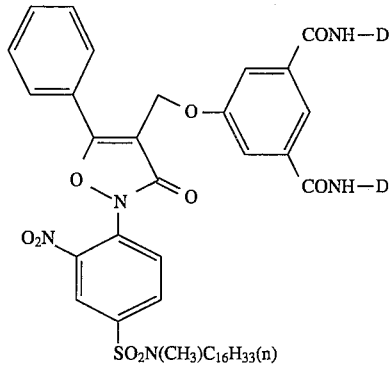 | Same as Y-2 |
| M-10 | Same as Y-12 | Same as M-1 |
| C-17 | Same as Y-12 | Same as C-1 |
| C-18 | Same as Y-12 | Same as C-2 |
| Y-13 | 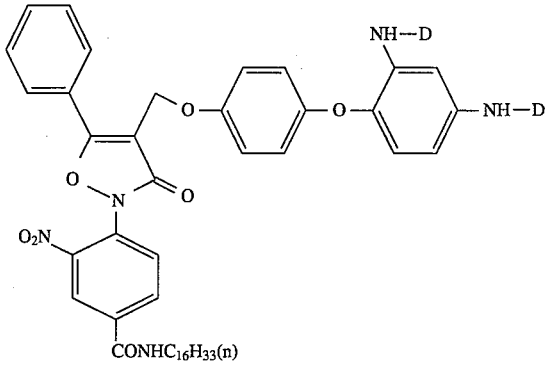 | Same as Y-2 |
| M-11 | Same as Y-13 | Same as M-1 |
| C-19 | Same as Y-13 | Same as C-1 |
| C-20 | Same as Y-13 | Same as C-2 |
| Y-14 | 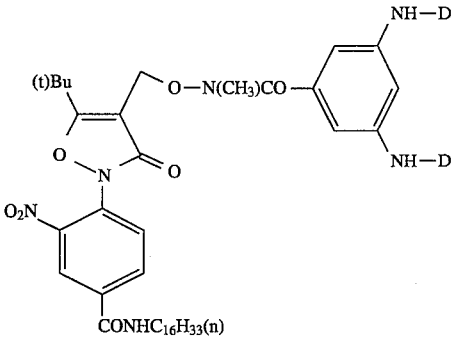 | Same as Y-2 |
| M-12 | Same as Y-14 | Same as M-1 |
| C-21 | Same as Y-14 | Same as C-1 |
| C-22 | Same as Y-14 | Same as C-2 |

TABLE 2-continued
| Compound No. | Structure other than D | Structure of D |
|---|---|---|
| Y-15 | 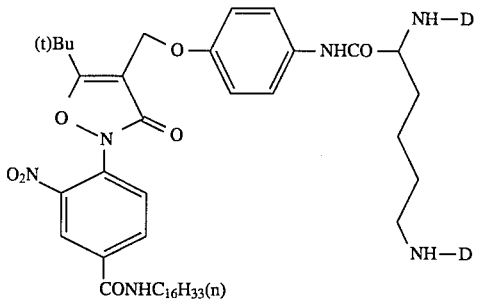 | Same as Y-2 |
| M-13 | Same as Y-15 | Same as M-1 |
| C-23 | Same as Y-15 | Same as C-1 |
| C-24 | Same as Y-15 | Same as C-2 |
| C-25 | Same as Y-4 | 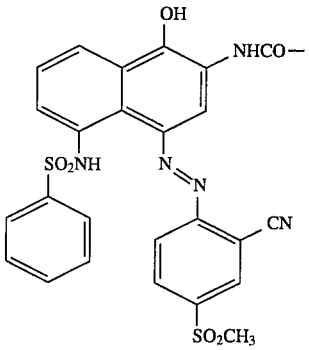 |
| Y-16 | 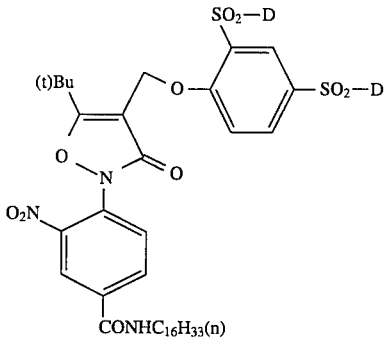 | 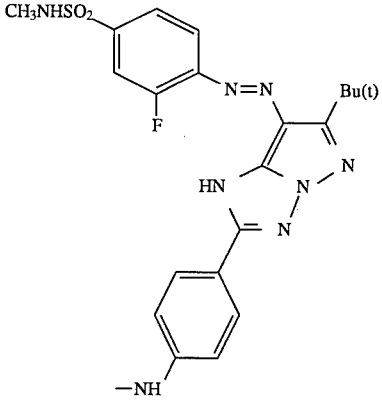 |
| M-14 | Same as Y-16 | 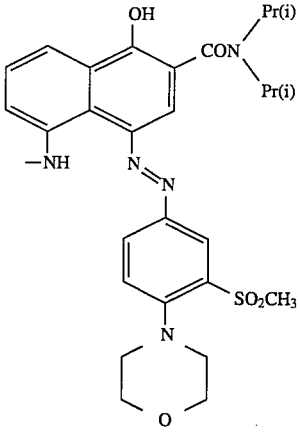 |

TABLE 2-continued
| Compound No. | Structure other than D | Structure of D |
|---|---|---|
| C-26 | Same as Y-16 | 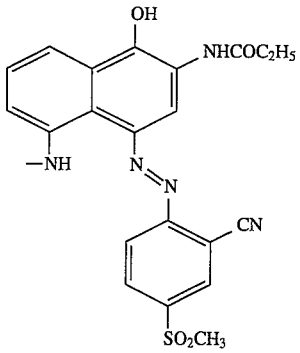 |
| C-27 | Same as Y-16 | 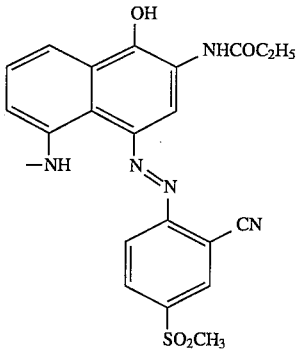 |
| C-28 | Same as Y-4 | 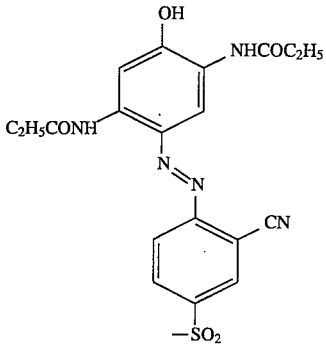 |
| Y-17 | 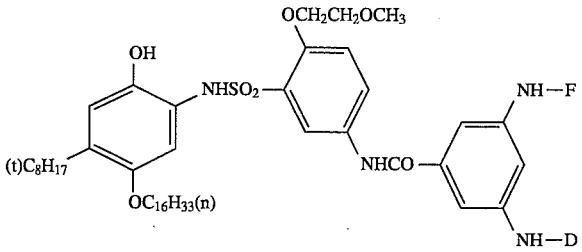 | Same as Y-1 |
| M-15 | Same as Y-17 | Same as M-1 |
| C-29 | Same as Y-17 | Same as C-1 |
| C-30 | Same as Y-17 | Same as C-2 |

TABLE 2-continued
| Compound No. | Structure other than D | Structure of D |
|---|---|---|
| Y-18 | 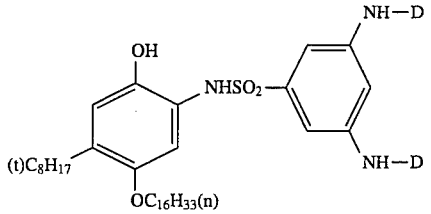 | Same as Y-2 |
| M-16 | Same as Y-18 | Same as M-1 |
| C-31 | Same as Y-18 | Same as C-1 |
| C-32 | Same as Y-18 | Same as C-2 |
| Y-19 | 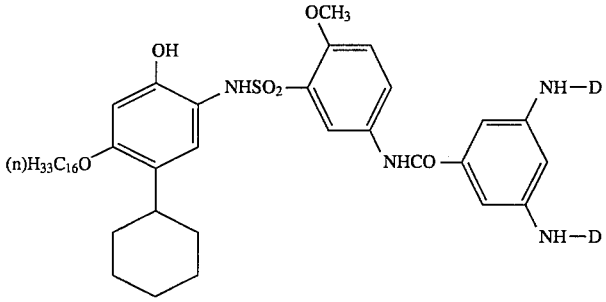 | Same as Y-2 |
| M-17 | Same as Y-19 | Same as M-1 |
| C-33 | Same as Y-19 | Same as C-1 |
| C-34 | Same as Y-19 | Same as C-2 |
| Y-20 | 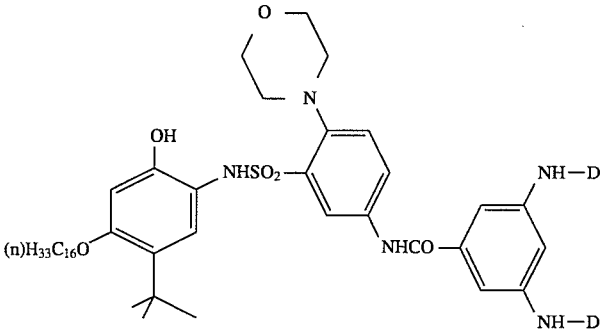 | Same as Y-2 |
| M-18 | Same as Y-20 | Same as M-1 |
| C-35 | Same as Y-20 | Same as C-1 |
| C-36 | Same as Y-20 | Same as C-2 |
| Y-21 | 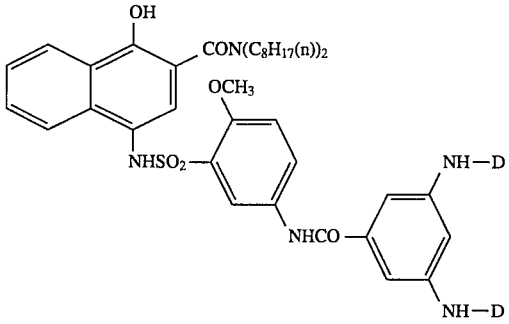 | Same as Y-2 |
| M-19 | Same as Y-21 | Same as M-1 |
| C-37 | Same as Y-21 | Same as C-1 |
| C-38 | Same as Y-21 | Same as C-2 |

TABLE 2-continued

| Compound No. | Structure other than D | Structure of D |
|---|---|---|
| Y-22 | 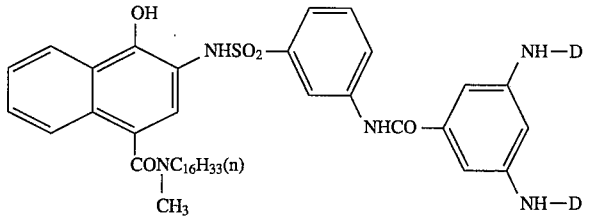 | Same as Y-2 |
| M-20 | Same as Y-22 | Same as M-1 |
| C-39 | Same as Y-22 | Same as C-1 |
| C-40 | Same as Y-22 | Same as C-2 |
| Y-23 | 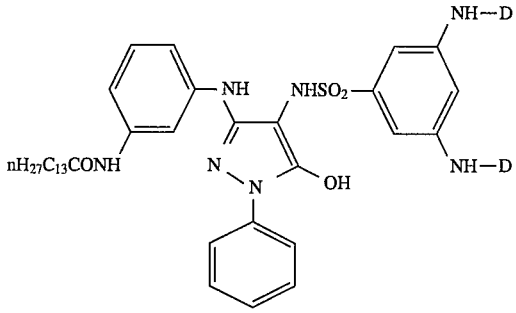 | Same as Y-2 |
| M-21 | Same as Y-23 | Same as M-1 |
| C-41 | Same as Y-23 | Same as C-1 |
| C-42 | Same as Y-23 | Same as C-2 |
| Y-24 | 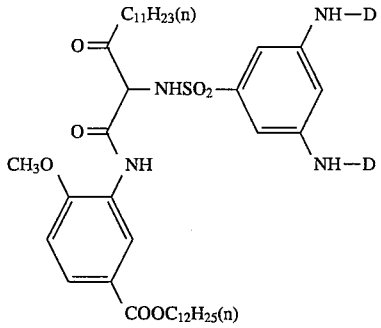 | Same as Y-2 |
| M-22 | Same as Y-24 | Same as M-1 |
| C-43 | Same as Y-24 | Same as C-1 |
| C-44 | Same as Y-24 | Same as C-2 |
| C-45 | Same as Y-19 | Same as C-25 |

Next, the synthetic examples of the specific compounds of the present invention is shown.

Synthesis of specific compound example Y-1:

Synthesis of intermediate (A):

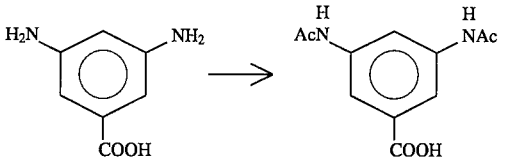

-continued

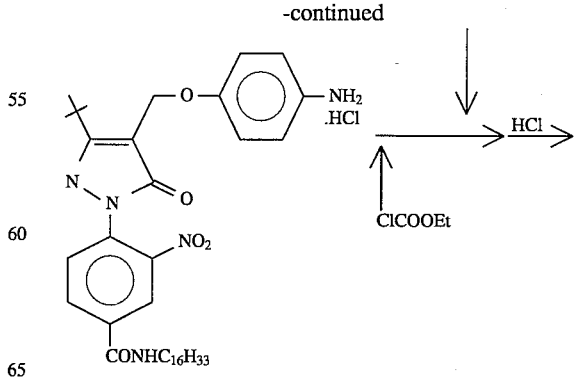

Compound (B)

-continued

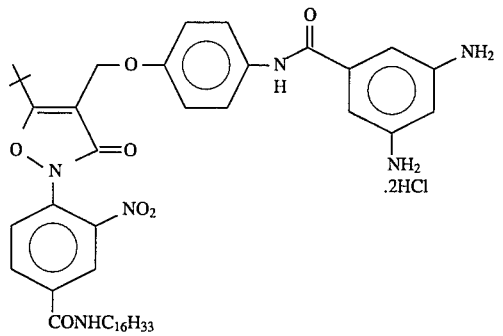

Intermediate (A)

(i) Synthesis of 3,5-diacetylaminobenzoic acid:

Water 2.0 liter was added to 100 g of 3,5-diaminobenzoic acid and stirring was applied while cooling with ice, followed by dropping 314 ml of acetic anhydride while maintaining a temperature at 20° to 25° C. Further, after carrying out a reaction at a room temperature for one hour, crystal was filtered off and washed with water, followed by drying, whereby 148 g of 3,5-diacetylaminobenzoic acid was obtained. (Yield: 95%).

(ii) Synthesis of intermediate (A):

Six hundred ml of acetonitrile and 29.5 ml of triethylamine were added to 50 g of 3,5-diacetylaminobenzoic acid for dissolution and stirring was applied while cooling with ice. Ethyl chlorocarbonate 20.2 ml was dropped while maintaining a temperature at 10° C. or lower, and then compound (B) 124 g was added, followed by further continuing a reaction at a temperature of 30° to 40° C. for 4 hours while dropping triethylamine 30 ml. After the reaction, crystal was filtered off and washed with water, followed by further washing with methanol and drying.

After drying, 750 ml of ethanol and 250 ml of conc. sulfuric acid were added to the crystal and heated for refluxing for one hour. After the reaction, a solution was cooled down to 0° C. and crude crystal formed was filtered off. The crystal was dissolved in 300 ml of methanol by heating and then 1.0 liter of acetonitrile was added for crystallization, whereby crystal 102 g of the intermediate (A) was obtained. (Yield: 66%). m.o.: 188° to 192° C. (changed to a blackish brown color).

Synthesis of specific compoud example Y-1:

Five hundred ml of dimethylacetamide and 60 ml of α-picoline were added to 100 g of intermediate (A) and stirring was applied while cooling with ice. Ninety five g of yellow dye acid chloride (C) was added over a period of about one hour while maintaining a temperature at 10° C. or lower, and a reaction was further carried out at a room temperature for 2 hours. After the reaction, 10 ml of pyridine and 10 ml of water were added and heated to 60° C. in order to remove by-products, followed by adding water and ethyl acetate for extraction. The extract was washed with diluted hydrochloric acid and saturated aqueous salt, followed by adding magnesium sulfate for drying and concentrating with a rotary evaporator.

Four hundred ml of dimethylacetamide, 800 ml of acetonitrile, 1000 ml of methanol, and 20 ml of pyridine were added to the concentrate, and heating was applied for dissolution. Then, 100 ml of acetone and 30 ml of water were added and stood for cooling. About 15 hours later, 20 ml of water was added and stirring was carried out for further 2 hours to obtain crystal by filteration. This crystal was recrystallized further twice at the same crystallization condition, whereby 58 g of high purity specific compound example Y-1 was obtained. (Yield: 34%).

Yellow dye acid chloride

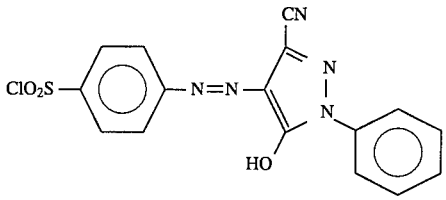

Pysical value of specific compound example Y-1:

$^1$H-NMR data (in a heavy DMSO solution): δ10.67 (2H, s), δ10.20 (1H, s), δ8.85 (1H, t), δ8.55 (1H,d), δ8.30 (1H, dd), δ8.05 to 7.20 (14H, m), δ7.60 (2H, d), δ7.55 to 7.20 (10H, m), δ7.02 (2H, d), δ4.84 (2H, s), δ3.30 (2H, dt), δ1.40 (9H, s), δ1.62 to 1.10 (28H, m), δ0.86 (3H, t).

m.p.: 159° to 162° C.

Synthesis of specific compound example M-9:

(i) Synthesis of intermediate (D):

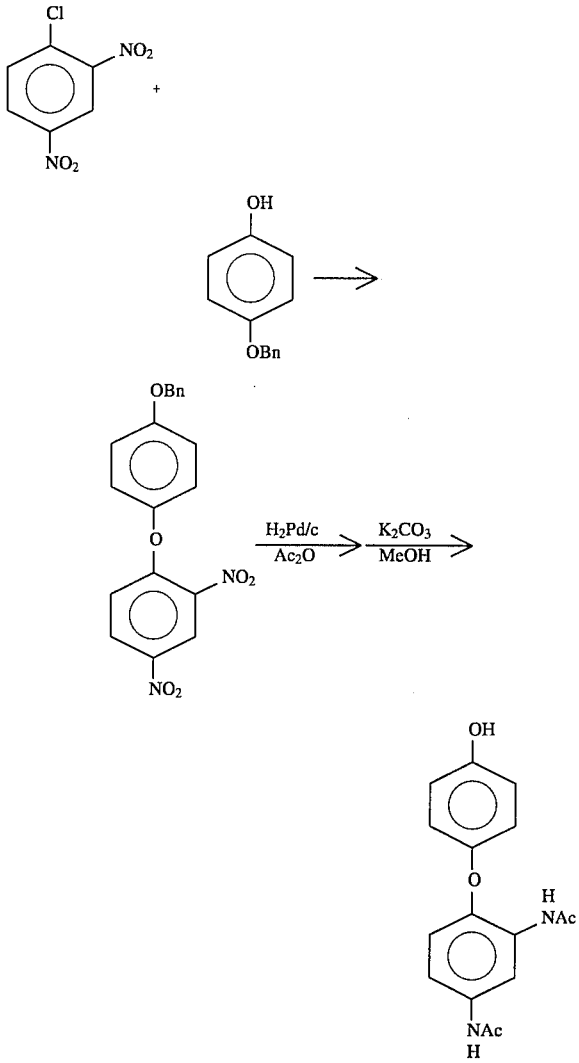

Intermediate (D)

Two hundred and fifty ml of dimethylacetamide was added to 25.3 g of 2,4-dinitrochlorobenzene, 25.0 g of hydroquinone monobenzyl ether, and 50 g of potassium carbonate, and a reaction was carried out at 100° C. for 40 minutes. After the reaction, water-ethyl acetate were added for extraction and magnesium sulfate was added to an extract for drying, followed by concentrating with a rotary evaporator.

Two hundred and fifty ml of ethyl acetate and 3.0 g of 10%-palladium carbon were added to the concentrate and a mixture was put in an autoclave of 1.0 liter. Hydrogen was charged thereinto at 100 atm and a reaction was carried out at a room temperature for 2 hours, further followed by heating to 75° C. to carry out the reaction for 2 hours.

After finishing the reaction, 70 ml of acetic anhydride and 30 ml of pyridine were added to the contents and stirring was applied at a room temperature for one hour. Then, a celite filtration was carried out to remove palladium-carbon and water was added to a filtrate for extraction.

The extract was washed with saturated aqueous salt and magnesium sulfate was added for drying, followed by concentrating with a rotary evaporator.

Three hundred ml of methanol and 80 g of potassium carbonate were added to the concentrate and stirring was applied while cooling with ice, followed by further carrying out a reaction at room temperature for 2 hours. After finishing the reaction, potassium carbonate was removed by the celite filtration and a filtrate was concentrated with a rotary evaporator.

Ethyl acetate 500 ml, 300 ml of water, and 30 ml of acetic acid were added to the concentrate for extraction, and the extract was washed with saturated aqueous salt, followed by adding magnesium sulfate for drying and concentrating with the rotary evaporator. The concentrate was refined with a column chromatography to thereby obtain the intermediate (D). The yield was 62 g (80%).

(ii) Synthesis of intermediate (E):

(Synthetic route)

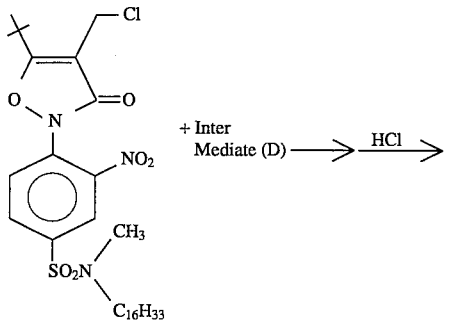

Compound (F)

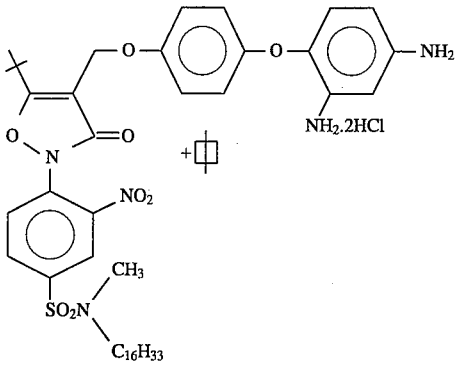

Intermediate (E)

Six hundred ml of acetone, 50 g potassium carbonate, 3 g of sodium iodide, and 3 ml of trismethoxyethoxyethylamine were added to 62.0 g of intermediate (D) and 109 g of compound (F) and heating for refluxing was carried out for 2.5 hours. After a reaction, a solution was concentrated with a rotary evaporator under reduced pressure, and 500 ml of water and 600 ml of ethyl acetate were added for extraction. An ethyl acetate layer was concentrated with a rotary evaporator. Six hundred ml of ethanol and 200 ml of 12N-HCl were added to the concentrate and heating for refluxing was carried out for one hour. After completion, the solution was cooled down to 0° C. to form crystal and this was filtered off, whereby 140 g of intermediate (E) was obtained. (m.p.: 75° to 77° C.).

(iii) Synthesis of specific compound example M-9:

One hundred and twenty ml of dimethylacetamide and 18 g of sodium bicarbonate were added to 26 g of intermediate (E) and stirring was applied at a temperatue of 40° C. Thirty eight g of magenta dye acid chloride (G) was added over a period of 2 hours while maintaining the temperature at 40° to 45° C., and a reaction was continued for further 3 hours after finishing addition. After 5 ml of pyridine and 5 ml of water were added to the reaction solution and stirring was carried out at 50° to 60° C. for one hour, 1.0 liter of ethyl acetate and 1.0 liter of water were added for extraction and 500 ml of a 2%-sodium bicarbonate aqueous solution was added to an ethyl acetate layer for washing, followed by adding 500 ml of 1N-hydrochloric acid for washing and further adding 500 ml of saturated aqueous salt for washing. Magnesium sulfate was added to the extracte for drying, and then the solution was concentrated with a rotary evaporator under reduced pressure. A concentrate was refined with a column chromatography (solvent: $CH_2Cl_2$-MeOH), whereby 42 g of specific compound example M-9 was obtained. (Yield: 73%.)

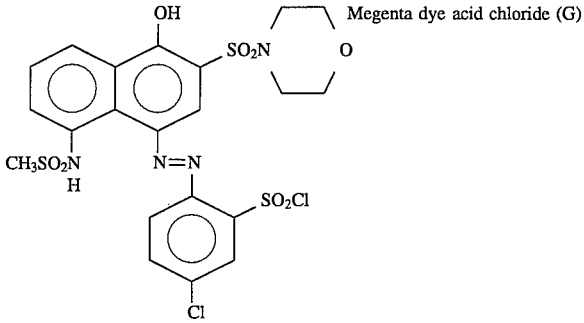

Physical value of specific compound example M-9:

$^1$H-NMR data (in a heavy DMSO solution): δ12.54 (1H, bs), δ12.46 (1H, bs), δ10.53 (1H, s), δ9.97 (1H, s), δ8.88 to 8.75 (3H, m), δ8.52 (1H, s), δ8.29 (1H, d), δ8.12 (2H, bs), δ8.03 (2H, bs), δ7.90 (1H, d), δ7.80 to 7.67 (4H, m), δ7.53 (1H, d), δ7.46 (1H, d), δ7.40 to 7.20 (3H, m), δ6.96 to 6.83 (3H, m), δ6.68 to 6.51 (3H, m), δ4.68 (2H, bs), δ3.58 (8H, m), δ3.17 (8H, m), δ3.07 (6H, s), δ1.34 (9H, s), δ1.62 to 1.16 (30H, m), δ0.86 (3H, t).

Synthesis of specific compound example Y-17:

(i) Synthesis of dye (H):

Four hundred ml of dimethylacetamide and 40 g of sodium bicarbonate were added to 20 g of 3,5-diaminobenzoic acid, and stirring was applied while cooling with ice. One hundred g of yellow dye acid chloride (C) was added over a period of about 40 minutes while maintaining a temperature at 5° to 10° C., and then stirring was applied at 10° C. for 2 hours. After a reaction, 1.0 liter of water was added and 50 ml of hydrochloric acid was added little by little to deposit crystal. This was filtered off and dried, whereby 85 g of dye (H) was obtained. (Yield: 75%.)

Dye (H)

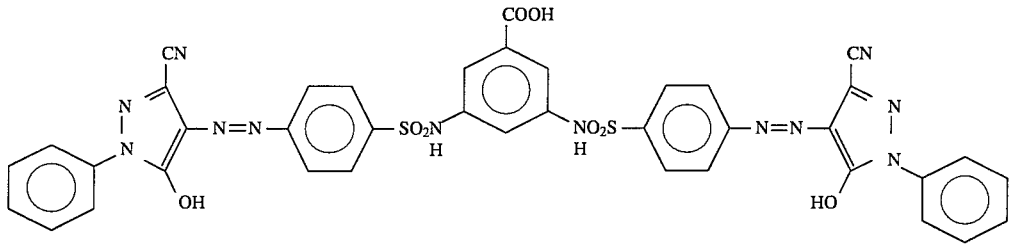

$^1$H-NMR data (in a heavy chloroform):

δ9.70 (2H, s), δ7.28 to 7.07 (14H, m), δ6.86 to 6.70 (8H, m), δ6.66 (1H, d).

(ii) Synthesis of dye acid chloride (I):

One hundred ml of ethyl acetate and 20 ml of thionyl chloride were added to 40 g of dye (H) and stirring was applied at 70° C. for 3 hours. After finishing a reaction, solution was cooled down to 0° C. to deposit crystal and this was filtered off, followed by drying under reduced pressure, whereby 35 g of dye acid chloride (I) was obtained. (Yield: 86%.)

Dye acid chloride (I)

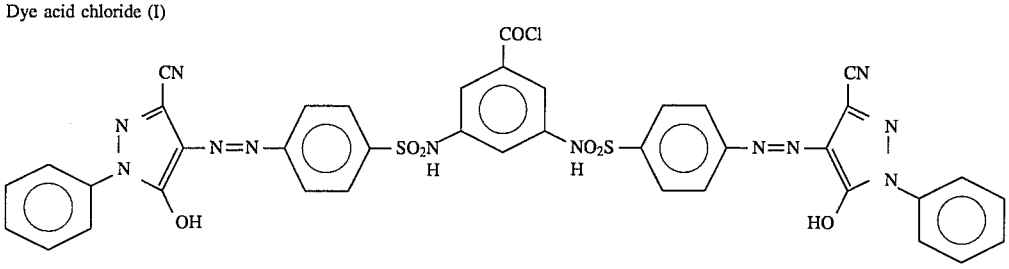

(iii) Synthesis of specific compound example Y-17:

Eighty ml of dimethylacetamide and 10 g of sodium bicarbonate were added to 25 g of compound (J) and stirring was applied at 5° to 10° C. under a nitrogen flow. Thirty one g of dye acid chloride (I) was added over a period of about one hour while maintaining a temperature at 5° to 10° C. After finishing addition, a reaction was continued at a room temperature for one hour and a reaction solution was poured into IN-hydrochloric acid 400 ml, followed by vigorously stirring to thereby form crystal. This was filtered off and refined with a column chromatography, whereby 47 g of specific compound example Y-17 was obtained. (Yield: 87%.)

Compound (J)

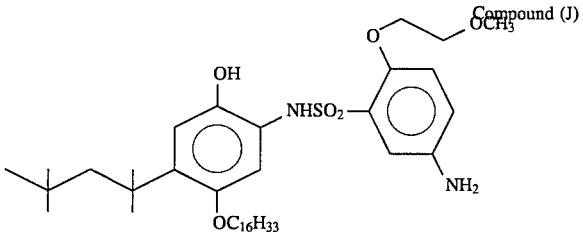

Physical value of specific compound example Y-17:

$^1$H-NMR data (in a heavy DMSO solution):

δ10.55 (2H, s), δ10.31 (1H, s), δ8.97 (1H, s), δ7.88 (1H, s), δ7.85 to 7.67 (10H, m), δ7.54 to 7.22 (8H, m), δ7.18 (1H, s), δ7.03 to 6.88 (4H, m), δ6.77 to 6.62 (3H, m), δ4.07 (2H, t), δ3.74 to 3.60 (4H, m), δ3.32 (6H, s), δ3.30 (3H, s), δ1.81 (2H, s), δ1.80 to 1.61 (2H, m), δ1.52 to 1.10 (28H, m), δ0.88 (3H, t), δ0.60 (9H, s).

In the light-sensitive material of the present invention, the dye-providing compound of the present invention, that is, the compound of formula (4) may be used for all of three colored (yellow, magenta and cyan), or the dye-providing compound of the present invention may be used for any one or two colors and a conventional dye-providing compound may be used for the others.

In the case where the dye-providing compounds of the present invention and those used in combination are the reduced dye-providing compounds, a reducing agent (described as an electron-providing product in some cases) is used.

The reducing agent may be supplied from an outside, or it may be incorporated in advance into a light-sensitive material. Further, there can be used as well a reducing agent precursor which does not have a reducibility in itself but reveals the reducibility by an action of a nucleophilic reagent and heat in a course of a development.

Examples of the electron-providing materials used in the present invention include the electron-providing materials and the electron-providing material precursors described in columns 49 to 50 of U.S. Pat. No. 4,500,626, columns of 30 to 31 U.S. Pat. No. 4,483,914, and U.S. Pat. Nos. 4,330,617 and 4,590,152, at pages 17 and 18 of JP-A-60-140335, JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-60-244044, and JP-A-62-131253 to JP-A-62-131256, and at pages 78 to 76 of European Patent 220,746A2.

A combination of such various electron-providing materials as those described in U.S. Pat. No. 3,039,869 can be used.

In the case where the dye-providing compound of the present invention is nondiffusible or a reducing agent used in combination with the reduced dye-providing compound of the present invention is nondiffusible, an electron transfer agent or the precursor thereof may be used.

The electron transfer agent or the precursor thereof can be selected from the electron-providing materials or the precursors thereof described above. The electron transfer agent or the precursor thereof has preferably a larger mobility than that of a nondiffusible dye-providing material. The particularly useful electron transfer agent is 1-phenyl-3-pyrazolidones or aminophenols.

The nondiffusible dye-providing material used in combination with the electron transfer agent may be any one of the reducing agents described above as long as they do not substantially move in a layer of a light-sensitive material. There can preferably be enumerated hydroquinones, sulfonamidophnols, sulfonamidonaphthols, and the compounds described in JP-A-53-110827 as the electron-providing material.

The electron transfer agent may be supplied from an outside, or it may be incorporated in advance into a light-sensitive material.

In the present invention, the total addition amount of the electron-providing material and the electron transfer agent is 0.01 to 20 moles, particularly preferably 0.1 to 10 moles per mole of silver.

The heat developable light-sensitive material used in the present invention has fundamentally light-sensitive silver halide, a binder, and a dye-providing compound on a support, and further an organic metal salt oxidizing agent can be incorporated, as needed.

These components are added to the same layer in many cases but can separately be added to the different layers if they are kept in a reactive condition. For example, the presence of a colored dye-providing compound in a layer lower than a silver halide emulsion can prevent reduction of a sensitivity. A reducing agent is contained preferably in the heat developable light-sensitive material but it may be supplied from an outside by, for example, a process such as allowing it to be diffused from a dye-fixing element described later.

In order to use the three primary colors, yellow, magenta and cyan, to obtain a color of a wide range in a chromaticity diagram, at least three silver halide emulsion layers each having a sensitivity in a different spectral region are used in combination. There are available, for example, the combination of a blue-sensitive layer, a green-sensitive layer and a red-sensitive layer and the combination of a green-sensitive layer, a red-sensitive layer and an infrared-sensitive layer. The respective light-sensitive layers can take various arrangement order known in a conventional type color light-sensitive material. Further, these respective light-sensitive layers may be divided into two or more layers as needed.

The heat developable light-sensitive material can be provided with various auxiliary layers such as a protective layer, a subbing layer, an intermediate layer, a yellow color filter layer, an anti-halation layer, and a back layer.

Silver halide capable of being used in the present invention may be any of silver chloride, silver bromide, silver bromoiodide, silver bromochloride, silver chloroiodide, and silver bromochloroiodide.

The silver halide emulsion used in the present invention may be either a surface latent image type emulsion or an inner latent image type emulsion. The inner latent image type emulsion is combined with a nucleus-forming agent and a fogging agent to be used as a direct reversal emulsion. It may be a so-called core/shell emulsion in which a grain inside and a grain surface have the different phases. The silver halide emulsion may be monodispersed or polydispersed, and the monodispersed emulsions may be used in a mixture. The grain size is preferably 0.1 to 2 μm, particularly preferably 0.2 to 1.5 μm. A crystal habit of a silver halide grain may be any of cube, octahedron, tetradecahedron, plate having a high aspect ratio, and others.

Specifically, there can be used any of the silver halide emulsions described in column 50 of U.S. Pat. Nos. 4,500,626, and 4,628,021, Research Disclosure (hereinafter abbreviated as RD) 17029 (1978), and JP-A-62-253159, JP-A-3-110555, JP-A-2-236546, and JP-A-1-167743.

A silver halide emulsion may be used as it is nonpostripening but it is usually subjected to a chemical sensitization before use. There can be used singly or in combination, a sulfur sensitization process, a reduction sensitization process, a novel metal sensitization process, and selenium sensitization process each publicly known in an emulsion for a conventional type light-sensitive material. These chemical sensitizations can be carried out as well under the presence of a nitrogen-containing heterocyclic compound (JP-A-62-253159).

A coating amount of the light-sensitive silver halide used in the present invention falls in the range of 1 mg to 10 g/m$^2$ in terms of the amount of silver.

In the present invention, an organic metal salt can also be used as an oxidizing agent in combination with light-sensitive silver halide. Of such the organic metal salts, an organic silver salt is particularly preferably used.

The organic compounds which can be used for forming the above organic silver salt oxidizing agent include benzotriazoles described in U.S. Pat. No. 4,500,626, columns 52 to 53, aliphatic acid, and other compounds. Further, also useful are a silver salt of carboxylic acid having an alkynyl group, such as silver phenylpropiolate acid described in JP-A-60-113235, and acetylene silver described in JP-A-61-249044. The organic silver salts may be used in combination of two or more kinds.

The above silver salts can be used in combination in an amount of 0.01 to 10 moles, preferably 0.01 to 1 mole per mole of light-sensitive silver halide. The total coated amount of the light-sensitive silver halide and the organic silver salt is suitably 50 mg to 10 g/m$^2$ in terms of the amount of silver.

In the present invention, various anti-fogging agents and photographic stabilizers can be used. There can be used as the example thereof, azoles and azaindenes described in RD 17643 (1978), pp. 24 to 25, carboxylic acid containing nitrogen and phosphoric acids described in JP-A-59-168442, the mercapto compounds and the metal salts thereof described in JP-A-59-111636 and JP-A-4-73649, and the acetylene compounds described in JP-A-62-87957 and JP-A-4-255845.

Silver halides used in the present invention may be spectrally sensitized with methine dyes and others. There are included in the dyes used, a cyanine dye, a merocyanine dye, a composite cyanine dye, a composite merocyanine dye, a holopolarcyanine dye, a hemicyanine dye, a styryl dye, and a hemioxonol dye.

Specifically, there can be enumerated the sensitizing dyes described in U.S. Pat. No. 4,617,257, JP-A-59-180550 and JP-A-60-140335, and RD 17029 (1978) pp. 12 to 13.

These sensitizing dyes may be used either singly or in combination thereof. The combination of the sensitizing dyes is used particularly for the purpose of a supersensitization in many cases.

In addition to the sensitizing dyes, there may be incorporated into an emulsion, the dyes having no spectral sensitization action by themselves or the materials which do not substantially absorb visible rays and show a supersensitization (for example, the compounds described in U.S. Pat. No. 3,615,641, and JP-A-63-23145).

Timing when these sensitizing dyes are added to an emulsion may be in a chemical ripening or before or after that, or before or after a nucleus formation of a silver halide grain according to U.S. Pat. Nos. 4,183,756 and 4,225,666. In general, an addition amount is $10^{-8}$ to $10^{-2}$ mole per mole of silver halide.

A hydrophilic compound is preferably used for a binder contained in a constitutional layer of a light-sensitive material and a dye fixing element. The compounds described at the pages 26 to 28 of JP-A-62-253159 can be enumerated as the example thereof. Specifically, a transparent or translucent hydrophilic binder is preferred and there can be enumerated, for example, a natural compound such as protein including gelatin and a gelatin derivative, polysaccharides including a cellulose derivative, starch, gum arabic, dextran, and pluran, and a synthetic high molecular compound such as polyvinyl alcohol, polyvnyl pyrrolidone, and an acrylamide polymer, and others. Further, there can be used a high water absorptive polymer described in JP-A-62-245260, that is, a homopolymer of a vinyl monomer having —COOM or —$SO_3M$ (M is a hydrogen atom or an alkali metal), or a copolymer of these vinyl monomers themselves or with the other vinyl monomers (for example, sodium methacrylate, ammonium methacrylate and Sumika Gel L-5H manufactured by Sumitomo Chemical Ind. Co., Ltd.). These binders can be used as well in combination of two or more kinds.

In the case where the system in which a trace of water is supplied to carry out a heat development is applied, the use of the above high water absorptive polymer makes it possible to rapidly absorb water. Further, the use of the high water absorptive polymer can prevent a dye from retransferring from a dye-fixing element to the others after transferring.

In the present invention, a coating amount of a binder contained in a light-sensitive element is preferably 5 g or less, particularly suitably 4 g or less per $m^2$ of the light-sensitive element.

Various polymer latexes can be incorporated into a constitutional layer (including a back layer) of a light-sensitive material or a dye-fixing element for the purposes of an improvement in a film physical property such as a dimension stability, a curling prevention, a sticking prevention, a cracking prevention of a film, and a pressure sensitization or desensitiza-tion prevention. To be specific, there can be used any of the polymer latexes described in JP-A-62-245258, JP-A-62-136648 and JP-A-62-110066. In particular, the use of a polymer latex having a low glass transition point (40° C. or lower) for a mordant layer can prevent cracking of the mordant layer and the use of a polymer latex having a light glass transition point can provide a curling prevention effect.

In the present invention, a development inhibitor-releasing redox compound can be used for a purpose of improving a color reproducibility. There can be used, for example, those described in JP-A-61-213,847, JP-A-62-260,153, JP-A-2-68,547, JP-A-2-110,557, JP-A-2-253,253, and JP-A-1-150,135.

The synthetic processes of the development inhibitor-releasing redox compounds used in the present invention are described in JP-A-61-213,847 and JP-A-62-260,153, U.S. Pat. No. 4,684,604, JP-A-1-269936, U.S. Pat. Nos. 3,379,529, 3,620,746, 4,377,634, and 4,332,878, and JP-A-49-129,536, JP-A-56-153,336, and JP-A-56-153,342.

The development inhibitor-releasing redox compound of the present invention is used in a range of $1\times10^{-6}$ to $5\times10^{-2}$ mole, more preferably $1\times10^{-5}$ to $1\times10^{-2}$ mole per mole of silver halide.

The hydrophobic additives such as the dye-providing compound of the present invention, a nondiffusible reducing agent, an electron-providing material and a development inhibitor-releasing redox compound can be used dissolving in a suitable water miscible organic solvent, for example, alcohols (methanol, ethanol, propanol, and fluorinated alcohol), ketones (acetone and methyl ethyl ketone), dimethylformamide, dimethylsulfoxide, and methyl cellosolve.

Further, there can be prepared and used as well the emulsions by a process in which the additives are dissolved using oil such as dibutyl phthalate, tricresyl phthalate, glyceryl triacetate, and diethyl phthalate, each of which is already known well, and an auxiliary solvent such as ethyl acetate and cyclohexanone to mechanically prepare an emulsified dispersion, and a process in which a dispersion is prepared with a polymer, described in JP-B-51-39853 and JP-A-51-59943. Or, powder of the hydrophobic additives can be dispersed in water with a ball mill, a colloid mill, or a supersonic wave by a process known as a solid matter dispersion process to use them.

In dispersing a hydrophobic compound in a hydrophilic colloid, various surface active agents can be used. For example, those listed as the surface active agent at pages 37 to 38 of JP-A-59-157636 can be used.

In the present invention, there can be used a compound which provides the light-sensitive material with a stabilization of an image as well as an activation of a development. The exemplified compounds capable of being preferably used are described at the columns 51 to 52 of U.S. Pat. No. 4,500,626.

In a system in which an image is formed by a diffusion transfer of a dye, a dye-fixing element is used together with a light-sensitive material. The dye-fixing element may be either of a form in which the dye fixing-element is independently coated on a support different from that for the light-sensitive material, or the form in which it is coated on the same support as that for the light-sensitive material. With respect to the relationships of the light-sensitive element with the dye fixing element, with a support and with a white color reflection layer, the relationships described at the 57th column of U.S. Pat. No. 4,500,626 can be applied as well to the present invention.

The dye-fixing element preferably used in the present invention has at least one layer containing a mordant and a binder. The compounds known in a photographic field can be used as the mordant and there can be enumerated as the specific example thereof, the mordants described at the columns 58 to 59 of U.S. Pat. No. 4,500,626 and the pages 32 to 41 of JP-A-61-88256, and those described in JP-A-62-244043 and JP-A-62-244036. Further, the dye-receivable high molecular compound described in U.S. Pat. No. 4,463,079 may be used as well.

The dye-fixing element can be provided with an auxiliary layer such as a protective layer, a peeling layer, and an anti-curling layer according to necessity. In particular, the provision of the protective layer is useful.

There can be used for the constitutional layers for a light-sensitive material and dye-fixing element, a plasticizer, a sliding agent, or high boiling solvent as a peeling improver for the light-sensitive material and the dye-fixing element. The specific examples include those described in JP-A-62-253159, pp. 25 and 62-245253.

Further, there can be used for the above purpose, various silicone oils (all silicone oils from a dimethyl silicone oil to a modified silicone oil obtained by introducing various organic groups into dimethyl siloxane). Effective as the example thereof are various modified silicone oils described in "Modified Silicone Oil" technical literature P6-18B, particularly carboxy-modified silicone oil (trade name: X-22-3710).

Silicone oils described in JP-A-62-215953 and JP-A-63-46449 are effective as well.

An anti-fading agent may be used for the light-sensitive material and the dye-fixing element. The anti-fading agentincludes, for example, an antioxidant, a UV absorber, and some kind of a metal complex.

The antioxidant includes, for example, a chroman series compound, a coumarane series compound, a phenol series compound (for example, hindered phenols), a hydroquinone derivative, a hindered amine derivative, and a spiroindane series compound. Further, the compounds described in JP-A-61-159644 are effective as well.

The UV absorber includes a benzotriazole series compound (U.S. Pat. No. 3,533,794), a 4-thiazolidone series compound (U.S. Pat. No. 3,352,681), a bezophenone series compound (JP-A-56-2784), and the other compounds described in JP-A-54-48535, JP-A-62-136641 and JP-A-61-88256. Further, the UV absorptive polymers described in JP-A-62-260152 are effective as well.

The metal complex includes the compounds described in U.S. Pat. Nos. 4,241,155, 4,245,018, columns 3 to 36, and 4,254,195, columns 3 to 8, and JP-A-62-174741, JP-A-61-88256, pages 27 to 29, JP-A-63-199248, JP-A-1-75568, and JP-A-1-74272.

The examples of the useful anti-fading agent are described in JP-A-62-215272, pages 125 to 137.

The anti-fading agent used for preventing fading of a dye transferred to the dye-fixing element may be incorporated in advance into the dye-fixing element or may be supplied to the dye-fixing element from an outside of the light-sensitive material.

The above antioxidant, UV absorber and metal complex may be used in combination of themselves.

A fluorescent whitening agent may be used for the light-sensitive material and the dye-fixing element. In particular, the fluorescent whitening agent is preferably incorporated into the dye-fixing element of preferably supplied from an outside of the light-sensitive material. There can be enumerated as the examples thereof, the compounds described in "The Chemistry of Synthetic Dyes" edited by K. Veenkataraman, vol. V, chapter 8, and JP-A-61-143752. Specifically, there can be enumerated a stilbene series compound, a coumarin series compound, a biphenyl series compound, a benzoxazolyl series compound, a napthalimide series compound, a pyrazolidone series compound, and a carbostyryl series compound.

The fluorescent whitening agent can be used in combination with the anti-fading agent.

The hardeners described in U.S. Pat. No. 4,678,739, the 41st column, and JP-A-59-116655, JP-A-62-245261, and JP-A-61-18942 can be enumerated as a hardener used for the constitutional layers in a light-sensitive material and a dye-fixing element. Specifically, there can be enumerated an aldehyde series hardener (formaldehyde), an aziridene series hardener, an epoxy series hardener, a vinyl sulfone series hardener (N,N'-ethylene-bis(vinylsulfonylacetamide)ethane), an N-methylol series hardener (dimethylolurea), and a polymer series hardener (the compounds described in JP-A-62-234157). The vinyl suofone series hardeners described in JP-A-3-114,043 are particularly preferably used.

Various surface active agents can be used for the constitutional layers in a light-sensitive material and a dye-fixing element for the purposes of a coating aid, improvement in a peeling performance, improvement in a sliding performance, anti-electrification, and development acceleration. The specific examples of the surface active agent are described in JP-A-62-173463 and JP-A-62-183457.

An organic fluoro compound may be incorporated into the constitutional layers in the light-sensitive material and the dye-fixing element for the purposes of improvement in a sliding performance, anti-electrification, and improvement in a peeling performance. There can be enumerated as the representative examples of the organic fluoro compound, a hydrophobic fluorine compound such as the fluorine series surface active agents described in JP-B-57-8083, columns 8 to 17, and JP-A-61-20944 and JP-A-62-135826, an oily fluorine series compound including fluorine oil, and a solid fluorine compound resin including a tetrafluoroethylene resin.

A matting agent can be used for the light-sensitive material and the dye-fixing element. The matting agent includes the compounds described in JP-A-63-274944 and JP-A-63-274952, such as benzoguanamine resin beads, polycarbonate resin beads, and AS resin beads, as well as the compounds described in JP-A-61-88256, pp. 29, such as silicon dioxide, polyolefin, and polymethacrylate.

In addition thereto, a heat solvent, a defoaming agent, an anti-fungus and anti-mold agent, and colloidal silica may be incorporated into the constitutional layers in the light-sensitive material and the dye-fixing element. The specific examples of these additives are described in JP-A-61-88256, pages 26 to 32.

In the present invention, an image-forming accelerator can be used for the light-sensitive material and/or the dye-fixing element. The image-forming accelerator has the functions sch as acceleration of an oxidation-reduction reaction of a silver salt oxidizing agent with a reducing agent, acceleration of a reaction such as preparation of a dye from a dye-providing material, decomposition of a dye, and releasing of a diffusible dye, and acceleration of transfer of a dye from a light-sensitive material layer to a dye-fixing layer. From a viewpoint of a physical chemical function, it is classified to a base or base precursor, a nucleophilic compound, a high boiling organic solvent (oil), a heat solvent, a surface active agent, and a compound having an interaction with silver or a silver ion. In general, however, these material groups have a composite function and usually has some of the acceleration effects described above in combination. The details thereof are described in U.S. Pat. No. 4,678,739, columns 38 to 30.

The base precursor includes a salt of an organic acid, which is decarboxylated by heat and a base, and the compounds releasing amines by an intermolecular nucleophilic substitution reaction, a Lossen rearrangement, or a Beckmann rearrangement. The specific examples thereof are described in U.S. Pat. No. 4,511,493 and JP-A-62-65038.

Also in a system in which a heat development and transfer of a dye are carried out at the same time under the presence of a small amount of water, a base and/or a base precursor are preferably incorporated into a dye-fixing element in a sense that a storing performance is raised.

In the present invention, there is used a combination of the scarcely soluble metal compounds described in European Patent Publication 210,660 and U.S. Pat. No. 4,740,445 and the compounds (referred to as a complex-forming compound) capable of carrying out a complex-forming reaction with a metal ion constituting this scarcely soluble metal compound. To be specific, it is described in JP-A-2-269,338, pages 2 to 6. The compounds particularly preferred as the scarcely soluble metal compound are zinc hydroxide, zinc oxide, and a mixture of both.

In the present invention, various development stoppers can be used for the light-sensitive material and/or the dye-fixing element for the purpose of obtaining always a constant image against the variations in processing temperature and a processing time in development.

The development stopper as called herein is a compound quickly neutralizing or reacting with a base after an optimum developing to lower a base concentration in a layer to stop the development, or a compound controlling the development by the interaction with silver or a silver salt. Specifically, there can be enumerated an acid precursor releasing acid by heating, an electrophilic compound causing a displacement reaction with coexisting base by heating, a nitrogen-containing heterocyclic compound, and a mercapto compound or a precursor thereof. More details are described at the pages 31 to 32 of JP-A-62-253159.

A material which can endure a processing temperature is used as a support for the light-sensitive material and the dye-fixing element in the present invention. In general, a paper and a synthetic polymer (film) are enumerated. To be specific, there are used polyethylene terephthalate, polycarbonate, polyvinyl chloride, polystyrene, polypropylene, polyimide, celluloses (for example, triacetyl cellulose) or those obtained by incorporating a pigment such as titanium oxide into those films, a film process synthetic paper made of polypropylene and others, a mixed paper made of a synthetic resin pulp such as polyethylene and a natural pulp, a Yankee paper, a baryta paper, a coated paper (particularly a cast coat paper), metal, cloths, and glasses.

They can be used either singly or in a form of a support laminated on one side or both sides thereof with a synthetic polymer such as polyethylene.

In addition thereto, the supports described at pages 29 to 31 of JP-A-62-253159 can be used as well.

A hydrophilic binder, semiconductive metal oxide such as alumina sol and tin oxide, and an anti-static agent such as carbon black and others may be coated on the surfaces of these supports.

A process by which an image is exposed and recorded on a light-sensitive material includes a process in which a scenery and a person are directly photographed, for example, with a camera, a process in which exposing is carried out through a reversal film and a negative film with a printer and an enlarger, a process in which an original picture is subjected to a scanning exposure through a slit with an exposing equipment of a copying machine, a process in which an image information is exposed by emitting a light emitting diode and various lasers via an electric signal, and a process in which an image information is output on an image display equipment such as CRT, a liquid crystal display, an electroluminescence display, and a plasma display to expose directly or through an optical system.

As described above, the light sources described in column 56 of U.S. Pat. No. 4,500,626, such as natural light, a tungsten lump, light emitting diode, a laser light source, and a CRT light source can be used as a light source for recording an image on a light-sensitive material.

Further, an image exposure can be carried out by using a wavelength conversion element obtained by combining a non-linear optical material and a coherent light source such as a laser ray. Herein, the nonlinear optical material means a material capable of a nonlinearity between a polarization generating when applying a strong photoelectric field such as a laser ray and an electric field, and preferably used are an inorganic compound represented by lithium niobate, potassium dihydrogenphosphate (KDP), lithium iodate, and $BaB_2O_4$, a urea derivative, a nitroaniline derivative, for example, a nitropyridine-N-oxide derivative such as 3-methyl-4-nitropyridine-N-oxide (POM), and the compounds described in JP-A-61-53462 and JP-A-62-210432. A single crystal optical waveguide type and a fiber type are known as the wavelength conversion element, and every one of them is useful.

There can be utilized as the image information described above, an image information obtained from a video camera and an electronic still camera, a TV signal represented by Nippon television signal standard (NTSC), an image signal obtained by dividing an original picture into a lot of picture elements such as scanner, and an image signal prepared with a computer, represented by CG and CAD.

The light-sensitive material and/or the dye fixing element may be of a form having a conductive exothermic body layer as a heating means for a heat development or a diffusion transfer of a dye. In this case, those described in JP-A-61-145544 can be utilized for a transparent or opaque exothermic element. These conductive layers can function also as an antistatic layer.

With respect to a heating temperature in a heat developing process, the development is possible at about 50° to about 250° C. In particular, about 80° to about 180° C. is useful. The diffusion transfer process of a dye may be carried out at the same time as a heat development or may be carried out after finishing the heat developable process. In the latter case, with respect to the heating temperature in the transfer process, the transfer is possible in a range of a temperature in the heat developable process to a room temperature. In particular, 50° C. or higher to a temperature about 10° C. lower than a temperature in the heat developing process is more preferred.

Transfer of a dye is caused only by heat but a solvent may be used in order to accelerate a dye transfer. Further, as described in detail in JP-A-59-218443 and JP-A-61-238056, a process in which heating is applied under the presence of a small amount of a solvent (particularly water) to carry out a development and a transfer at the same time or in succession is useful as well. In this process, the heating temperature is preferably 50° C. or higher and a boiling point of a solvent or lower. In the case where the solvent is, for example, water, it is preferably 50° C. or higher and 100° C. or lower.

Water or a base aqueous solution containing inorganic alkali metal salt and organic base (those described above in the item of an image-forming accelerator are used as these bases) can be enumerated as a solvent used for accelerating a development and/or transferring a diffusive dye to a dye-fixing layer. Further, there can be used as well a low boiling solvent or a mixed solution of a low boiling solvent and water or a base aqueous solution. A surface active agent, an anti-fogging agent, a scarcely soluble metal salt, and a complex-forming compound may be incorporated into the solvent.

These solvents can be used by a process in which they are incorporated into a dye fixing element, a light-sensitive material, or both of them. The use amount thereof may be as small amount as a weight or less of a solvent corresponding to a maximum swollen volume of the whole coated layer (in particular, an mount or less obtained by subtracting the weight of the whole coated layer from the weight of the solvent corresponding to the maximum swollen volume of the whole coated layer, or less).

The process for incorporating the solvent into a light-sensitive layer or a dye-fixing layer includes, for example, the process described in JP-A-61-147244, pp. 26. Further, the solvent can be used by incorporating in advance into a light-sensitive material or a dye fixing element or both of them in a form of a microcapsule in which the solvent is charged.

In order to accelerate the dye transfer, a process in which a hydrophilic heat solvent which is a solid matter at an ordinary temperature and is dissolved at a high temperature is allowed to be built in the light-sensitive material or the dye-fixing element can be applied as well. The hydrophilic heat solvent may be built in either of the light-sensitive material and the dye-fixing element or both of them. A layer which is built in may be any of an emulsion layer, an intermediate layer, a protective layer, and a dye-fixing layer. It is preferably built in the dye-fixing layer and/or a layer adjacent thereto.

The examples of the hydrophilic heat solvent include ureas, pyridines, amides, sulfonamides, imides, alcohols, oximes, and the other heterocycles.

In order to accelerate the dye transfer, a high boiling organic solvent may be incorporated into the light-sensitive material and/or the dye-fixing element.

A heating method in a developing and/or transfer process includes contacting to a heated block and plate, contacting to a hot plate, a hot presser, a hot roller, a halogen lump heater, and infrared and far infrared lump heaters, and passing through an environment of a high temperature.

The process described in JP-A-61-147244, pp. 27 can be applied for a pressure condition and a process for exerting a pressure in superposing the light-sensitive material and the dye-fixing element to tightly contact them.

Any of various heat developable equipments can be used for processing the photographic element of the present invention. There can preferably be used the equipments described in, for example, JP-A-59-75247, JP-A-59-177547, JP-A-59-181353, JP-A-60-18951, JP-A-U-62-25944 (the term "JP-A-U" as used herein means an unexamined published Japanese utility model application), JP-A-3-131856, and JP-A-3-131851.

EXAMPLES

The present invention is explained below with reference to the examples but the present invention is not limited thereto.

Example 1

A preparation process for a dispersion of zinc hydroxide is described below.

Zinc hydroxide 12.5 g with an average particle size of 0.2 μm, craboxymethyl cellulose 1 g as a dispersant, and poly-(sodium acrylate) 0.1 g were added to a 4% gelatin aqueous solution 100 ml and pulverized for 30 minutes with a mill using glass beads having an average particle size of 0.75 μm. The glass beads were separated to obtain the dispersion of zinc hydroxide.

Next, a preparing process for a dispersion of an electron transfer agent is described below.

The following electron transfer agent 10 g, polyethylene glycol nonylphenyl ether 0.5 g as a dispersant, and the following anionic surface active agent 0.5 g were added to a 5% gelatin aqueous solution and pulverized for 60 minutes with a mill using glass beads having an average particle size of 0.75 μm. The glass beads were separated to obtain the dispersion of the electron transfer agent having an average particle size of 0.35 μm.

Electron transfer agent

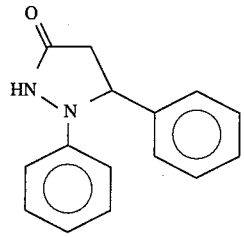

Anionic surface active agent

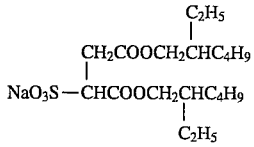

Next, a preparing process for a dispersion of a dye trapping agent is described.

A mixed solution of the following polymer latex (a solid content: 13%) 108 ml, the following surface active agent 20 g, and water 1232 ml was added to a 5% aqueous solution 600 ml of the following anionic surface active agent over a period of 10 minutes while stirring. The dispersion thus prepared was concentrated to 500 ml and desalted with a ultrafiltration module. Then, water 1500 ml was added and the same procedure was repeated once again, whereby the dispersion 500 g of the dye trapping agent was obtained.

Polymer latex

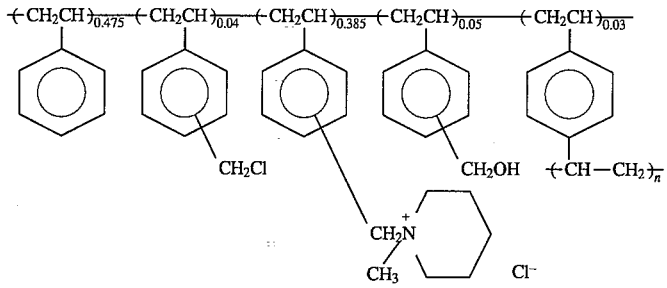

Surface active agent

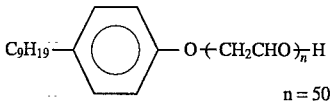

-continued

Anionic surface active agent

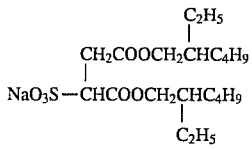

Next, a preparing process for a gelatin dispersion of a hydrophobic additive is described.

The gelatin dispersions of the cyan, magenta and yellow dye-providing materials and an electron-providing material were prepared, respectively, according to the procedures shown in Table 3. That is, each of the oil phase components was heated to about 60° C. and dissolved to prepare a uniform solution. This solution and an aqueous phase component heated to about 60° C. were added for stirring and mixing and then was dispersed with a homogenizer at 12000 rpm for 13 minutes. Water was added thereto and stirring was carried out to thereby obtain a uniform dispersion.

TABLE 3

| | Cyan | Magenta | Yellow | EPM* |
|---|---|---|---|---|
| Oil phase | | | | |
| Dye-providing material (A) | 9.05 g | — | — | — |
| Dye-providing material (B) | 6.19 g | — | — | — |
| Dye-providing material (C) | — | 15.5 g | — | — |
| Dye-providing material of the present invention or comparative dye-providing material (D) | — | | 11.3 g | — |
| Electron-providing material (1) | 4.84 g | 5.61 g | 4.53 g | — |
| Electron-providing material (2) | — | — | — | 13.87 g |
| Inhibitor-releasing redox compound (1) | — | — | — | 2.62 g |
| Electron transfer agent precursor | 1.42 g | 1.42 g | 0.86 g | — |
| Compound (1) | 0.40 g | 0.44 g | 0.40 g | — |
| Compound (2) | 1.53 g | 1.94 g | — | — |
| Compound (3) | 1.52 g | 1.94 g | — | — |
| High boiling solvent (1) | 1.91 g | 1.94 g | 5.20 g | — |
| High boiling solvent (2) | — | — | 3.90 ml | — |
| High boiling solvent (3) | 5.72 g | 5.81 g | — | 2.93 g |
| High boiling solvent (4) | — | — | — | 2.94 g |
| Surface active agent (2) | 1.55 g | 0.52 g | 1.50 g | 0.45 g |
| Ethyl acetate | 34.5 ml | 34.5 ml | 25.0 ml | 18.0 ml |
| Methyl ethyl ketone | 47.5 ml | 47.5 ml | — | — |
| Aqueous phase | | | | |
| Lime-treated gelatin | 10.0 g | 10.0 g | 10.0 g | 10.0 g |
| Citric acid | — | — | 0.14 g | 0.14 g |
| Sodium bisulfite | — | — | — | 0.15 g |
| Water | 150 ml | 150 ml | 120 ml | 97 ml |
| Water | 150 ml | 160 ml | 115 ml | 61 ml |

*Electron-providing material

Dye-providing compound (A)

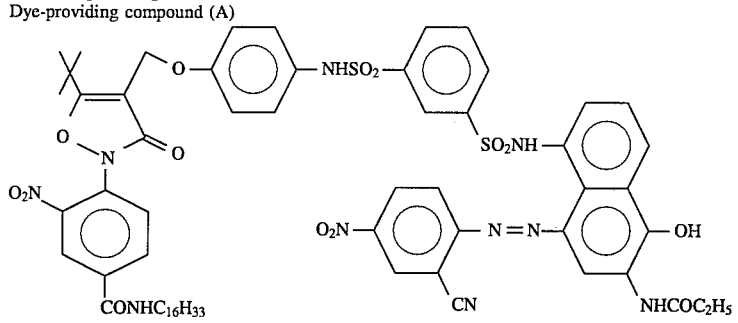

TABLE 3-continued
Dye-providing compound (B)
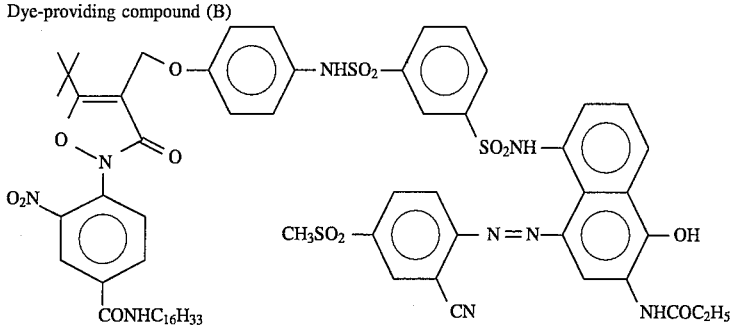
Dye-providing compound (C)
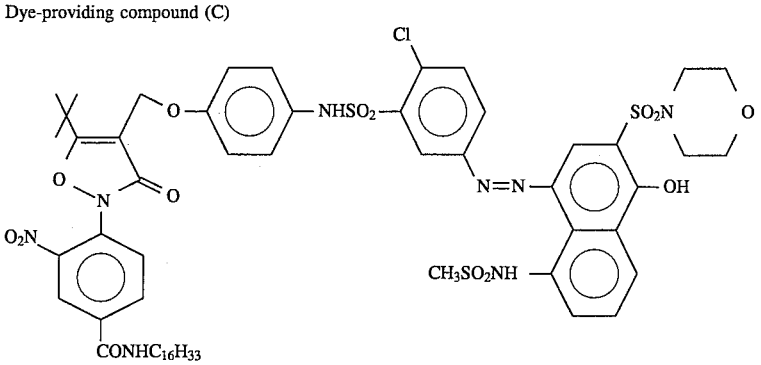
Dye-providing compound (D)
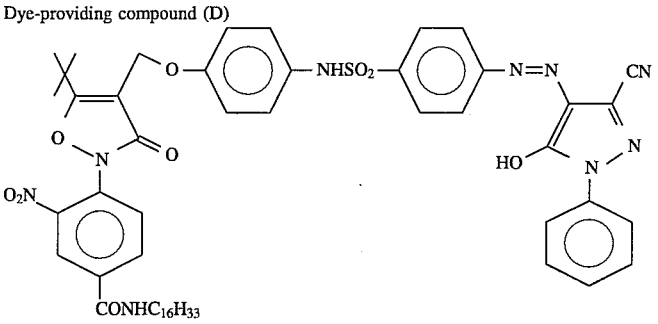
Electron-providing material (1)
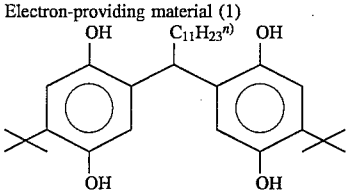
Electron-providing material (2)
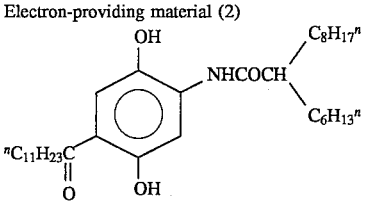

TABLE 3-continued
Inhibitor-releasing redox compound
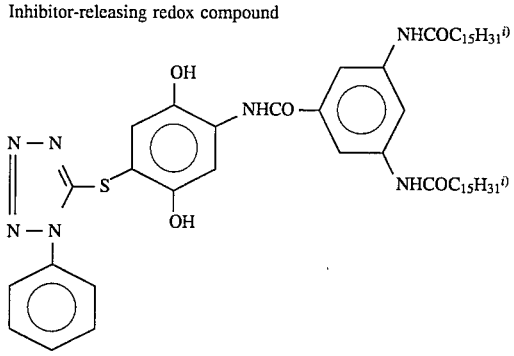
Electron transfer agent precursor
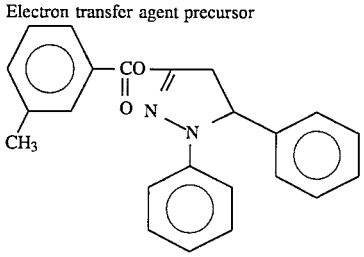
Compound (1)
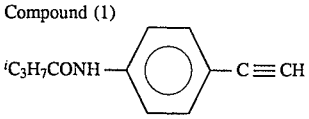
Compound (2)
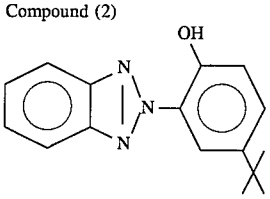
Compound (3)
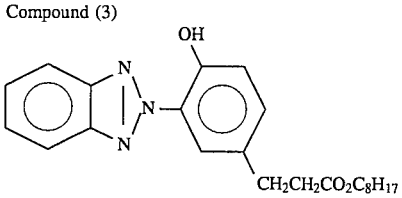
High boiling solvent (1)
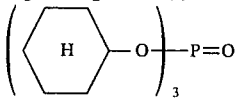
High boiling solvent (2)
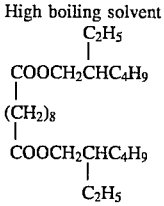

TABLE 3-continued

High boiling solvent (3)

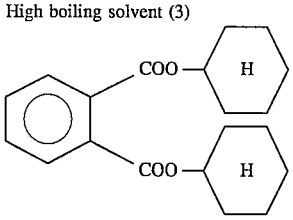

High boiling solvent (4)

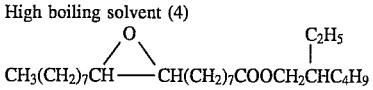

Surface active agent (2)

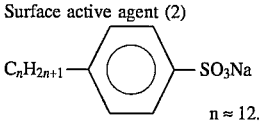

Next, a preparing process for a light-sensitive silver halide emulsion is described.

Light-sensitive silver halide emulsion (1) (for a red-sensitive emulsion layer)

Solution (I) and solution (II) each shown in Table 4 were simultaneously added to a gelatin aqueous solution. (prepared by adding gelatin 20 g, potassium bromide 0.5 g, sodium chloride 3 g, and the following chemical (A) 30 mg to water 500 ml and maintained at a temperature of 45° C.) in the same flow rate over a period of 20 minutes while vigorously stirring. Further, six minutes later, solution (III) and solution (IV) each shown in Table 4 were simultaneously added in the same flow rate over a period of 25 minutes. Ten minutes after the addition of solution (III) and solution (IV) was started, an aqueous solution of a gelatin dispersion of a dye (containing gelatin 1 g, the following dye (a) 70 mg, the following dye (b) 139 mg, and the following dye (c) 5 mg in water 105 ml and maintained at a temperature of 45° C.) was added over a period of 20 minutes.

After the emulsion was subjected to washing and desalting by an ordinary process, lime-treated osein gelatin 22 g was added and pH and pAg were adjusted to 6.2 and 7.8, respectively, followed by adding 4-hydroxy-6-methyl-1,3, 3a,7-tetrazaindene and then sodium thiosulfate and chlorauric acid to provide an optimum chemical sensitization at 60° C. Subsequently, the following anti-fogging agent (2) was added and then the emulsion was cooled down, whereby a monodispersed cubic silver chlorobromide emulsion 635 g having an average grain size of 0.30 μm was obtained.

Chemical (A)

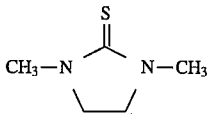

TABLE 4

| | Solution | | | |
|---|---|---|---|---|
| | (I) | (II) | (III) | (IV) |
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| Water to make | 250 ml | 250 ml | 200 ml | 200 ml |

TABLE 4-continued

| | Solution | | | |
|---|---|---|---|---|
| | (I) | (II) | (III) | (IV) |
| Dye (a) | 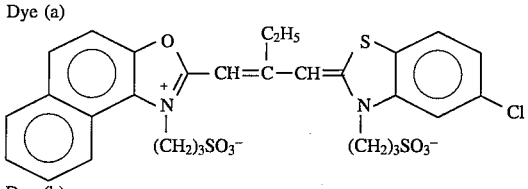 | | | |
| Dye (b) | 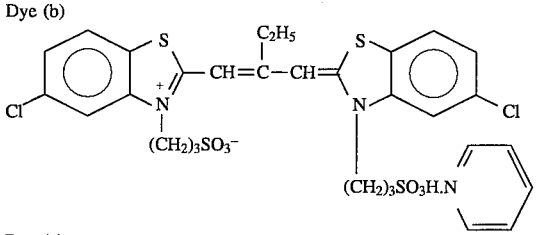 | | | |
| Dye (c) | 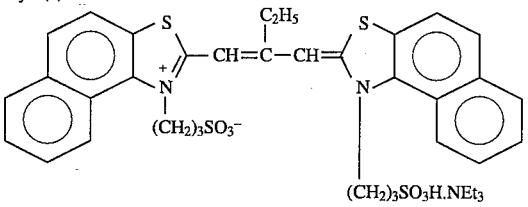 | | | |

Light-sensitive silver halide emulsion (2) (for a red-sensitive emulsion layer)

Solution (I) and solution (II) each shown in Table 5 were simultaneously added to a gelatin aqueous solution (preparred by adding gelatin 20 g, potassium bromide 0.5 g, sodium chloride 6 g, and the above chemical (A) 30 mg to water 800 ml and maintained at a temperature of 65° C.) in the same flow rate over a period of 30 minutes while vigorously stirring. Further, five minutes later, solution (III) and solution (IV) each shown in Table 5 were simultaneously added in the same flow rate over a period of 15 minutes. Two minutes after the addition of solution (III) and solution (IV) was started, an aqueous solution of a gelatin dispersion of a dye (containing gelatin 1.1 g, the above dye (a) 76 mg, the above dye (b) 150 mg, and the above dye (c)

5 mg in water 95 ml and maintained at a temperature of 50° C.) was added over a period of 18 minutes.

After the emulsion was subjected to washing and desalting by an ordinary process, lime-treated osein gelatin 22 g was added and pH and pAg were adjusted to 6.2 and 7.8, respectively, followed by adding 4-hydroxy-6-methyl-1,3, 3a,7-tetrazaindene and then sodium thiosulfate and chlorauric acid to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.30 μm was obtained.

TABLE 5

| | Solution | | | |
|---|---|---|---|---|
| | (I) | (II) | (III) | (IV) |
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| Water to make | 200 ml | 140 ml | 145 ml | 155 ml |

Light-sensitive silver halide emulsion (3) (for a green-sensitive emulsion layer)

Solution (I) and solution (II) each shown in Table 6 were simultaneously added to a gelatin aqueous solution (prepared by adding gelatin 20 g, potassium bromide 0.5 g, sodium chloride 4 g, and the above chemical (A) 15 mg in water 690 ml and maintained at a temperature of 47° C.) in the same flow rate over a period of 8 minutes while vigorously stirring. Further, ten minutes later, solution (III) and solution (IV) each shown in Table 6 were simultaneously added in the same flow rate over a period of 32 minutes. One minute after the addition of solution (III) and solution (IV) was finished, an aqueous solution of a gelatin dispersion of a dye (conatining gelatin 3.0 g and the following dye (d) 250 mg in water 100 ml and maintained at a temperature of 45° C.) was added in one lump.

After the emulsion was subjected to washing and desalting by an ordinary process, lime-treated osein gelakin 22 g was added and pH and pAg were adjusted to 6.0 and 7.6, respectively, followed by adding 4-hydroxy-6-methyl-1,3, 3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.27 μm was obtained.

TABLE 6

| | Solution | | | |
|---|---|---|---|---|
| | (I) | (II) | (III) | (IV) |
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.51 g |
| Water to make | 110 ml | 110 ml | 245 ml | 245 ml |

Dye (d)

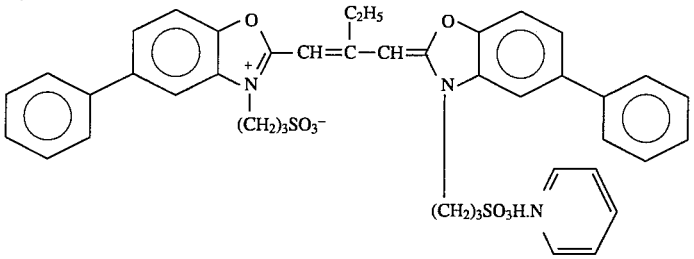

Light-sensitive silver halide emulsion (4) (for a green-sensitive emulsion layer)

Solution (I) and solution (II) each shown in Table 7 were simultaneously added to a gelatin aqueous solution (prepared by adding gelatin 20 g, potassium bromide 0.3 g, sodium chloride 6 g, and the above chemical (A) 15 mg in water 700 ml and maintained at a temperature of 60° C.) in the same flow rate over a period of 20 minutes while vigorously stirring. Further, ten minutes later, solution (III) and solution (IV) each shown in Table 7 were simultaneously added in the same flow rate over a period of 20 minutes. One minute after the addition of solution (III) and solution (IV) was finished, an aqueous solution of a gelatin dispersion of a dye (containing gelatin 1.8 g and the above dye (d) 180 mg in water 75 ml and maintained at a temperature of 45° C.) was added in one lump.

After the emulsion was subjected to washing and desalting by an ordinary process, lime-treated osein gelatin 22 g was added and pH and pAg were adjusted to 6.0 and 7.7, respectively, followed by adding 4-hydroxy-6-methyl-1,3, 3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.30 μm was obtained.

TABLE 7

| | Solution | | | |
|---|---|---|---|---|
| | (I) | (II) | (III) | (IV) |
| $AgNO_3$ | 20.0 g | — | 80.0 g | — |
| $NH_4NO_3$ | 0.19 g | — | 0.38 g | — |
| KBr | — | 9.8 g | — | 44.8 g |
| NaCl | — | 2.06 g | — | 5.51 g |
| Water to make | 165 ml | 165 ml | 205 ml | 205 ml |

Light-sensitive silver halide emulsion (5) (for a blue-sensitive emulsion layer)

Solution (I) and solution (II) each shown in Table 8 were simultaneously added to a gelatin aqueous solution (prepared by adding gelatin 20 g, potassium bromide 0.5 g, sodium chloride 5 g, and the above chemical (A) 15 mg to water 690 ml and maintained at a temperature of 51° C.) in the same flow rate over a period of 8 minutes while vigorously stirring. Further, ten minutes later, solution (III) and solution (IV) each shown in Table 8 were simultaneously added in the same flow rate over a period of 32 minutes. One minute after the addition of solution (III) and solution (IV) was finished, an aqueous solution of a gelatin dispersion of a dye (cntaining the following dye (e) 235 mg and the following dye (f) 120 mg in water 95 ml and methanol 5 ml and maintained at a temperature of 45° C.) was added in one lump.

After the emulsion was subjected to washing and desalting by an ordinary method, lime-treated osein gelatin 22 g was added and pH and pAg were adjusted to 6.0 and 7.7, respectively, followed by adding 4-hydroxy-6-methyl-1,3, 3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.30 μm was obtained.

TABLE 8

| | Solution | | | |
|---|---|---|---|---|
| | (I) | (II) | (III) | (IV) |
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.60 g | — | 5.52 g |
| Water was added to | 110 ml | 110 ml | 240 ml | 240 ml |

Dye (e)

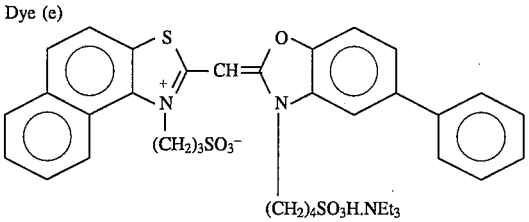

TABLE 8-continued

| | Solution | | | |
|---|---|---|---|---|
| | (I) | (II) | (III) | (IV) |

Dye (f)

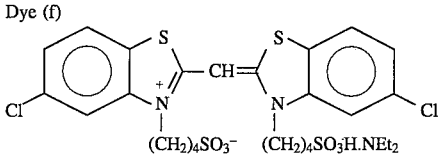

Light-sensitive silver halide emulsion (6) (for a blue-sensitive emulsion layer)

Solution (I) and a solution (II) each shown in Table 9 were simultaneously added to a gelatin aqueous solution (prepared by adding gelatin 20 g, potassium bromide 0.3 g, sodium chloride 9 g, and the above chemical (A) 15 mg to water 695 ml and maintained at a temperature of 63° C.) in the same flow rate over a period of 10 minutes while vigorously stirring. Further, ten minutes later, solution (III) and solution (IV) each shown in Table 9 were simultaneously added in the same flow rate over a period of 30 minutes. One minute after the addition of solution (III) and solution (IV) was finished, an aqueous solution of a dye (containing the above dye (e) 155 mg and the above dye (f) 78 mg in water 66 ml and methanol 4 ml and maintained at a temperature of 60° C.) was added in one lump.

After the emulsion was subjected to washing and desalting by an ordinary process, lime-treated osein gelatin 22 g was added and pH and pAg were adjusted to 6.0 and 7.7, respectively, followed by adding 4-hydroxy-6-methyl-1,3, 3a,7-tetrazaindene and then sodium thiosulfate to provide an optimum chemical sensitization at 68° C. Subsequently, the following anti-fogging agent (1) was added and then the emulsion was cooled down, whereby a monodispersed cubic silver chlorobromide emulsion 635 g having an average grain size of 0.52 μm was obtained.

TABLE 9

| | Solution | | | |
|---|---|---|---|---|
| | (I) | (II) | (III) | (IV) |
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.58 g | — | 5.18 g |
| Water was added to | 120 ml | 120 ml | 225 ml | 225 ml |

The above materials were used to prepare the light-sensitive material 101 shown in Table 10.

TABLE 10

Constitution of light-sensitive material 101

| Layer No. | Layer name | Additive | Coated amount ($mg/m^2$) |
|---|---|---|---|
| 7th layer | Protective layer II | Acid-treated gelatin | 340 |
| | | PMMA latex (size: 3μ) | 20 |
| | | Colloidal silver | 0.7 |
| | | Surface active agent (3) | 8 |
| 6th layer | Protective layer I | Lime-treated gelatin | 410 |
| | | Zinc hydroxide | 440 |
| | | Electron-providing material (2) | 75 |
| | | Inhibitor-releasing redox compound (1) | 14 |
| | | High boiling solvent (3) | 16 |
| | | High boiling solvent (4) | 16 |
| | | Surface active agent (3) | 4 |
| | | Dextran | 16 |
| | | Water soluble polymer (1) | 1.4 |
| | | Polymer latex (1) | 66 |
| | | Surface active agent (4) | 28 |
| | | Surface active agent (2) | 4.5 |
| 5th layer | Blue-sensitive emulsion layer | Light-sensitive silver halide emulsion (5) | 315 as Ag |
| | | Light-sensitive silver halide emulsion (6) | 95 as Ag |
| | | Dye-providing material (4) | 380 |
| | | Gelatin | 520 |
| | | Electron-providing material (1) | 132 |
| | | Electron transfer agent precursor | 25 |
| | | Compound (1) | 11.7 |
| | | High boiling solvent (1) | 152 |
| | | High boiling solvent (2) | 114 |
| | | Surface active agent (2) | 44 |
| | | Anti-fogging agent (1) | 0.9 |
| | | Water soluble polymer (1) | 11 |
| 4th layer | Intermediate layer | Lime-treated gelatin | 550 |
| | | Electron-providing material (2) | 159 |
| | | Inhibitor-releasing redox compound (1) | 30 |
| | | High boiling solvent (3) | 34 |
| | | High boiling solvent (4) | 34 |
| | | Surface active agent (2) | 5.1 |
| | | Polymer latex (1) | 88 |
| | | Electron transfer agent | 78 |
| | | Dextran | 38 |
| | | Hardener (1) | 36 |
| | | Surface active agent (4) | 26 |
| | | Water soluble polymer (1) | 10 |
| 3rd layer | Green-sensitive emulsion layer | Light-sensitive silver halide emulsion (3) | 250 as Ag |
| | | Light-sensitive silver halide emulsion (4) | 100 as Ag |
| | | Dye-providing material (3) | 359 |
| | | Lime-treated gelatin | 430 |
| | | Electron-providing material (1) | 130 |
| | | Electron transfer agent precursor | 33 |
| | | Compound (1) | 10 |
| | | Compound (2) | 45 |
| | | Compound (3) | 45 |
| | | High boiling solvent (1) | 45 |
| | | High boiling solvent (3) | 135 |
| | | Anti-fogging agent (1) | 0.8 |
| | | Water soluble polymer (1) | 13 |
| | | Surface active agent (2) | 8 |
| 2nd layer | Intermediate layer | Lime-treated gelatin | 760 |
| | | Zinc hydroxide | 812 |
| | | Electron-providing material (2) | 139 |
| | | Inhibitor-releasing redox compound (1) | 26 |
| | | High boiling solvent (3) | 29 |
| | | High boiling solvent (4) | 29 |
| | | Surface active agent (2) | 4.5 |
| | | Surface active agent (3) | 5 |
| | | Dextran | 29 |
| | | Water soluble polymer (1) | 3.0 |
| | | Polymer latex (1) | 132 |
| | | Surface active agent (4) | 54 |
| 1st layer | Red-sensitive emulsion layer | Light-sensitive silver halide emulsion (1) | 108 as Ag |
| | | Light-sensitive silver halide emulsion (2) | 60 as Ag |

TABLE 10-continued

| Constitution of light-sensitive material 101 | | |
|---|---|---|
| | Dye-providing material (1) | 185 |
| | Dye-providing material (2) | 127 |
| | Lime-treated gelatin | 580 |
| | Electron-providing material (1) | 100 |
| | Electron transfer agent precursor | 29 |
| | Compound (1) | 8.2 |
| | Compound (2) | 31 |
| | Compound (3) | 31 |
| | High boiling solvent (1) | 39 |
| | High boiling solvent (3) | 117 |
| | Surface active agent (3) | 21 |
| | Anti-fogging agent (1) | 0.2 |
| | Anti-fogging agent (2) | 0.3 |
| | Water soluble polymer (1) | 7 |
| | Surface active agent (2) | 21 |
| Support (1) | Paper support laminated with polyethylene (thickness: 131 μm) | |

Support (1)

| Layer name | Composition | Layer thickness |
|---|---|---|
| Surface subbing layer | Gelatin | 0.1 μm |
| Surface PE layer (glossy) | Low density polyethylene (density 0.923): 89.2 parts, Surface-treated titanium oxide: 10.0 parts, | 36.0 μm |
| Pulp layer | Wood free paper (LBKP/NBKP = 1/1, density: 1.080) | 64.0 μm |
| Back face PE layer (mat) | High density polyethylene (density: 0.960) | 31.0 μm |
| Back face subbing layer | Gelatin | 0.05 μm |
| | Colloidal silica | 0.05 μm |
| | | 131.2 μm |

Surface active agent (3)

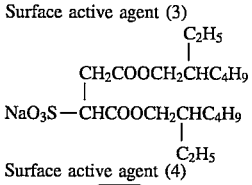

Surface active agent (4)

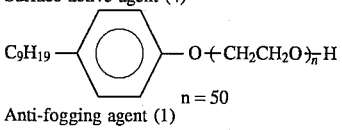

Anti-fogging agent (1)

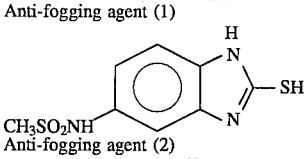

Anti-fogging agent (2)

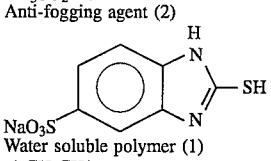

Water soluble polymer (1)

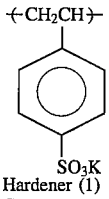

Hardener (1)

$CH_2=CHSO_2CH_2SO_2CH=CH_2$

Polymer latex (1)

TABLE 10-continued

Constitution of light-sensitive material 101

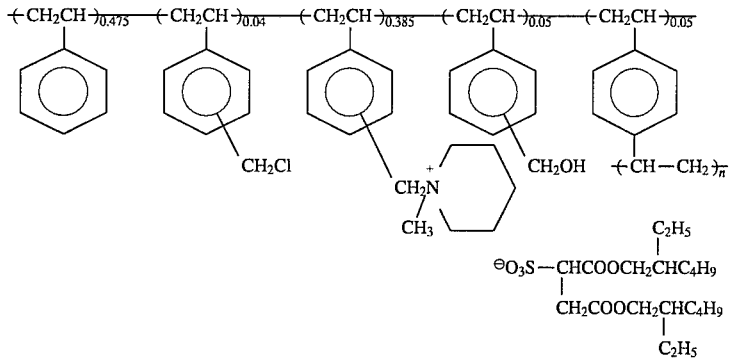

The light-sensitive materials 102 to 110 were prepared in the same manner as that in the light-sensitive material 101, except that the dye-providing compound contained in the blue-sensitive layer and the binder amount were changed as shown in Table 11.

TABLE 11

| Light-sensitive material | Dye-providing compound and use amount in blue-sensitive layer (mg/m²) | Use amount of electron-providing compound in blue-sensitive layer (mg/m²) | Gelatin amount in light-sensitive layer (mg/m²) | Gelatin amount in non-light-sensitive layer (mg/m²) | Whole binder amount* (mg/m²) |
|---|---|---|---|---|---|
| 101 (Inv.) | Compound (1)** 330 | 100 | BS layer 580<br>GS layer 530<br>RS layer 520 | 2nd layer 330<br>4th layer 340<br>6th layer 180<br>7th layer 340 | 3718.4 |
| 102 (Inv.) | Compound (2)** 337 | 100 | 580<br>530<br>520 | 330<br>340<br>180<br>340 | 3718.4 |
| 103 (Inv.) | Compound (3)** 347 | 100 | 580<br>530<br>520 | 330<br>340<br>180<br>340 | 3718.4 |
| 104 (Inv.) | Compound (7)** 319 | 100 | 580<br>530<br>520 | 330<br>340<br>180<br>340 | 3718.4 |
| 105 (Inv.) | Compound (9)** 350 | 100 | 580<br>530<br>520 | 330<br>340<br>180 | 3718.4 |
| 106 (Inv.) | Compound (13)** 259 | 50 | 580<br>530<br>520 | 330<br>340<br>180<br>340 | 3718.4 |
| 107 (Inv.) | Compound (15)** 230 | 50 | 580<br>530<br>520 | 330<br>340<br>180<br>340 | 3718.4 |
| 108 (Comp.) | Compound (D)** 380 | 132 | 580<br>530<br>520 | 330<br>340<br>180<br>340 | 3718.4 |
| 109 (Comp.) | Compound (1)** 330 | 100 | 1160<br>1060<br>1040 | 330<br>340<br>180<br>340 | 5348.4 |
| 110 (Comp.) | Compound (1)** 330 | 100 | 580<br>530<br>520 | 990<br>1020<br>540<br>1020 | 6098.4 |

*including dextran and the water soluble binder (1)
**of the present invention
BS: blue-sensitive, GS: green-sensitive, RS: red-sensitive Next, a preparing process of an image-receiving material is described.

Image-receiving material R101 having the structure shown in Table 12 was prepared.

TABLE 12

Constitution of receiving material R101

| Layer No. | Additive | Coated amount ($mg/m^2$) |
|---|---|---|
| 4th layer | Water soluble polymer (3) | 240 |
| | Water soluble polymer (4) | 60 |
| | Potassium nitrate | 50 |
| | Surface active agent (3) | 7 |
| | Surface active agent (6) | 5 |
| 3rd layer | Gelatin | 250 |
| | Water soluble olymer (3) | 10 |
| | Surface active agent (7) | 27 |
| | Hardener (2) | 170 |
| 2nd layer | Gelatin | 800 |
| | Water soluble polymer (3) | 100 |
| | Water soluble polymer (5) | 660 |
| | Polymer dispersion | 1190 |
| | High boiling solvent (5) | 650 |
| | Fluorescent whitening agent | 22 |
| | Mordant | 2350 |
| | Surface active agent (3) | 10 |
| | Guanidine picolinate | 2900 |
| | Mordant | 2350 |
| | Anti-stain agent | 32 |
| 1st layer | Gelatin | 150 |
| | Water soluble polymer (3) | 40 |
| | Surface active agent (3) | 6 |
| | Surface active agent (7) | 27 |
| | Hardener (2) | 170 |
| Support (2) | Paper support laminated with polyethylene (thickness: 206 μm) | |

Support (2)

| Layer name | Composition | Layer thickness (μm) |
|---|---|---|
| Surface subbing layer | Gelatin | 0.1 |
| Surface PE layer (glossy) | Low density polyethylene (density 0.923): 89.2 parts Surface-treated titanium oxide: 10.0 parts, Ultramarine: 0.8 parts | 35.0 |
| Pulp layer | Wood free papaer (LBKP/NBKP = 1/1, density 1,080) | 140.8 |
| Back face PE layer (mat) | High density polyethylene (density: 0.960) | 30.0 |
| Back face subbing layer | Gelatin | 0.05 |
| | Colloidal silica | 0.05 |
| | | 206.0 |

Surface active agent (6)

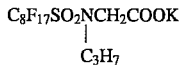

Surface active agent (7)

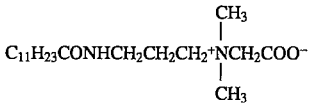

-continued

High boiling solvent (5)

$C_{26}H_{46}Cl_{7.1}$

Enpara 40 (manufactured by Ajinomoto Co., Ltd.)

Fluorescent whitening agent

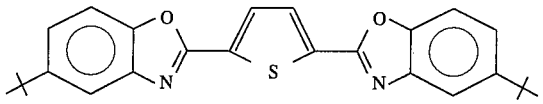

Anti-stain agent

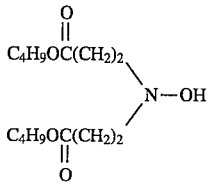

Mordant

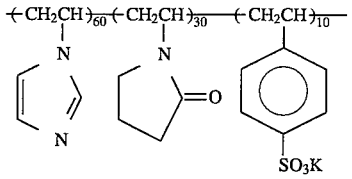

Hardener (2)

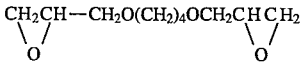

The above light-sensitive materials 101 to 110 and the image-receiving material R101 were used to carry out a processing with the image recording equipment described in JP-A-63-137104.

That is, a Fuji CC filter manufactured by Fuji Photo Film Co., Ltd. was used to make adjustment so that a gray density of 0.7 was met, and the light-sensitive material was subjected to a scanning exposure via an original picture (a test chart on which the wedges of Y, M, Cy and grey having the continuously changed densities are recorded) through a slit. After the light-sensitive material thus exposed was dipped in water maintained at 40° C. for 4 seconds, it was squeezed with rollers and immediately superposed on the image-receiving material so that the film faces thereof were contacted. Then, heating was applied for 17 seconds with a heat drum which was adjusted to such a temperature that a temperature of the film faces absorbing water became 80° C., and the light-sensitive material was peeled off from the image-receiving material, whereby a sharp color image corresponding to the original picture was obtained on the image-receiving material.

The above procedure was repeated except that in the image forming process described above, a temperature was adjusted so that the temperature of the film face became 70° C., to thereby obtain a color image in the case where a developing condition is forcibly changed, and then a yellow density at the same position as where the gray density of 0.7 was obtained at 80° C., that is, the yellow densities obtained with the same exposure were compared (the difference between the respective yellow densities is designated as ΔD).

Further, a color image was formed with the above image recording equipment so that the image of fine lines of 8 lines/mm was obtained. It was left at the conditions of 60° C. and 70% RH for 72 hours, and then the degree of unsharpness was visually evaluated. The results are shown in Table 13.

TABLE 13

| Light-sensitive material | ΔD | Degree of unsharpness |
|---|---|---|
| 101 | 0.06 | o |
| 102 | 0.05 | o |
| 103 | 0.06 | o |
| 104 | 0.06 | o |
| 105 | 0.07 | o |
| 106 | 0.06 | o |
| 107 | 0.06 | o |
| 108 | 0.07 | Δ |
| 109 | 0.20 | o |
| 110 | 0.26 | o |

As shown above, it can be seen that the light-sensitive materials of the present invention are less susceptible to an influence by a change in the developing conditions. Further, the image obtained had less unsharpness, that is, had less lowered sharpness. The light fastness also was high as described in JP-A-61-261738.

Example 2

A preparation process of emulsion (7) for the fifth layer is described below.

Solution (I) and solution (II) each having a composition shown in Table 15 were added to an aqueous solution having the composition shown in Table 14 over a period of 10 minutes while vigorously stirring, and then solution (III) and solution (IV) each having a composition shown in Table 15 were added over a period of 25 minutes.

TABLE 14

| Composition | |
|---|---|
| $H_2O$ | 780 ml |
| Gelatin | 20 g |
| KBr | 0.3 g |
| NaCl | 2.4 g |
| Chemical (A) | 0.030 g |
| $H_2SO_4$ (1N) | 16 ml |
| Temperature | 45° C. |

TABLE 15

| | I | II | III | IV |
|---|---|---|---|---|
| $K_2IrCl_6$ (IV) (g) | 30 | — | — | $3.9 \times 10^{-5}$ |
| $AgNO_3$ (g) | — | — | 70 | — |
| KBr (g) | — | 13.7 | — | 44.5 |
| NaCl (g) | — | 3.6 | — | 1.7 |
| Water to make (ml) | 230 | 180 | 260 | 250 |

Chemical (A) shown in Table 12 was the same as that used in Example 1.

A 1% solution 50 ml (mixed solvent of methanol:water=1:1) of dye (g) was added immediately before a chemical sensitization.

After washing with water and desalting (carried out at pH 4.1 using settling agent a), gelatin 22 g was added and pH and pAg were adjusted to 6.0 and 7.9, respectively. Then, a chemical sensitization was carried out at 60° C. The compounds used for the chemical sensitization are shown in Table 16.

The yield of the emulsion obtained was 630 g. The emulsion was a monodispersed cubic emulsion having a fluctuation coefficient of 10.3% and an average grain size of 0.21 μm.

TABLE 16

| Chemical sensitization | |
|---|---|
| Temperature | 60° C. |
| 4-Hydroxy-6-methyl-1,3,3a,7-tetrazaindene | 0.34 g |
| Sodium thiosulfate | 6.0 mg |
| Compound (a) | 0.10 g |
| Compound (b) | 68 mg |
| Compound (c) | 3.78 g |

Dye (g)

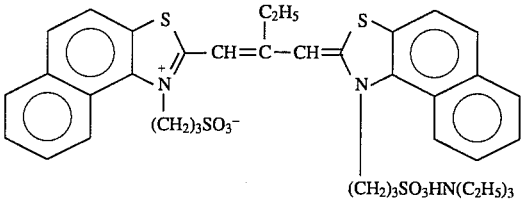

a. Settling agent

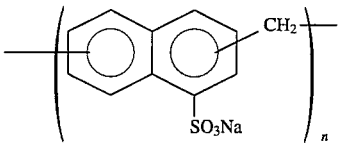

b. Settling agent

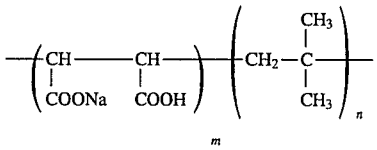

Compound (a)

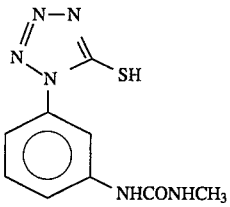

TABLE 16-continued

| Chemical sensitization |
|---|
| Compound (b) |
| 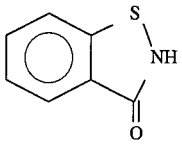 |
| Compound (c) |
| 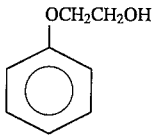 |

A preparation process of emulsion (8) for the third layer is described below.

Solution (I) and solution (II) each having a composition shown in Table 16 were added to an aqueous solution having a composition shown in Table 17 over a period of 18 minutes while vigorously stirring, and then solution (III) and solution (IV) each having a composition shown in Table 18 were added over a period of 24 minutes.

TABLE 17

| Composition | |
|---|---|
| $H_2O$ | 780 ml |
| Gelatin | 20 g |
| KBr | 0.3 g |
| NaCl | 2.5 g |
| Chemical (A) | 0.03 g |
| $H_2SO_4$ (1N) | 16 ml |
| Temperature | 45° C. |

TABLE 18

| | I | II | III | IV |
|---|---|---|---|---|
| $K_2IrCl_6$ (IV) (g) | — | — | — | $2 \times 10^{-5}$ |
| $K_4[Fe(CN)_6].3H_2O$ (g) | — | — | — | 0.033 |
| $AgNO_3$ (g) | 30 | — | 70 | — |
| KBr (g) | — | 13.6 | — | 44 |
| NaCl (g) | — | 3.6 | — | 2.4 |
| Water added to (ml) | 230 | 230 | 375 | 365 |

After washing with water and desalting (carried out at pH 3.9 using settling agent b), gelatin 22 g was added and pH and pAg were adjusted to 5.9 and 7.8, respectively. Then, a chemical sensitization was carried out at 70° C. A 1% methanol solution 6.7 ml of the dye (h) described later was added in the course of the chemical sensitization. The compounds used for the chemical sensitization are as shown in Table 19.

TABLE 19

| Chemical sensitization | |
|---|---|
| Temperature | 70° C. |
| 4-Hydroxy-6-methyl-1,3, 3a,7-tetrazaindene | 0.78 g |
| Triethylthiourea | 3.3 mg |
| KI | 0.12 g |
| Compound (d) | 78 mg |
| Compound (b) | 68 mg |
| Compound (c) | 3.0 g |

TABLE 19-continued

| Chemical sensitization |
|---|
| Compound (d) |
| 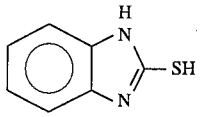 |
| Dye (h) |
| 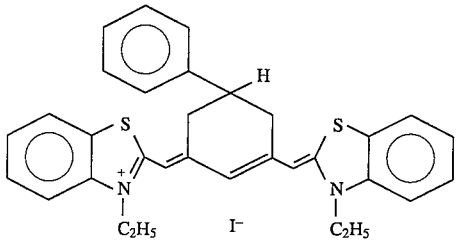 |

The yield of the emulsion obtained was 645 g. The emulsion was a monodispersed cubic emulsion having a fluctuation coefficient of 9.7% and an average grain size of 0.24 μm.

A preparation process of emulsion (9) for the first layer is described below.

Solution (I) and solution (II) each having a composition shown in Table 21 were added to an aqueous solution having a composition shown in Table 20 over a period of 18 minutes while vigorously stirring, and then solution (III) and solution (IV) each having a composition shown in Table 21 were added over a period of 25 minutes.

TABLE 20

| Composition | |
|---|---|
| $H_2O$ | 780 ml |
| Gelatin | 20 g |
| KBr | 0.3 g |
| NaCl | 2.5 g |
| Chemical (A) | 0.03 g |
| $H_2SO_4$ (1N) | 16 cc |
| Temperature | 50° C. |

TABLE 21

| | I | II | III | IV |
|---|---|---|---|---|
| $K_2IrCl_6$ (IV) (g) | — | — | — | $3.9 \times 10^{-5}$ |
| $NaNO_3$ (g) | 30 | — | 70 | — |
| KBr (g) | — | 13.8 | — | 44.1 |
| NaCl (g) | — | 3.6 | — | 2.4 |
| Water added to (ml) | 230 | 225 | 375 | 365 |

After washing with water and desalting (carried out at pH 4.1 using the settling agent a), gelatin 22 g was added and pH and pAg were adjusted to 7.4 and 7.6, respectively. Then, a chemical sensitization was carried out at 60° C. A 0.2% methanol solution (p-toluenesulfonic acid 0.1N) 7.5 ml of dye (i) was added in the course of the chemical sensitization. The compounds used for the chemical sensitization are shown in Table 22.

The yield of the emulsion obtained was 650 g. The emulsion was a monodispersed cubic emulsion having a fluctuation coefficient of 12.6% and an average grain size of 0.25 μm.

TABLE 22

| Chemical sensitization | |
|---|---|
| Temperature | 60° C. |
| 4-Hydroxy-6-methyl-1,3, 3a,7-tetrazaindene | 0.36 g |
| Triethylthiourea | 3.0 mg |
| Compound (d) | 0.18 g |
| Compound (b) | 68 mg |
| Compound (c) | 3.0 g |

Dye (i)

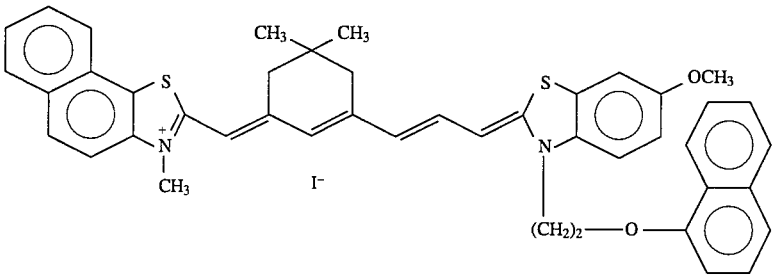

A zinc hydroxide dispersion was prepared in the same manner as that in Example 1.

Next, a gelatin dispersion of the dye-providing compound is described below.

A uniform solution having a composition shown in Table 23 and an even solution having a composition shown in Table 24 were prepared and stirred for mixing. Then, the mixed solution was dispersed with a homogenizer at 10000 rpm for 10 minutes. This dispersion is called a dispersion of a magenta dye-providing material.

TABLE 23

| Compound | Composition |
|---|---|
| Magenta dye-providing compound (E) | 14.64 g |
| High boiling solvent (1) | 7.32 g |
| Electron-providing material (3) | 0.20 g |
| Anti-fogging agent (3) | 0.02 g |
| Ethyl acetate | 30.00 g |
| $H_2O$ | 174.00 g |
| Total | 236.18 g |

TABLE 24

| Compound | Composition |
|---|---|
| 16% aqueous solution of lime-treated gelatin | 62.50 g |
| Surface active agent (2) | 7.50 g |
| $H_2O$ | 90.00 g |
| Total | 160.00 g |

A uniform solution having a composition shown in Table 25 and a uniform solution having a composition shown in Table 26 were prepared and stirred for mixing. Then, the mixed solution was dispersed with a homogenizer at 10000 rpm for 10 minutes. This dispersion is called a dispersion of a cyan dye-providing material.

TABLE 25

| Compound | Composition |
|---|---|
| Cyan dye-providing compound (F) | 7.25 g |
| Cyan dye-providing compound (G) | 10.63 g |
| High boiling solvent (5) | 9.83 g |
| Electron-providing material (3) | 1.00 g |
| Anti-fogging agent (3) | 0.03 g |
| Ethyl acetate | 50.00 g |
| $H_2O$ | 178.80 g |
| Total | 257.54 g |

TABLE 26

| Compound | Composition |
|---|---|
| 16% aqueous solution of lime-treated gelatin | 62.50 g |
| Surface active agent (2) | 7.50 g |
| $H_2O$ | 90.00 g |
| Total | 160.00 g |

A uniform solution having a composition shown in Table 27 and a uniform solution having a composition shown in Table 28 were prepared and stirred for mixing. Then, the mixed solution was dispersed with a homogenizer at 10000 rpm for 10 minutes. This dispersion is called a dispersion of a yellow dye-providing material.

TABLE 27

| Compound | Composition |
|---|---|
| Compound (16) in the specification | 15.21 g |
| Filter dye (F) | 1.90 g |
| High boiling solvent (5) | 8.63 g |
| Electron-providing material (3) | 1.20 g |
| Anti-fogging agent (3) | 0.02 g |
| Ethyl acetate | 45.00 g |

TABLE 27-continued

| Compound | Composition |
|---|---|
| $H_2O$ | 100.00 g |
| Total | 173.98 g |

TABLE 28

| Compound | Composition |
|---|---|
| 16% aqueous solution of lime-treated gelatin | 62.50 g |
| Surface active agent (2) | 30.00 g |
| $H_2O$ | 67.50 g |
| Total | 160.00 g |

Next, a gelatin dispersion of the electron-providing material is described.

A uniform solution having a composition shown in Table 29 and a uniform solution having a composition shown in Table 30 were prepared and stirred for mixing. Then, the mixed solution was dispersed with a homogenizer at 10000 rpm for 10 minutes. This dispersion is called a dispersion of an electron-providing material.

TABLE 29

| Compound | Composition |
|---|---|
| Electron-providing material (1) | 10.00 g |
| Surface active agent (2) | 3.00 g |
| High boiling solvent (5) | 6.30 g |
| Anti-fogging agent (4) | 1.00 g |
| Ethyl acetate | 50.00 g |
| Total | 70.30 g |

TABLE 30

| Compound | Composition |
|---|---|
| 16% aqueous solution of lime-treated gelatin | 71.40 g |
| $H_2O$ | 70.60 g |
| Total | 142.00 g |

These emulsions and the dispersions of the dye-providing compounds were used to prepare the light-sensitive materials having constitution shown in Table 31.

TABLE 31

| Layer No. | Layer name | Additive | Coated amount (mg/m$^2$) |
|---|---|---|---|
| 7th layer | Protective layer | Acid-treated gelatin | 450 |
| | | High boiling solvent (5) | 33 |
| | | Electron-providing material (1) | 53 |
| | | Anti-fogging agent (4) | 5 |
| | | PMM matting agent | 150 |
| | | Surface active agent (9) | 27 |

TABLE 31-continued

| Layer No. | Layer name | Additive | Coated amount (mg/m$^2$) |
|---|---|---|---|
| | | Surface active agent (3) | 42 |
| | | Surface active agent (2) | 13 |
| | | $Ca(NO_3)_2$ | 5 |
| 6th layer | Intermediate layer | Gelatin | 480 |
| | | $Zn(OH)_2$ | 830 |
| | | Surface active agent (9) | 5 |
| | | Surface active agent (3) | 4 |
| | | $Ca(NO_3)_2$ | 5 |
| | | Water soluble polymer (1) | 6 |
| 5th layer | Red-sensitive layer (670 nm light-sensitive layer) | Silver halide as silver emulsion (7) | 200 |
| | | Gelatin | 280 |
| | | Dye-providing compound (E) | 280 |
| | | High boiling solvent material (3) | 140 |
| | | Electron-providing material (3) | 4 |
| | | Anti-fogging agent (3) | 4 |
| | | Surface active agent (2) | 6 |
| | | Water soluble polymer (1) | 5 |
| 4th layer | Intermediate layer | Gelatin | 390 |
| | | Surface active agent (8) | 57 |
| | | Surface active agent (3) | 6 |
| | | $Ca(NO_3)_2$ | 9 |
| | | Water soluble polymer (1) | 5 |
| 3rd layer | Near infrared-sensitive layer (750 nm light-sensitive layer) | Silver halide as silver emulsion (8) | 200 |
| | | Gelatin | 270 |
| | | Dye-providing compound (F) | 120 |
| | | Dye-providing compound (G) | 180 |
| | | High boiling solvent (5) | 160 |
| | | Stabilizer | 13 |
| | | Electron-providing material (3) | 17 |
| | | Anti-fogging agent (3) | 4 |
| | | Surface active agent (2) | 6 |
| | | Water soluble polymer (1) | 11 |
| 2nd layer | Intermediate layer | Gelatin | 440 |
| | | Surface active agent (8) | 57 |
| | | Surface active agent (3) | 6 |
| | | $Ca(NO_3)_2$ | 9 |
| | | Water soluble polymer (1) | 15 |
| | | Hardener (1) | 37 |
| 1st layer | Infrared-sensitive layer (870 nm light-sensitive layer) | Silver halide as silver emulsion (9) | 200 |
| | | Gelatin | 510 |
| | | Compound (16) in the specification | 297 |
| | | High boiling solvent (5) | 210 |
| | | Filter dye (F) | 46 |
| | | Electron-providing material (3) | 30 |
| | | Anti-fogging agent (3) | 4 |
| | | Surface active agent (2) | 37 |
| | | Water soluble polymer (1) | 12 |
| | | Stabilizer | 7 |

The support used is a paper support laminated with polyethylene and having a thickness of 135 μm.

The compounds shown in Table 31 including the compounds shown in the preparing processes of the dispersions of the dye-providing compounds and the dispersions of the electron-providing materials (refer to Table 23 to Table 30) are shown below.

Dye-providing compound (E)
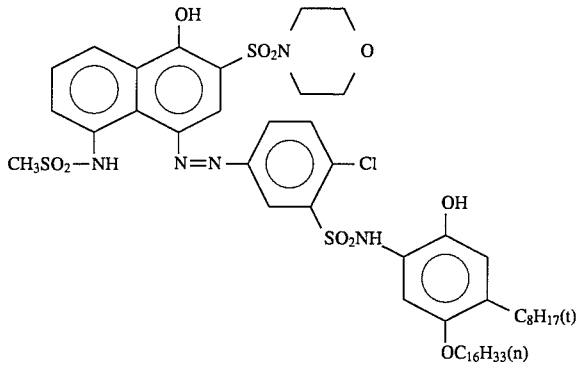
Dye-providing compound (F)
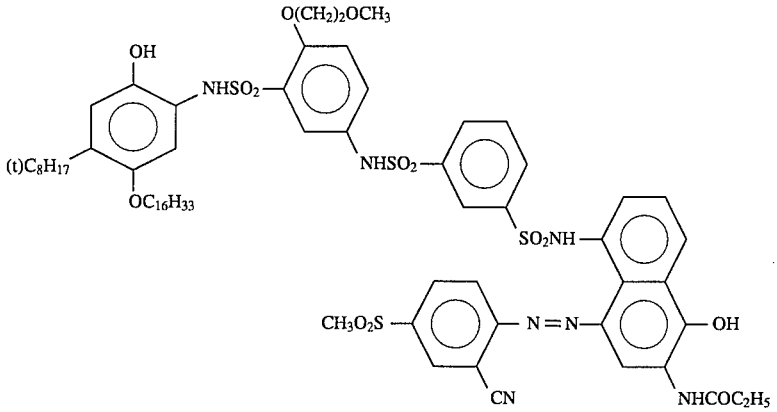
Dye-providing compound (G)
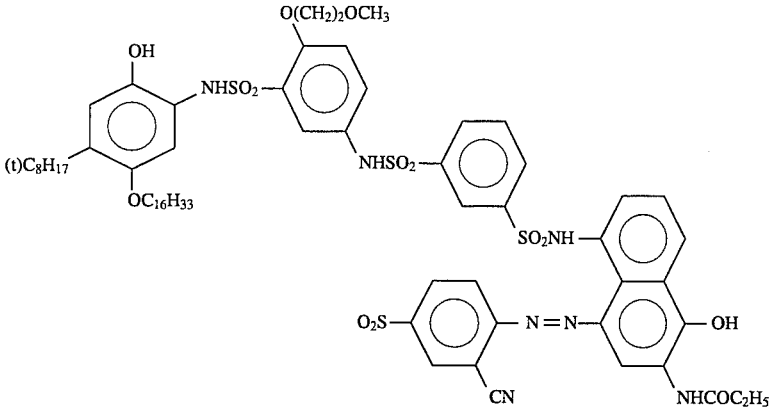

-continued
Dye-providing compound (H)
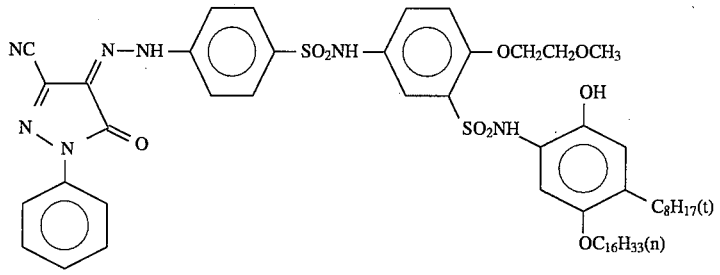
High boiling solvent (5)
$$(C_{18}H_{37}O)_3P{=}O$$
Dye (F)
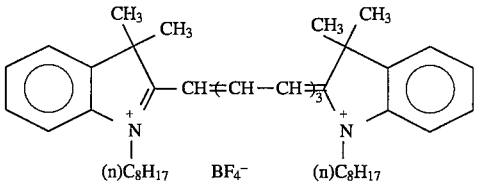
Electron-providing material (3)
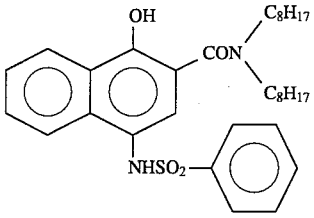
Anti-fogging agent (3)
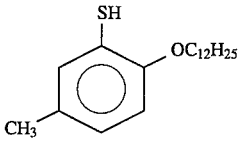
Surface active agent (8)
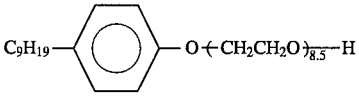
Surface active agent (9)
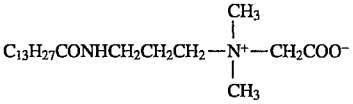

-continued

Anti-fogging agent (4)

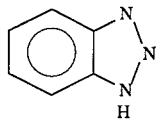

Stabilizer

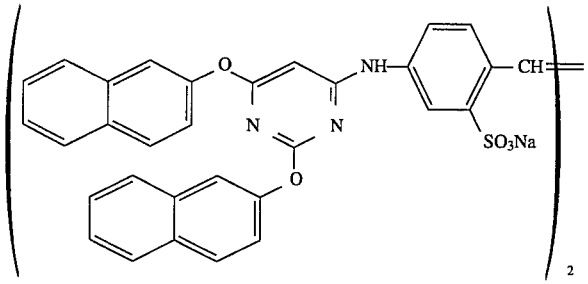

Further, light-sensitive materials 201 to 209 were prepared, except that the yellow dye-providing compound and the gelatin addition amount were changed as shown in Table 32.

Next, evaluation was carried out by the following exposure and processing. Exposure was carried out at the conditions shown in Table 33 with a laser exposing equipment described in JP-A-2-129625, and water (11 ml/m$^2$) was

TABLE 32

| Light-sensitive material | Yellow dye-providing compound and use amount thereof (mg/m$^2$) | Gelatin amount in light-sensitive layer (mg/m$^2$) | Gelatin amount in non-light-sensitive layer (mg/m$^2$) | Whole binder amount* (mg/m$^2$) |
|---|---|---|---|---|
| 201 (Inv.) | Compound (16)**<br>297 | BS layer 270<br>GS layer 360<br>RS layer 330 | 2nd layer 400<br>4th layer 430<br>6th layer 550<br>7th layer 390 | 2793 |
| 202 (Inv.) | Compound (17)**<br>278 | 270<br>360<br>330 | 400<br>430<br>550<br>390 | 2793 |
| 203 (Inv.) | Compound (18)**<br>302 | 270<br>360<br>330 | 400<br>430<br>550<br>390 | 2793 |
| 204 (Inv.) | Compound (22)**<br>305 | 270<br>360<br>330 | 400<br>430<br>550<br>390 | 2793 |
| 205 (Inv.) | Compound (23)**<br>320 | 270<br>360<br>330 | 400<br>430<br>550<br>390 | 2793 |
| 206 (Inv.) | Compound (33)**<br>263 | 270<br>360<br>330 | 400<br>430<br>550<br>390 | 2793 |
| 207 (Comp.) | Yellow dye-providing compound (C)<br>395 | 270<br>360<br>330 | 400<br>430<br>550<br>390 | 2793 |
| 208 (Comp.) | Compound (16)**<br>297 | 945<br>1260<br>1155 | 400<br>430<br>550<br>390 | 5170 |
| 209 (Comp.) | Compound (16)**<br>297 | 270<br>360<br>330 | 1000<br>1075<br>1375<br>975 | 5448 |

*including the water soluble binder (1)
**of the present invention
BS: blue-sensitive, GS: green-sensitive, RS: red-sensitive Dye-fixing material was the same as used in Example 1. supplied on an emulsion face of the exposed light-sensitive material. Then, it was superposed on the above dye-fixing material so that the film faces thereof were contacted. Heating was applied for 30 seconds with a heat drum which was adjusted to such a temperature that a temperature of the film face absorbing water became 83° C., and then the dye-fixing material was peeled off from the light-sensitive material, whereby an image was obtained on the dye fixing material.

The procedure in the above process was repeated to obtain an image, except that in order to forcibly change the conditions in developing, a temperature was adjusted so that a temperature of a film became 73° C.

TABLE 33

| | |
|---|---|
| Beam strength on a light-sensitive material face | 1 mW |
| Scanning line density | 800 dpi (32 raster per 1 mm) |
| Beam system | 100 ± 10 μm in main scanning direction; 80 ± 10 μm in secondary scanning direction |
| Exposing time | 0.9 m second per raster |
| Exposing wavelength | 670, 750, 810 nm (laser ray) |
| Exposure | 1 log E per 2.5 cm in secondary direction, variation (maximum: 80 erg/cm$^2$, minimum: 1.2 erg/cm$^2$) |
| Changing method of exposure | emitting time modulation |

The transfer density was measured with an automatic recording densitometer. There was obtained a difference from a yellow density given at 73° C. with the same exposure as that providing a yellow density of 0.7 when a development was carried out at 83° C., and it was designated as ΔD (the smaller the ΔD is, the less the influence of a temperature change is).

Further, exposing was carried out with the laser exposing equipment described above so that the fine lines of 10 lines/mm were obtained, and the same processing as that described above (a heat drum was adjusted to such a temperature that a temperature of a film absorbing water became 83° C.) was carried out to obtain an image. Then, it was left at the conditions of 60° C. and 70% RH for 3 days, and the degree of unsharpness was visually observed. The results are shown in Table 34. It can be seen that the light-sensitive materials of the present invention are less susceptible to an influence by a change in the processing conditions End that an image obtained is less susceptible to fading (the sharpness was less susceptible to reduction). The images obtained with the light-sensitive materials of the present invention were fast as well to light.

TABLE 34

| Light-sensitive material | ΔD | Degree of unsharpness |
|---|---|---|
| 201 | 0.15 | ○ |
| 202 | 0.16 | ○ |
| 203 | 0.16 | ○ |
| 204 | 0.15 | ○ |
| 205 | 0.17 | ○ |
| 206 | 0.15 | ○ |
| 207 | 0.16 | Δ |
| 208 | 0.25 | ○ |
| 209 | 0.25 | ○ |

Example 3

A preparing process for a light-sensitive emulsion is described below.

Light-sensitive silver halide emulsion (10) (for a red-sensitive emulsion layer)

Solution (I) and solution (II) each shown in Table 35 were simultaneously added to a gelatin aqueous solution (prepared by adding gelatin 20 g, potassium bromide 0.3 g, sodium chloride 2 g, and chemical (A) 30 mg to water 600 ml and maintained at a temperature of 45° C.) in the same flow rate over a period of 20 minutes while vigorously stirring. Further, five minutes later, solution (III) and solution (IV) each shown in Table 35 were simultaneously added in the same flow rate over a period of 25 minutes.

After the emulsion was subjected to washing and desalting by an ordinary process, lime-treated osein gelatin 22 g and chemical (B) 90 mg were added and pH and pAg were adjusted to 6.2 and 7.7, respectively, followed by adding a ribonucleic acid decomposition product 500 mg and trimethylthiourea 2 mg to provide an optimum chemical sensitization at 60° C. for about 50 minutes. Thereafter, 4-hydroxy-6-methyl-1,3,3a,7-tetrazaindene 225 mg, dye (J) 64 mg, and KBr 500 mg were added in order, and then the emulsion was cooled down, whereby a monodispersed cubic silver chlorobromide emulsion 635 g having an average grain size of 0.30 μm was obtained.

TABLE 35

| | Solution | | | |
|---|---|---|---|---|
| | (I) | (II) | (III) | (IV) |
| $AgNO_3$ | 30.0 g | — | 70.0 g | — |
| $NH_4NO_3$ | 0.12 g | — | 0.27 g | — |
| KBr | — | 13.7 g | — | 44.0 g |
| NaCl | — | 3.6 g | — | 2.4 g |
| $K_2IrCl_6$ | — | — | | 0.04 mg |
| Water to make | 150 ml | 150 ml | 350 ml | 350 ml |

Chemical (B)

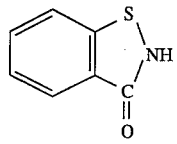

Dye (j)

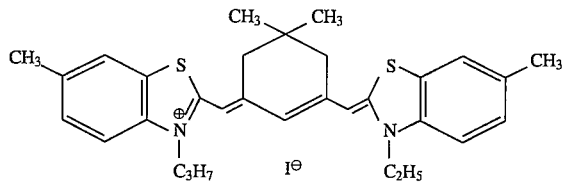

Light-sensitive silver halide emulsion (11) (for a green-sensitive emulsion layer)

Solution (I) and a solution (II) each shown in Table 36 were simultaneously added to a gelatin aqueous solution (prepared by adding gelatin 20 g, potassium bromide 0.3 g, sodium chloride 6 g, and chemical (A) 15 mg to water 700 ml and maintained at a temperature of 55° C.) in the same flow rate over a period of 20 minutes while vigorously stirring. Further, ten minutes later, solution (III) and solution (IV) each shown in Table 36 were simultaneously added in the same flow rate over a period of 20 minutes. One minute after the addition of solution (III) and solution (IV) was finished, an aqueous solution of a gelatin dispersion of a dye (containing gelatin 1.8 g and dye (d) 180 mg in water 100 ml and maintained at a temperature of 45° C.) was added in one lump.

After the emulsion was subjected to washing and desalting by an ordinary process, lime-treated osein gelatin 20 g was added and pH and pAg were adjusted to 6.0 and 7.6, respectively, followed by adding sodium thiosulfate 1 mg, 4-hydroxy-6-methyl-1,3,3a,7-tetrazaindene 47 mg, and chlorauric acid 0.6 mg to provide an optimum chemical sensitization at 68° C. Subsequently, anti-fogging agent (1) 165 mg was added and then the emulsion was cooled down, whereby a monodispersed cubic silver chlorobromide emulsion 635 g having an average grain size of 0.45 μm was obtained.

TABLE 36

| | Solution | | | |
|---|---|---|---|---|
| | (I) | (II) | (III) | (IV) |
| $AgNO_3$ | 20.0 g | — | 80.0 g | — |
| $NH_4NO_3$ | 0.19 g | — | 0.38 g | — |
| KBr | — | 9.80 g | — | 44.80 g |
| NaCl | — | 2.06 g | — | 5.51 g |
| Water to make | 165 ml | 165 ml | 205 ml | 205 ml |

Light-sensitive silver halide emulsion (12) (for a blue-sensitive emulsion layer)

Solution (I) and solution (II) each having the composition shown in Table 37 were added to a gelatin aqueous solution (prepared by adding gelatin 20 g, KBr 0.3 g, NaCl2 g, and chemical A 15 mg to water 630 ml and maintained at a temperature of 75° C.) while vigorously stirring in such a manner that first, solution (I) was added and 30 seconds later, solution (II) was added over a period of 30 minutes, respectively and further that five minutes after the addition of solution (II) was finished, solution (III) was added and 30 seconds later, solution (IV) was added over period of 30 minutes, respectively. Then, solution (III) and solution (IV) each having the composition shown in Table 37 were added over a period of 35 minutes. A 1N solution 19 ml of sodium hydroxide was added for neutralization to adjust pH of the solution to 6. Then, sodium thiosulfate 1.4 mg was added, and three minutes later, chlorauric acid 1.2 mg was added, followed by maintaining at 75° C. for 60 minutes. A solution prepared by dissolving the dye (e) 430 mg in methanol 80 ml was added and 5 minutes later, a temperature was lowered to 35° C. Thereafter, solution (v) was added over a period of 5 minutes. After the emulsion was subjected to washing and desalting (carried out with settling agent (b) at pH 3.9) by an ordinary process, lime-treated osein gelatin 6 g and the anti-fogging agent (2) 68 mg were added to adjust pH to 6.0. pAg and an electric conductivity were 8.5 and 4000 μS, respectively. The silver halide grain contained in the emulsion thus obtained was octahedral and had a grain size of 0.4 μm.

TABLE 37

| | Solution | | | | |
|---|---|---|---|---|---|
| | (I) | (II) | (III) | (IV) | (V) |
| $AgNO_3$ | 37.4 g | — | 74.9 g | — | — |
| $NH_4NO_3$ | 0.13 g | — | 0.37 g | — | — |
| KBr | — | 24.6 g | — | 49.2 g | — |
| KI | — | — | — | — | 2.0 g |
| Water to make | 200 ml | 200 ml | 400 ml | 400 ml | 190 ml |

A dispersion of zinc oxide was prepared in the same manner as described in Example 1.

Next, a preparing process of a gelatin dispersion of a dye-providing compound is described.

There were measured off cyan dye-providing compound (F) 7.3 g, cyan dye-providing compound (G) 10.6 g, surface active agent (2) 0.8 g, electron-providing material (3) 1.03 g, high boiling solvent (1) 7 g, high boiling solvent (5) 3 g, and anti-fogging agent (3) 0.23 g, and ethyl acetate 50 ml was added, followed by heating and dissolving at about 60° C. to prepare an even solution. This solution, a 14% solution 71 g of lime-treated gelatin, and water 80 ml were stirred for mixing and then was dispersed with the homogenizer at 10000 rpm for 10 minutes. After dispersing, water 180 ml for dilution was added. This dispersion is designated as the dispersion of the cyan dye-providing compound.

There were measured off magenta dye-providing compound (E) 14.93 g, electron-providing material (4) 0.48 g, surface active agent (1) 0.384 g, high boiling solvent (1) 7.4 g, and anti-fogging agent (3) 0.21 g, and ethyl acetate 50 ml was added, followed by heating and dissolving at about 60° C. to prepare an even solution. This solution, a 14% solution 71 g of lime-treated gelatin, and water 100 ml were stirred for mixing and then was dispersed with a homogenizer at 10000 rpm for 10 minutes. Thereafter, water 120 ml for dilution was added. This dispersion is designated as the dispersion of the magenta dye-providing compound.

There were measured off dye-providing compound (16) 14.1 g of the present invention, electron-providing material (3) 1.9 g, compound (1) 3.8 g, surface active agent (1) 1.74 g, and high boiling solvent (5) 9.7 g, and ethyl acetate 50 ml was added, followed by heating and dissolving at about 60° C. to prepare an even solution. This solution, a 14% solution 71 g of lime-treated gelatin, and water 73 ml were stirred for mixing and then was dispersed with the homogenizer at 10000 rpm for 10 minutes. Thereafter, water 105 ml for dilution was added. This dispersion is designated as the dispersion of the yellow dye-providing compound.

Electron-providing material (1) 10 g, surface active agent (1) 3 g, high boiling solvent (1) 6.3 g, and ethyl acetate 16 g were heated and dissolved at 60° C. to prepare a uniform solution. This solution and a 14% solution 71.4 g of acid-treated gelatin were mixed with water 70.6 g and added to a solution maintained at 55° C. After stirring, the solution was dispersed with the homogenizer at 10000 rpm for 10 minutes. This dispersion is designated as the dispersion of the electron-providing material.

Thus, the heat developable light-sensitive material 301 having the constitution shown in Table 38 was prepared.

TABLE 38

| Constitution of the light-sensitive material | | | |
|---|---|---|---|
| Layer No. | Layer name | Additive | Coated amount ($mg/m^2$) |
| 7th layer | Protective layer | Acid-treated gelatin | 390 |
| | | High boiling solvent (1) | 354 |
| | | Electron-providing material (1) | 53 |
| | | PMM matting agent | 160 |
| | | Surface active agent (9) | 6.6 |
| | | Surface active agent (3) | 69 |
| | | Surface active agent (1) | 26 |
| | | Surface active agent (6) | 1.4 |
| | | $Ca(NO_3)_2$ | 5 |
| 6th layer | Intermediate layer | Gelatin | 550 |
| | | $Zn(OH)_2$ | 305 |
| | | Surface active agent (3) | 4.8 |
| | | $Ca(NO_3)_2$ | 5 |
| | | Water soluble polymer (1) | 8 |
| 5th layer | blue-sensitive | Silver halide emulsion (12) | as silver 362 |

TABLE 38-continued

| Layer No. | Layer name | Additive | Coated amount (mg/m²) |
|---|---|---|---|
| | Constitution of the light-sensitive material | | |
| | layer | Gelatin | 330 |
| | | Dye-providing compound (16) of the present invention | 316 |
| | | Electron-providing material (3) | 43 |
| | | High boiling solvent material (5) | 197 |
| | | Compound (1) | 86 |
| | | Surface active agent (9) | 37 |
| | | Water soluble polymer | 4 |
| 4th layer | Inter-mediate layer | Gelatin | 430 |
| | | Hardener | 34 |
| | | Surface active agent (4) | 90 |
| | | $Ca(NO_3)_2$ | 9 |
| | | Water soluble polymer (1) | 19 |
| 3rd layer | Green-sensitive layer | Silver halide emulsion (11) | as silver 360 |
| | | Gelatin | 360 |
| | | Dye-providing compound (E) | 370 |
| | | Electron-providing material (4) | 12 |
| | | High boiling solvent (1) | 185 |
| | | Anti-fogging agent (3) | 5.2 |
| | | Surface active agent (1) | 10 |
| | | Water soluble polymer (1) | 5 |
| 2nd layer | Inter-mediate layer | Gelatin | 400 |
| | | $Zn(OH)_2$ | 305 |
| | | Surface active agent (4) | 94 |
| | | Surface active agent (1) | 7 |
| | | $Ca(NO_3)_2$ | 9 |
| | | Water soluble polymer (1) | 15 |
| 1st layer | Red-sensitive layer | Silver halide emulsion (10) | as silver 180 |
| | | Gelatin | 270 |
| | | Dye-providing compound (F) | 125 |
| | | Dye-providing compound (G) | 187 |
| | | Electron-providing material (3) | 18 |
| | | High boiling solvent (1) | 120 |
| | | High boiling solvent (5) | 52 |
| | | Surface active agent (2) | 14 |
| | | Anti-fogging agent (3) | 4 |
| | | Water soluble polymer (1) | 12 |
| | | Stabilizer | 4 |
| Support (1): | | paper support laminated with polyethylene (thickness: 131 μm) | |

Further, heat developable light-sensitive materials 302 to 309 were prepared in the same manner, except that the kind and addition amount of the yellow dye-providing compound used and the amount of gelatin were changed as shown in Table 39.

Electron-providing material (4)

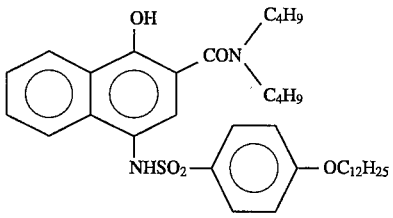

-continued

Stabilizer

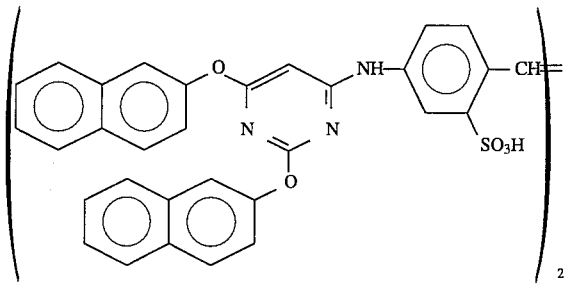

TABLE 39

| Light-sensitive material | Yellow dye-providing compound and use amount thereof (mg/m²) | Gelatin amount in light-sensitive layer (mg/m²) | Gelatin amount in non-light-sensitive layer (mg/m²) | Whole binder amount* (mg/m²) |
|---|---|---|---|---|
| 301 (Inv.) | Compound (16)** 316 | IRS layer 510 NRS layer 270 RS layer 280 | 2nd layer 440 4th layer 390 6th layer 480 7th layer 450 | 2906 |
| 302 (Inv.) | Compound (17)** 296 | 510 270 280 | 440 390 480 450 | 2906 |
| 303 (Inv.) | Compound (18)** 321 | 510 270 280 | 440 390 480 450 | 2906 |
| 304 (Inv.) | Compound (22)** 324 | 510 270 280 | 440 390 480 450 | 2906 |
| 305 (Inv.) | Compound (23)** 340 | 510 270 280 | 440 390 480 450 | 2906 |
| 306 (Inv.) | Compound (33)** 280 | 510 270 280 | 440 390 480 450 | 2906 |
| 307 (Comp.) | Yellow dye-providing compound (C) 420 | 510 270 280 | 440 390 480 450 | 2906 |
| 308 (Comp.) | Compound (16)** 316 | 1785 945 980 | 440 390 480 450 | 5556 |
| 309 (Comp.) | Compound (16)** 316 | 510 270 280 | 1100 975 1200 1125 | 5460 |

*including the water soluble binder (1)
**of the present invention
IRS: infrared-sensitive, NRS: near infrared-sensitive, RS: red-sensitive The dye-fixing material was prepared in the same manner as described in Example 1.

Next, heat developable light-sensitive materials 301 to 309 were subjected to the following exposure and processing.

An adjustment was carried out with a tungsten lump and Fuji CC filter manufactured by Fuji Photo Film Co., Ltd. so that a gray density of 0.7 was met, and exposing was carried out through a gray wedge having the continuously changed density at 2500 lux for 1/10".

Water for wetting was supplied with a wire bar on the emulsion surface of the light-sensitive material exposed and then superposed on the dye-fixing material so that the film faces thereof were contacted. Heating was applied for 30 seconds with a heater which was adjusted to such a temperature that a temperature of a film absorbing water became 83° C., and then the dye-fixing material was peeled off from the light-sensitive material to thereby obtain an image on the dye-fixing material. The procedure in the above process was repeated to obtain an image, except that in order to forcibly change the conditions in developing, a temperature was adjusted so that a temperature of the film became 73° C.

The transfer density was measured with an automatic recording densitometer. There was obtained a difference from a yellow density given with the same exposure as that providing a yellow density of 0.7 when a development was carried out at 83° C., and it was designated as ΔD (the smaller the ΔD is, the less the influence of a temperature change is).

Further, after a gray density was adjusted in the same manner as that described above, exposing was carried out through a wedge having the fine lines of 10 lines/mm (an exposure was adjusted so that the fine lines could be obtained), and then the same processing as that described above was carried out to thereby obtain an image on the dye-fixing material. After this image was left the forcible conditions of 60° C.–80% RH for 3 days, the degree of unsharpness (reduction in sharpness) was visually observed. The results are shown in Table 40.

TABLE 40

| Light-sensitive material | ΔD | Degree of unsharpness |
|---|---|---|
| 301 | 0.20 | o |
| 302 | 0.21 | o |
| 303 | 0.22 | o |
| 304 | 0.23 | o |
| 305 | 0.22 | o |
| 306 | 0.21 | o |
| 307 | 0.22 | Δ |
| 308 | 0.40 | o |
| 309 | 0.40 | o |

It can been seen from the results that the light-sensitive materials of the present invention are less susceptible to an influence by a change in the processing conditions and that an image obtained is less susceptible to fading.

Further, the images obtained in the present invention were fast particularly to light.

Example 4

Light-sensitive material 401 was prepared in the same manner as that in the light-sensitive material 101 of Example 1, except that a gelatin dispersion of a hydrophobic additive was prepared in the composition shown in Table 41 and a layer structure of the light-sensitive material was changed as shown in Table 42.

TABLE 41

| | Cy-1 | M-1 | Y-1 | EPM* |
|---|---|---|---|---|
| Oil phase | | | | |
| Dye-providing material (A) | 9.05 g | — | — | — |
| Dye-providing material (B) | 6.19 g | — | — | — |
| Dye-providing material (C) | — | 15.5 g | — | — |
| Dye-providing material (D) | — | | 13.0 g | — |
| Electron-providing material (1) | 4.84 g | 5.61 g | 4.53 g | — |
| Electron-providing material (2) | — | — | — | 13.87 g |
| Inhibitor-releasing redox compound (1) | — | — | — | 2.62 g |
| Electron transfer agent precursor | 1.42 g | 1.42 g | 0.86 g | — |
| Compound (1) | 0.40 g | 0.44 g | 0.40 g | — |
| Compound (2) | 1.53 g | 1.94 g | — | — |
| Compound (3) | 1.52 g | 1.94 g | — | — |
| High boiling solvent (1) | 1.91 g | 1.94 g | 5.20 g | — |
| High boiling solvent (2) | — | — | 3.90 ml | — |
| High boiling solvent (3) | 5.72 g | 5.81 g | — | 2.93 g |
| High boiling solvent (4) | — | — | — | 2.94 g |
| Surface active agent (2) | 1.55 g | 0.52 g | 1.50 g | 0.45 g |
| Ethyl acetate | 34.5 ml | 34.5 ml | 25.0 ml | 18.0 ml |
| Methyl ethyl ketone | 47.5 ml | 47.5 ml | — | — |
| Aqueous phase | | | | |
| Lime-treated gelatin | 10.0 g | 10.0 g | 10.0 g | 10.0 g |
| Citric acid | — | — | 0.14 g | 0.14 g |
| Sodium hydrogen-sulfite | — | — | — | 0.15 g |
| 3-Benzoisothiazolone | 0.06 g | 0.07 g | 0.05 g | 0.10 g |
| Water | 130 ml | 130 ml | 120 ml | 100 ml |
| Water | 130 ml | 140 ml | 120 ml | 60 ml |

*Electron-providing material

TABLE 42

Constitution of light-sensitive material 101

| Layer No. | Layer name | Additive | Coated amount (mg/m²) |
|---|---|---|---|
| 7th layer | Protective layer II | Acid-treated gelatin | 340 |
| | | PMMA latex (size: 3μ) | 20 |
| | | Colloidal silver | 0.7 |
| | | Anionic surface active agent (1) | 8 |
| | | Surface active agent (3) | 22 |
| 6th layer | Protective layer I | Lime-treated gelatin | 230 |
| | | Dispersion of zinc hydroxide | 2590 |
| | | Gelatin dispersion of the electron-providing material | 1050 |
| | | Dispersion of the dye-trapping agent | 740 |
| | | Dextran | 15 |
| | | Water soluble polymer (1) | 2 |
| 5th layer | Blue-sensitive emulsion | Light-sensitive silver halide emulsion (5) | 3080 |
| | | Light-sensitive silver | 940 |

TABLE 42-continued

| Constitution of light-sensitive material 101 | | | |
|---|---|---|---|
| Layer No. | Layer name | Additive | Coated amount (mg/m²) |
| | layer | halide emulsion (6) | |
| | | Dispersion of the yellow dye-providing compound | 8310 |
| | | Water soluble polymer (1) | 10 |
| 4th layer | Intermediate layer | Lime-treated gelatin | 390 |
| | | Gelatin dispersion of the electron transfer agent | 780 |
| | | Gelatin dispersion of the electron-providing material | 2360 |
| | | Dispersion of the dye-trapping agent | 1040 |
| | | Dextran | 40 |
| | | Water soluble polymer (1) | 18 |
| | | Hardener (1) | 39 |
| 3rd layer | Green-sensitive emulsion layer | Light-sensitive silver halide emulsion (3) | 2460 |
| | | Light-sensitive silver halide emulsion (4) | 1000 |
| | | Dispersion of the magenta dye-providing compound | 8690 |
| | | Water soluble polymer (1) | 13 |
| 2nd layer | Intermediate layer | Lime-treated gelatin | 410 |
| | | Dispersion of zinc hydroxide | 4870 |
| | | Gelatin dispersion of the electron-providing material | 1940 |

TABLE 42-continued

| Constitution of light-sensitive material 101 | | | |
|---|---|---|---|
| Layer No. | Layer name | Additive | Coated amount (mg/m²) |
| | | Dispersion of the dye-trapping agent | 1370 |
| | | Dextran | 29 |
| | | Water soluble polymer (1) | 4 |
| 1st layer | Red-sensitive emulsion layer | Light-sensitive silver halide emulsion (1) | 1080 |
| | | Light-sensitive silver halide emulsion (2) | 580 |
| | | Dispersion of the cyan dye-providing compound | 7580 |
| | | Water soluble polymer (1) | 7 |
| | | Surface active agent (4) | 54 |
| Suppot (1) | | Paper support laminated with polyethylene (thickness: 131 μm) | |

Dispersions Cy-2 to Cy-3 of the cyan dye-providing compounds, dispersions M-2 to M-3 of the magenta dye-providing compounds, and dispersions Y-2 to Y-3 of the yellow dye-providing compounds each shown in Table 43 were prepared in the same manner as those in the process for preparing the gelatin dispersions of the hydrophobic additives described above, except that the dye-providing materials were changed and that the amounts of electron-providing material (1) and high boiling solvents (1) to (3) were changed.

TABLE 43

| | Dye-providing compound | | Electron-providing | High boiling solvent | | |
|---|---|---|---|---|---|---|
| Dispersion | Compound | Amount | material (1) | (1) | (2) | (3) |
| Cy-2 | C-1* | 7.19 g | 2.42 g | 1.52 g | — | 4.56 g |
| | C-2* | 4.95 g | | | | |
| Cy-3 | C-13* | 7.09 g | 2.42 g | 1.50 g | — | 4.50 g |
| | C-14* | 4.89 g | | | | |
| M-2 | M-1* | 12.3 g | 2.81 g | 1.54 g | — | 4.61 g |
| M-3 | M-8* | 12.1 g | 2.81 g | 1.51 g | — | 4.54 g |
| Y-2 | Y-1* | 19.3 g | 2.27 g | 3.86 g | 2.90 ml | — |
| Y-3 | Y-14* | 18.9 g | 2.27 g | 3.79 g | 2.84 ml | — |

*concrete example compound.
Comparative dye-providing compound

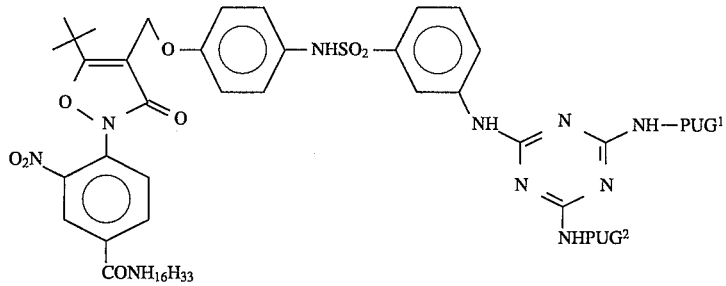

Cy-(a) Cy-(b)

TABLE 43-continued

PUG¹ = PUG² =

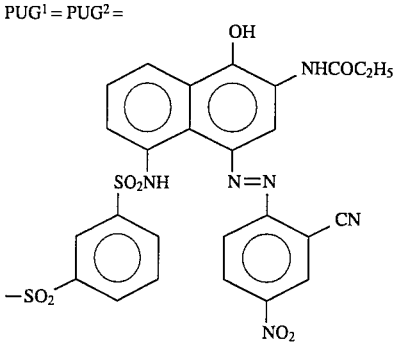

M-(a)

PUG¹ = PUG² =

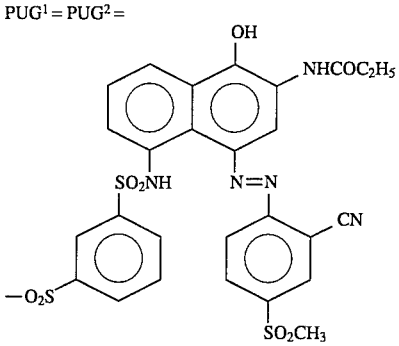

Y-(a)

PUG¹ = PUG² =

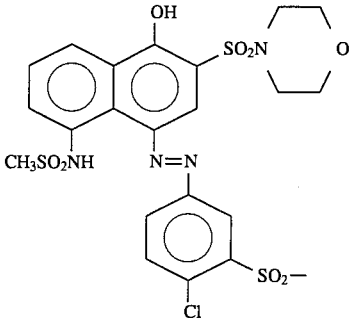

PUG¹ = PUG² =

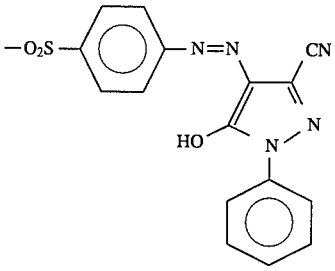

Light-sensitive material 402 to 409 shown in Table 44 were. prepared in the same manner as for the light-sensitive material 401, except that the gelatin dispersions of the dye-providing compounds contained in the first layer, the third layer, and the fifth layer in light-sensitive material 401 were changed to the gelatin dispersions of the dye-providing compounds shown in Table 43.

TABLE 44

| Light-sensitive material | 1st layer | 3rd layer | 5th layer |
|---|---|---|---|
| 401 | Cy-1 | M-1 | Y-1 |
| 402 | Cy-1 | M-1 | Y-2 |
| 403 | Cy-1 | M-1 | Y-3 |
| 404 | Cy-1 | M-2 | Y-1 |
| 405 | Cy-1 | M-3 | Y-1 |
| 406 | Cy-2 | M-1 | Y-1 |
| 407 | Cy-3 | M-1 | Y-1 |
| 408 | Cy-2 | M-2 | Y-2 |
| 409 | Cy-3 | M-3 | Y-3 |

The above light-sensitive materials 401 to 409 and PS paper PS-SG manufactured by Fuji Photo Film Co., Ltd. as an image-receiving material were used for processing with Pictrostat 200 as an image recording equipment manufactured by Fuji Phogo Film Co., Ltd.

That is, the light-sensitive material was subjected to scanning exposure via an original picture (a test chart on which the wedges of Y, M, Cy and gray each having a continuously changed density are recorded) through a slit. After the light-sensitive material thus exposed was dipped in water maintained at 45° C. for about 2.5 seconds, it was squeezed with rollers and immediately superposed on the image-receiving material so that the film faces thereof were contacted. Then, heating was applied for 17 seconds with a heat drum which was adjusted to such a temperature that a temperature of a film face absorbing water became 82° C., and the light-sensitive material was peeled off from the image-receiving material, whereby a sharp color image corresponding to the original picture was obtained on the image-receiving material.

Further, the processing was carried out in the same manner as described above, except that in order to forcibly change a developing condition, the temperature of a layer face absorbing water was settled at 87° C., whereby an image was obtained on the image-receiving material.

With respect to the density measurement, densitometer X Light 404 manufactured by X Light Co., Ltd. was used to measure the reflection density, and the differences between the maximum densities and the minimum densities of the respective images obtained in the above two conditions were designated as ΔDmax and ΔDmin, respectively, to evaluate the performances (the smaller the values of ΔDmax and ΔDmin are, the less the light-sensitive materials are susceptible to a fluctuation in the developing condition). Further, a value of Dmin/Dmax (heat development at 82° C.) was obtained as a standard for a discrimination of an image and compared (the lower the value is, the higher the discrimination is). ΔDmin and ΔDmax were shown by the differences between a development at 82° C. and a development at 87° C. in case of setting a heating time at 12 seconds.

It can be seen that the samples of the present invention have less changes in Dmax and Dmin due to a fluctuation in temperature, particularly in case of changing to a short time processing.

The color images obtained above were left for standing at 60° C.–70% for 3 days and the images obtained with the light-sensitive materials of the present invention had less n;rrf and were excellent as compared with the comparative light-sensitive materials.

The results are shown in Tables 45 and 46.

TABLE 45

| Light-sensitive material | Relative* sensitivity | | | ΔDmin (17 sec processing) | | | ΔDmax (17 sec processing) | | | Dmin/Dmax | | |
|---|---|---|---|---|---|---|---|---|---|---|---|---|
| | Cy | M | Y | Cy | M | Y | Cy | M | Y | Cy | M | Y |
| 401 | 100 | 100 | 100 | 0.03 | 0.02 | 0.02 | 0.04 | 0.03 | 0.04 | 0.04 | 0.05 | 0.05 |
| 402 | 100 | 100 | 160 | 0.03 | 0.02 | 0.03 | 0.04 | 0.03 | 0.05 | 0.04 | 0.05 | 0.05 |
| 403 | 100 | 100 | 155 | 0.03 | 0.02 | 0.02 | 0.04 | 0.03 | 0.04 | 0.05 | 0.05 | 0.05 |
| 404 | 100 | 135 | 100 | 0.03 | 0.02 | 0.02 | 0.04 | 0.03 | 0.04 | 0.04 | 0.05 | 0.05 |
| 405 | 100 | 170 | 100 | 0.03 | 0.02 | 0.02 | 0.04 | 0.03 | 0.04 | 0.04 | 0.05 | 0.04 |
| 406 | 150 | 100 | 100 | 0.03 | 0.31 | 0.02 | 0.04 | 0.02 | 0.04 | 0.04 | 0.05 | 0.04 |
| 407 | 155 | 100 | 100 | 0.03 | 0.02 | 0.02 | 0.04 | 0.03 | 0.04 | 0.04 | 0.05 | 0.04 |
| 408 | 155 | 140 | 160 | 0.04 | 0.02 | 0.02 | 0.04 | 0.03 | 0.04 | 0.04 | 0.04 | 0.04 |
| 409 | 160 | 145 | 150 | 0.03 | 0.02 | 0.02 | 0.04 | 0.03 | 0.04 | 0.04 | 0.05 | 0.04 |

*Relative sensitivity is a value relative to each of the sensitivities, which are taken as 100, of the respective layers of light-sensitive material 401 at a portion with a density of 0.7.

TABLE 46

| Light-sensitive material | ΔDmin (12 sec processing) | | | ΔDmax (12 sec processing) | | |
|---|---|---|---|---|---|---|
| | Cy | M | Y | Cy | M | Y |
| 401 | 0.03 | 0.03 | 0.03 | 0.09 | 0.08 | 0.08 |
| 402 | 0.03 | 0.02 | 0.03 | 0.08 | 0.08 | 0.05 |
| 403 | 0.03 | 0.02 | 0.02 | 0.07 | 0.08 | 0.04 |
| 404 | 0.03 | 0.02 | 0.02 | 0.08 | 0.03 | 0.08 |
| 405 | 0.03 | 0.02 | 0.02 | 0.08 | 0.03 | 0.08 |
| 406 | 0.03 | 0.03 | 0.02 | 0.04 | 0.08 | 0.08 |
| 407 | 0.03 | 0.02 | 0.02 | 0.04 | 0.07 | 0.07 |
| 408 | 0.04 | 0.02 | 0.02 | 0.04 | 0.03 | 0.04 |
| 409 | 0.03 | 0,02 | 0.02 | 0.04 | 0.03 | 0.04 |

Example 5

Light-sensitive material 501 was prepared in the same manner as for light-sensitive material 201 in Example 2, except that dye-providing compounds (yellow) contained in the first layer was changed to the following compound (the same amount).

[Ka 64]

Yellow dye-providing material (H)

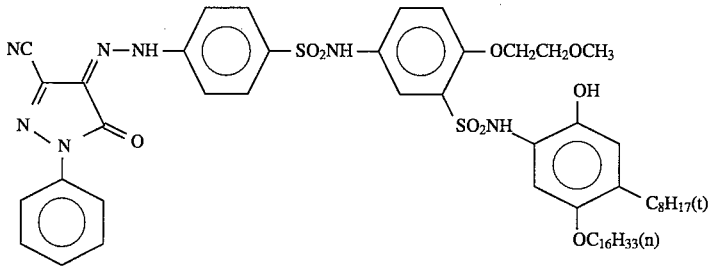

Further, the dispersions of the magenta dye-providing compounds, the dispersions of the cyan dye-providing compounds, and the dispersions of the yellow dye-providing compounds each shown in Table 47 were prepared in the same manners as those in the process for preparing the gelatin dispersions of the hydrophobic additives, except that the dye-providing materials were changed and that the amount of the high boiling solvent was changed.

TABLE 47

| Disper-sion | Dye-providing compound | | High boiling solvent (5) |
|---|---|---|---|
| | Compound | Amount | |
| M-5 | (E) | 14.64 | 7.32 |
| M-6 | M-15 | 14.06 | 7.03 |
| Cy-5 | (F) | 7.25 | 9.83 |
| | (G) | 10.63 | |
| Cy-6 | C-30 | 5.77 | 7.95 |
| | C-29 | 8.69 | |
| Y-5 | (H) | 17.25 | 8.63 |
| Y-6 | Y-17 | 12.76 | 6.38 |

Light-sensitive materials 502 to 505 shown in Table 48 were prepared in the same manner as for light-sensitive material 501, except that the gelatin dispersions of the dye-providing compounds contained in the first layer, the third layer and the fifth layer in light-sensitive material 501 were changed to the gelatin dispersions of the dye-providing compounds shown in Table 47.

TABLE 48

| Light-sensitive material | 1st layer | 3rd layer | 5th layer |
|---|---|---|---|
| 501 | Y-5 | Cy-5 | M-5 |
| 502 | Y-6 | Cy-5 | M-5 |
| 503 | Y-5 | Cy-6 | M-5 |
| 504 | Y-5 | Cy-5 | M-6 |
| 505 | Y-6 | Cy-6 | M-6 |

The above light-sensitive materials 501 to 505 and PS paper manufactured by Fuji Photo Film Co., Ltd. as an image-receiving material were used to obtain an image on an image-receiving material in the same manner as described in Example 2.

Further, an image was obtained on the image-receiving material in the same manner, except that in order to forcibly change a developing condition, the development was carried out with a heat drum which was adjusted to such a temperature that a temperature of a layer absorbing water became 88° C. With respect to a density measurement, densitometer X Light 404 manufactured by X Light Co., Ltd. was used to measure the reflection density, and the variation ranges in the maximum densities and the minimum densities obtained in the above two conditions were designated as ΔDmax and ΔDmin, respectively (the smaller the values of ΔDmax and ΔDmin are, the less the light-sensitive materials are susceptible to a fluctuation in the developing condition). Further, the values of Dmin/Dmax (83° C.) and the differrences in Dmax and Dmin due to a fluctuation in a developing temperature in a short time processing (20 seconds)were measured as well.

TABLE 49

| Light-sensitive | ΔDmin (3 sec processing) | | | ΔDmax (20 sec processing) | | | Dmin/Dmax | | |
|---|---|---|---|---|---|---|---|---|---|
| material | Cy | M | Y | Cy | M | Y | Cy | M | Y |
| 201 | 0.05 | 0.09 | 0.08 | 0.03 | 0.06 | 0.07 | 0.04 | 0.05 | 0.05 |
| 202 | 0.05 | 0.09 | 0.07 | 0.03 | 0.06 | 0.06 | 0.04 | 0.05 | 0.05 |
| 203 | 0.05 | 0.10 | 0.08 | 0.03 | 0.06 | 0.07 | 0.05 | 0.05 | 0.05 |
| 204 | 0.05 | 0.09 | 0.08 | 0.03 | 0.06 | 0.07 | 0.04 | 0.04 | 0.05 |
| 205 | 0.05 | 0.09 | 0.07 | 0.03 | 0.06 | 0.06 | 0.05 | 0.04 | 0.05 |

TABLE 50

| Light-sensitive | ΔDmin (20 sec processing) | | | ΔDmax (20 sec processing) | | |
|---|---|---|---|---|---|---|
| material | Cy | M | Y | Cy | M | Y |
| 201 | 0.14 | 0.15 | 0.11 | 0.03 | 0.05 | 0.05 |
| 202 | 0.13 | 0.15 | 0.05 | 0.03 | 0.05 | 0.04 |
| 203 | 0.14 | 0.08 | 0.11 | 0.03 | 0.04 | 0.05 |
| 204 | 0.07 | 0.15 | 0.11 | 0.03 | 0.05 | 0.05 |
| 205 | 0.07 | 0.07 | 0.04 | 0.03 | 0.04 | 0.04 |

The color images obtained above were left for standing at 60° C.–70% for 3 days and the images obtained with the light-sensitive materials of the present invention had less bleed and were excellent as compared with the comparative light-sensitive materials.

While the invention has been described in detail and with reference to specific embodiments thereof, it will be apparent to one skilled in the art that various changes and modifications can be made therein without departing from the spirit and scope thereof.

What is claimed is:

1. A heat developable color light-sensitive material comprising a support having thereon at least light-sensitive silver halide, a binder, and a dye-providing compound, wherein at least one of the compounds represented by formula (1) is contained as said dye-providing compound, and the amount of said binder is 5 g/m$^2$ or less, $$[(\mathrm{Dye})_p\text{-}X]_q\text{-}Y \qquad (1)$$

wherein Dye represents a dye group or a dye precursor group represented by the following formula (2); Y represents a group which is able to differentiate a diffusibility of a dye component corresponding or inversely corresponding with a light-sensitive silver halide having an imagewise latent image; X represents a mere bond or a linkage group; p represents an integer of 1 or more and q represents 1 or 2; and when p is 2 or more or q is 2, all of Dye or $(\mathrm{Dye})_p$-X may be the same of different:

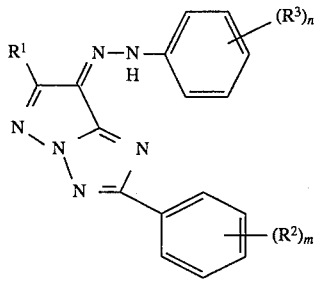

(2)

wherein $R^1$ represents a substituent selected from the group consisting of a hydrogen atom, a halogen atom, a hydroxyl group, a cyano group, a nitro group, a carboxyl group, a substituted or unsubstituted alkyl group, a cycloalkyl group, an aryl group, a heterocycle residue, an alkoxy group, an aryloxy group, an amino group, an acylamino group, a sulfonylamino group, an acyl group, a sulfonyl group, a carbamoyl group, a sulfamoyl group, a ureido group, an alkylthio group, and an arylthio group; $R^2$ and $R^3$, which may be the same of different, each is the same as $R^1$, except that a hydrogen atom which is a substituent defined for $R^1$ is excluded; m and n each represents an integer of 0 to 5, and when m or n is 2 or more $mR^2$ groups or $nR^3$ groups may the same or different; and Dye and X are bonded Via any one of $R^1$, $R^2$ and $R^3$ in formula (2).

2. The material of claim 1, wherein X is a linking group.

3. The material of claim 2, wherein said linkage group is —$NR^4SO_2$—, —$N^4CO$—, —O—, —$SO_2$— or a combination thereof, wherein $R^4$ is a hydrogen atom, an alkyl group, an aryl group, or an aralkyl group.

4. The material of claim 1, wherein Y is a group which differentiates diffusibility of a dye corresponding with said latent image.

5. The material of claim 1, wherein Y is a group which differentiates diffusibility of a dye inversely corresponding with said latent image.

6. The material of claim 1, wherein Y further comprises at least on ballast group of at least 10 carbon atoms.

7. The material of claim 1 where Dye is bonded to X at the $R^2$ or $R^3$ group.

* * * * *